US009206595B2

(12) United States Patent
Rutledge

(10) Patent No.: US 9,206,595 B2
(45) Date of Patent: Dec. 8, 2015

(54) HANDMADE STRUCTURE SYSTEM

(76) Inventor: Richard Bruce Rutledge, Bloomfield, KY (US)

( * ) Notice: Subject to any disclaimer, the term of this patent is extended or adjusted under 35 U.S.C. 154(b) by 433 days.

(21) Appl. No.: 13/153,453

(22) Filed: Jun. 5, 2011

(65) Prior Publication Data

US 2012/0304549 A1 Dec. 6, 2012

(51) Int. Cl.

| | |
|---|---|
| ***E04B 1/00*** | (2006.01) |
| ***E04H 1/00*** | (2006.01) |
| ***E04B 1/343*** | (2006.01) |
| ***E04B 7/02*** | (2006.01) |
| ***E04D 13/064*** | (2006.01) |
| ***E04D 13/08*** | (2006.01) |
| *E04C 3/32* | (2006.01) |

(52) U.S. Cl.

CPC ..... *E04B 1/34315* (2013.01); *E04B 7/026* (2013.01); *E04B 7/028* (2013.01); *E04D 13/064* (2013.01); *E04D 13/0645* (2013.01); *E04D 13/08* (2013.01); *E04C 3/32* (2013.01)

(58) Field of Classification Search

CPC ..... E04D 13/0645; E04D 13/064; E04B 1/34315; E04B 7/026; E04H 1/12–1/14

USPC ..... 52/362, 264, 270, 271, 79.1, 79.12

See application file for complete search history.

(56) References Cited

U.S. PATENT DOCUMENTS

| | | | | |
|---|---|---|---|---|
| 2,841,977 | A * | 7/1958 | Kok | 52/601 |
| 3,504,472 | A * | 4/1970 | Clement | 52/477 |
| 3,571,965 | A * | 3/1971 | Gibb | 446/105 |
| 4,074,488 | A * | 2/1978 | Ray, III | 52/263 |
| 4,561,232 | A * | 12/1985 | Gladden et al. | 52/385 |
| 4,567,709 | A * | 2/1986 | Faw | 52/745.14 |
| 5,323,575 | A * | 6/1994 | Yeh | 52/177 |
| 5,779,517 | A * | 7/1998 | Clarke | 446/108 |
| 6,209,267 | B1 | 4/2001 | Dantzer | |
| 6,694,689 | B1 * | 2/2004 | Scott et al. | 52/392 |
| 6,701,678 | B1 * | 3/2004 | Skov et al. | 52/79.9 |
| 6,721,967 | B2 * | 4/2004 | Braxton | 4/664 |
| 6,796,087 | B1 * | 9/2004 | Greene | 52/32 |
| 6,889,475 | B2 * | 5/2005 | De Zen | 52/91.3 |
| 7,007,429 | B2 * | 3/2006 | Kim | 52/16 |
| D529,186 | S * | 9/2006 | Fullelove et al. | D25/33 |
| 7,395,634 | B2 * | 7/2008 | Anderson et al. | 52/79.1 |
| 7,487,622 | B2 * | 2/2009 | Wang | 52/384 |
| 7,509,776 | B2 * | 3/2009 | Reisman | 52/281 |
| 7,895,793 | B1 * | 3/2011 | Yates | 52/12 |
| 7,895,794 | B2 * | 3/2011 | Pope | 52/67 |
| 8,011,148 | B2 * | 9/2011 | Bertke et al. | 52/263 |
| 8,353,131 | B2 * | 1/2013 | Freet | 52/79.9 |

(Continued)

*Primary Examiner* — Elizabeth A Plummer

(57) ABSTRACT

A system of integrated structural components, designed to fit and connect together using no tools other than human hands, allowing persons with little or no construction experience to assemble floored/partitioned/roofed structures of variable shape(s) and surface area(s). Flooring panels are inserted and secured into flooring frames that have been inserted and secured into frame connectors. Flooring frames may be anchored into an outdoor installation surface for long term use. Certain configurations of the frame connector allow for the installation of variable height partition supports, as well as partition panels. A special configuration of the flooring frame allows for wheeled implement/conveyance access to the floored surface from the surrounding surface. Open, unfloored areas may be created within the periphery of a structure. Roof panels are installed onto and supported by roof brackets, roof beams and integrated gutter sections. Precipitation is conveyed to downspout pipes and fittings via downspouts.

8 Claims, 38 Drawing Sheets

(56) References Cited

U.S. PATENT DOCUMENTS

| | | | | |
|---|---|---|---|---|
| 8,424,258 | B2 * | 4/2013 | Modica et al. | 52/285.4 |
| 8,584,404 | B2 * | 11/2013 | Heidenreich | 52/79.5 |
| 8,596,012 | B2 * | 12/2013 | Franchini | 52/587.1 |
| 8,650,807 | B2 * | 2/2014 | McKimmy et al. | 52/79.9 |
| 8,776,449 | B1 * | 7/2014 | Rowan | 52/79.1 |
| 2005/0076590 | A1 * | 4/2005 | Wang et al. | 52/263 |
| 2005/0246968 | A1 * | 11/2005 | Wood | 52/79.12 |
| 2007/0056223 | A9 * | 3/2007 | Hunt | 52/79.1 |
| 2007/0074462 | A1 * | 4/2007 | Linares | 52/79.1 |
| 2010/0287848 | A1 * | 11/2010 | Pepin | 52/79.9 |
| 2011/0179722 | A1 * | 7/2011 | Schulz et al. | 52/79.1 |

* cited by examiner 45
122
1702

121
45
1701

45
123
1703

45
124
1704

45
126
1705

HANDMADE STRUCTURE SYSTEM

RELATED APPLICATIONS

The present application is incorporated by reference to provisional application 61/351,911, confrmation number 9568.

FIELD OF THE INVENTION

The present invention relates to the assembly of temporary or permanent structures (landscape or garden borders, enclosures, decking, walkways, platforms, sheds, cabins, shelters, mazes or other general, non-fixed configurations of variably-partitioned spaces, bulletin boards or other configurations of vertical display surfaces or barrier walls, etc.), fully or partially roofed, and/or fully or partially floored, and/or fully or partially enclosed by walls, windows, doors, or railings, indoors or outdoors, and more particularly, to assembling temporary or permanent indoor or outdoor structures (landscape or garden borders, enclosures, decking, walkways, platforms, sheds, cabins, shelters, mazes or other general, non-fixed configurations of variably-partitioned spaces, bulletin boards or other configurations of vertical display surfaces or barrier walls, etc.) fully or partially roofed, and/or fully or partially floored, and/or fully or partially enclosed by walls, windows, doors, or railings, without requiring the use of any tools other than human hands for assembly. The final configuration of structures or assemblies is accomplished by using different combinations and quantities of components from the present invention, which is a system of integrated structural components collectively referred to, described, and defined herein as the Handmade Structure System.

BACKGROUND OF THE INVENTION

The building of structures or assemblies for recreational or utility purposes (decks, walkways, platforms, shelters, bulletin board displays, sheds, mazes, etc.) traditionally requires the person building the structure to have at least moderate carpentry and construction skills. In addition, tools and materials such as hammers, nails, screws and screwdrivers, saws, etc., are required. Depending on the size and scale of the project, it also can be necessary to dig holes or trenches for a foundation, mix and pour cement for that foundation (or buy concrete pre-mixed, and pay delivery charges), then, upon completion of the task, remove the resultant spoils and unused (wasted) construction materials. All of these require significant physical effort, are time-consuming, and of significant expense. Adding railings to such structures or assemblies, or wall-height partitions for privacy and/or security, and partially or fully roofing such structures or assemblies adds to the effort, complexity, and expense.

One previous attempt to achieve some of the benefits of a systematized approach is disclosed in U.S. Pat. No. 6,209,267 to Dantzer, described as a modular decking system for use in constructing a square or rectangular deck of the type normally attached to a house or other dwelling. It makes use of mostly precut or possibly preassembled components such as rectangular base frames and floor panels, in conjunction with certain commercial off-the-shelf building/construction components, such as nails, metal connecting brackets, screws, bolts, etc., to connect the deck components into a square or rectangular shape, and connect the overall deck to a house or other building. Railings are installed via shaped wooden posts attached by bolts, screws, or nails, at outside edge framing junctions and corners. These posts have vertical slots for the installation of railing panels, and holes bored vertically into the top, to accept finishing caps bolted into these vertical bored holes. The railing panels slide vertically down into the vertical slots in the posts. The outside periphery of the floor surface is finished by attaching finished lumber boards. The Dantzer patent also describes a foundation system that utilizes posts resting on concrete foundation blocks, or, alternatively, foundation components that are mounted either in a commercially available bracket-and-spike combination driven into the ground, or in a bracket and anchor combination which is set in concrete.

Unfortunately, the Decking System of Dantzer still makes use of nails, screws, bolts, etc., for connecting the components. In addition, not all components are precut or preassembled, which means that some cutting of components and/or materials would be necessary. All this would require the use of tools and materials such as hammers, nails, screws, screwdrivers, saws, nuts and bolts, etc.

In addition, the components of the Decking System of Dantzer are oriented to square or rectangular decks, rather than irregular or custom shapes, including open areas inside the outer periphery of the overall structure or assembly.

Also, the Dantzer design allows only for the installation of fence-height railings, while the present invention enables a second, higher level of panels to be installed, allowing for the creation of true privacy walls. The Dantzer design does not allow the installation of railings or partitions anywhere except at the edge of the deck, therefore there is no provision for partitioning the surface space or spaces inside the periphery of the deck. The present invention allows the installation of posts at any junction of Floor Panels or corner of a single Floor Panel, and these posts, in conjunction with Post Brackets, make it possible to install fence or wall-height panels at variable locations, thereby allowing interior space or spaces to be partitioned into separate areas.

The Dantzer system also makes no provision for roofing an assembled structure, either partially or completely.

Another disadvantage of the Dantzer system is that removal or disassembly of the Dantzer design would be difficult, if not impossible, without damaging or destroying at least some of the components or materials. An additional removal disadvantage is that if the foundation had been installed into concrete, heavy tools and effort would be required to break up the concrete to completely remove the structure. The present invention does not make any use of concrete footings or foundations, and can be removed using the same means, and virtually the same effort, as that used to assemble it, with minimal cosmetic repair work to the site necessary after removal.

It is another object of the invention to eliminate any necessity for tools of any kind, other than human hands, to assemble the various combinations of components comprising this invention.

It is another object of the invention to reduce, if not eliminate, any necessity for foundation excavation or construction.

It is another object of the invention to allow either indoor or outdoor structures of various plans or configurations by using various combinations of components from the set of components comprising this invention.

It is another object of the invention to eliminate wastage of building materials, by allowing precise pre-planning of component requirements.

It is another object of the invention to allow the partitioning of the interior horizontal surface space(s) of a structure or assembly into separated areas.

It is another object of the invention to allow the disassembly and removal of any structure previously assembled from the components of this invention, by the same means used to accomplish the original assembly.

It is another object of the invention to allow an assembled structure to be fully or partially enclosed, partitioned, and/or roofed, regardless of structure configuration or floor plan.

It is another object of this invention to allow flexibility in the final configuration of any structure produced by using different combinations of the components comprising this invention, including the ability to partially or completely surround, within the periphery of the structure or assembly, physical objects, areas, or features in, or planned for, the installation area (trees or other plantings, water features, other structures or assemblies, etc., or just open, unoccupied areas).

BRIEF DESCRIPTION OF THE DRAWINGS

A complete understanding of the present invention may be obtained by reference to the accompanying drawings, when considered in conjunction with the subsequent, detailed description, in which:

FIG. 12A is a top perspective view of a "side" edge framing section component, shown both upright and inverted (122);

FIG. 12B is a top perspective view of an "outside corner" edge framing section component, shown both upright and inverted (121);

FIG. 12C is a top perspective view of an "inside corner" edge framing section component, shown both upright and inverted (123);

FIG. 12D is a top perspective view of a U-shaped edge framing section component, shown both upright and inverted (124);

FIGS. 25 through 29A are a progressive series of figures illustrating the procedure of installing roofing components at a visually-isolated junction of components at the top of a post assembly, either half-height or full-height;

FIG. 25 is a front exploded perspective view of an example corner assembly of supporting and connecting components for a roof panel installation;

FIG. 26 is an elevated front perspective view of the same example corner assembly in FIG. 25, showing the relative installation positions of precipitation-conveying and sealing components;

FIG. 28 is an exploded front perspective view of the relative installation positions of the final connecting and sealing components at this example junction;

FIG. 29A is an elevated front perspective view of the completed example corner installation of roofing components shown in FIGS. 25 through 28;

FIG. 30A is an exploded perspective view of an assembly that could be installed to a full-height post assembly, to convey water to a point near ground-level, and then either disperse that water onto the ground via a "dispersal" water fitting, or connect to an external, possibly underground, storage or drainage system via a "harvesting" water fitting;

FIG. 30B is an exploded perspective view of an assembly that could be installed to a full-height post assembly, to connect to an external above-ground storage system or container via a "harvesting" water fitting.

FIG. 30C is an exploded perspective view of an assembly that could be installed to a half-height post assembly to convey water to a point near ground-level, and then either disperse that water onto the ground via a "dispersal" water fitting, or connect to an external storage or drainage system via, possibly underground, via a "harvesting" water fitting.

FIG. 30D is an exploded perspective view of an assembly that could be installed to a half-height post assembly, to connect to an external above-ground storage system or container, via a "harvesting" water fitting.

For purposes of clarity and brevity, like elements and components will bear the same designations and numbering throughout the Figures.

DESCRIPTION OF THE PREFERRED EMBODIMENT

Figure 1:
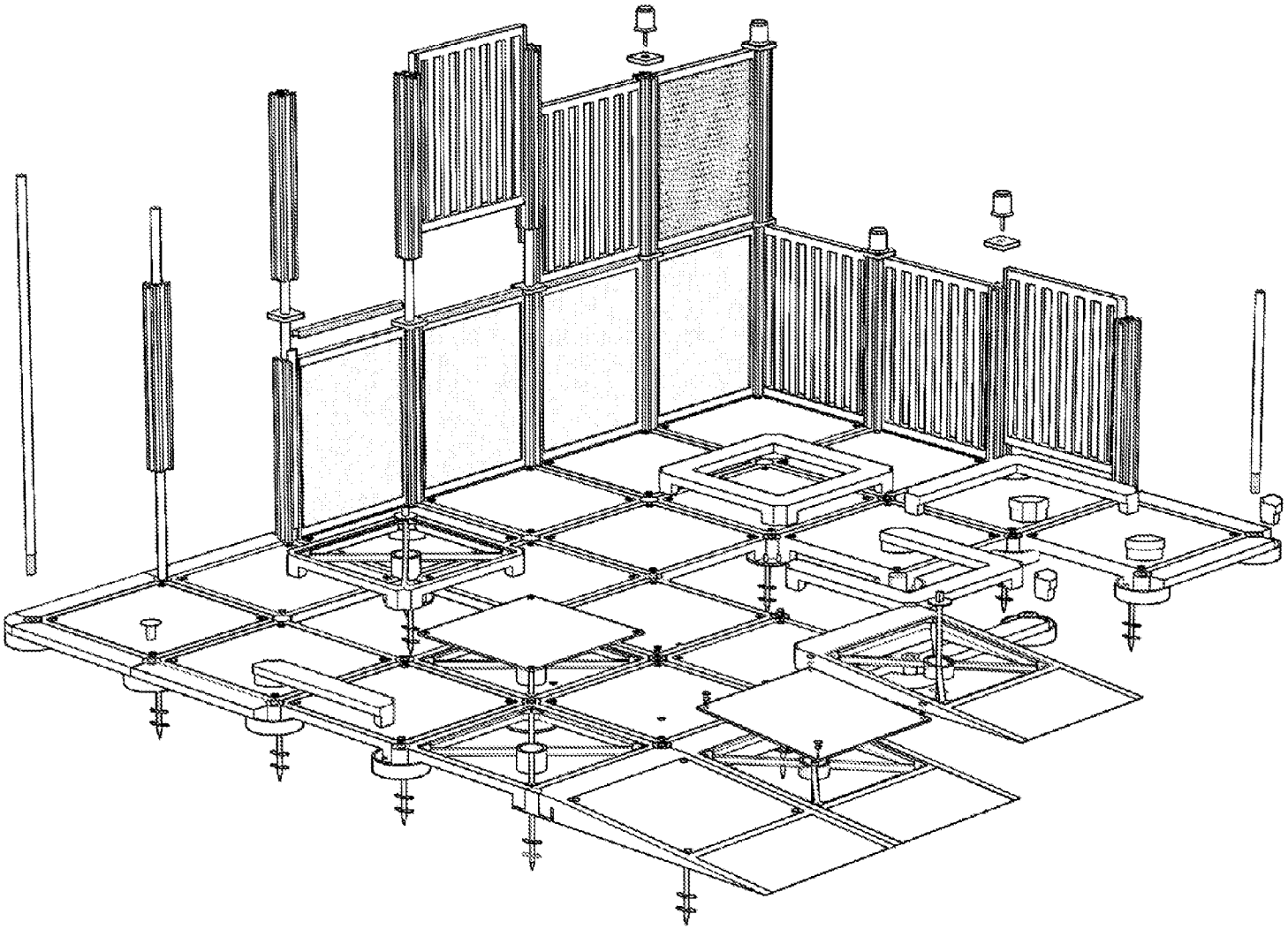
FIG. 1 is a front perspective view of an example structure.

While the present invention is capable of embodiment in an almost unlimited variety of structural forms in both extent and configuration, there is shown in the drawings, and will hereinafter be described, various embodiments of structures and structural assemblies, with the understanding that the present disclosure is to be considered an exemplification of the invention's capabilities, and is not intended to limit the invention to the specific embodiments illustrated.

FIG. 1 is a front perspective view of an example un-roofed structure being assembled. It illustrates one possible configuration of a structure that can be assembled using a subset of components, with some of those components indicated in their relative positions for installation, and some in their installed positions.

Figure 2:
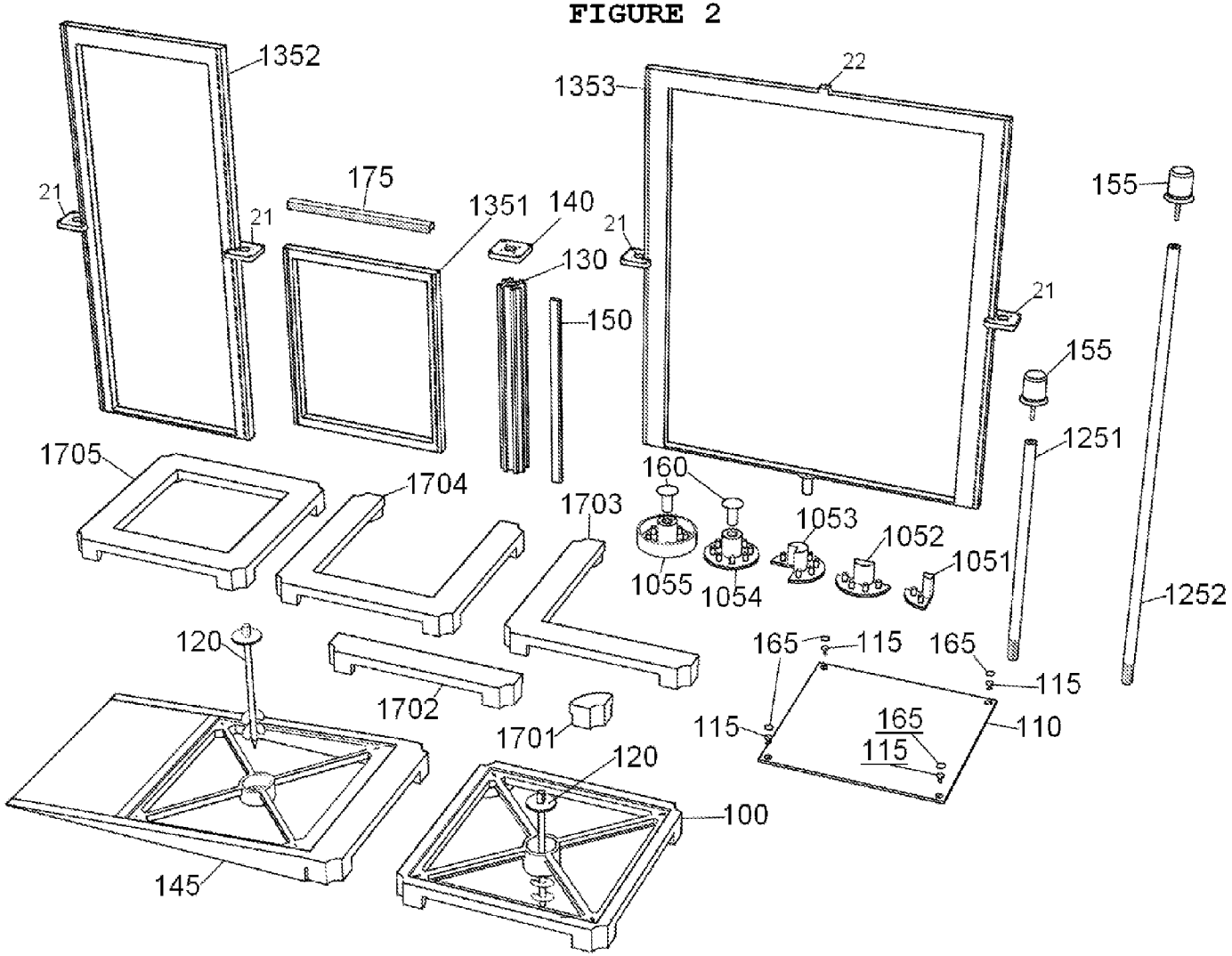
FIG. 2 is a front perspective view of the non-roofing subset of components.

FIG. 2 is a front perspective view of a non-roofing subset of components. Combinations of these components, in varying numbers depending on the size and configuration of the desired structure, allow the assembly of unroofed structures of any desired or required size or configuration. Not every structure would require all of the components shown, and any structure or assembly constructed using this subset of components could then be partially or fully roofed.

Figures 3A, 3B, 3C, 3D, 3E:
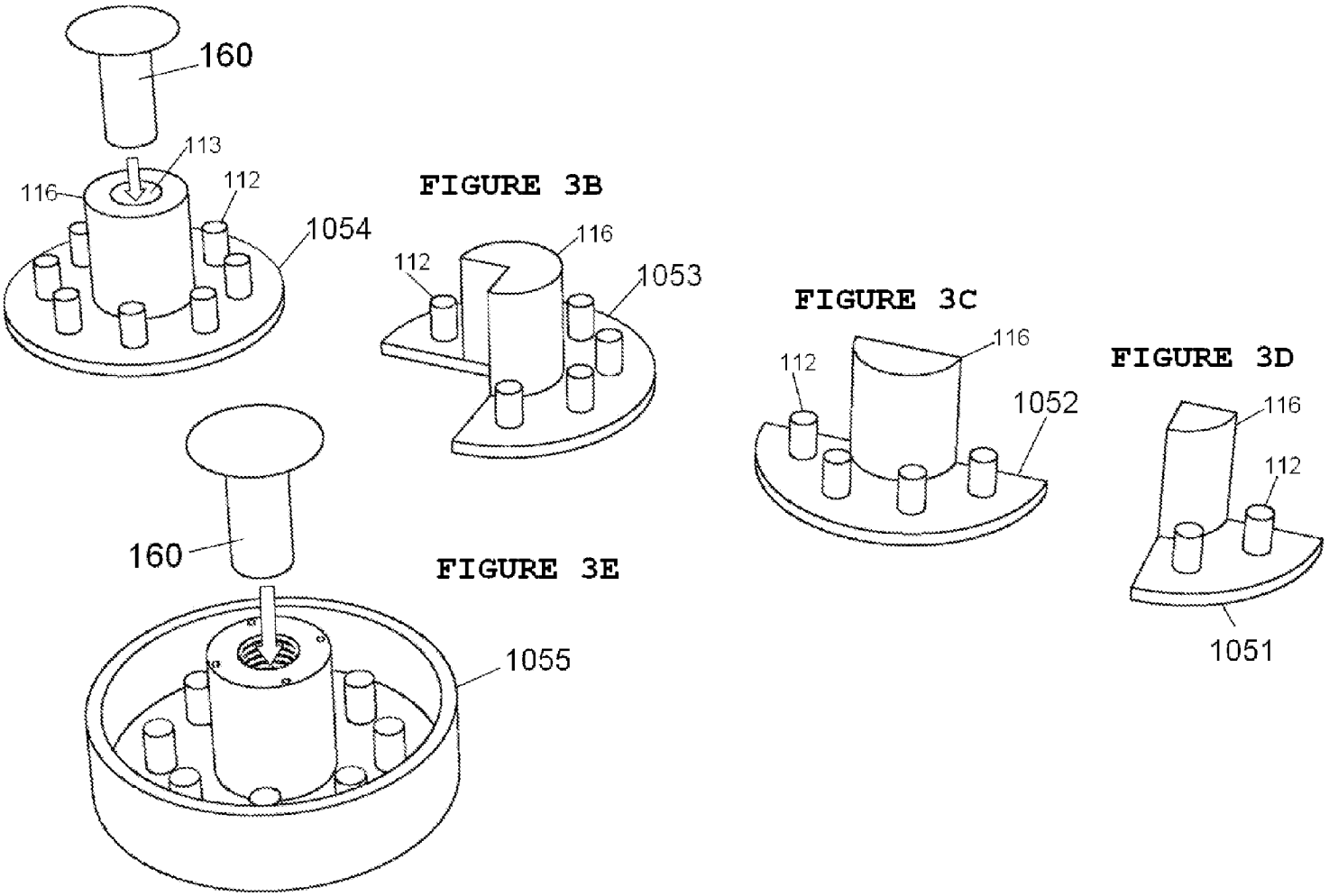
FIG. 3A is a perspective view of a full-junction "basic" floor panel frame connector.
FIG. 3B is a perspective view of an "inside corner" "basic" floor panel frame connector.
FIG. 3C is a perspective view of a "side" "basic", floor panel frame connector.
FIG. 3D is a perspective view of an "outside corner" "basic", floor panel frame connector.
FIG. 3E is a perspective view of a "post" configuration floor panel frame connector. It is identical to the "full-junction" simple floor panel frame connector, but with the following additional features: 1) the hole in the center of the central column is threaded to its full depth; 2) there are four small smooth-bore holes in the top surface of the central column; 3) the entire periphery of the base is surrounded by a vertically-extending sidewall.

FIGS. 3A through 3E are views of the five different configurations of floor panel frame connectors 1051 through 1055. Each is configured as one to four "quadrants" of a full circle; configuration 1051 shown in FIG. 3D is one quadrant, configuration 1052 shown in FIG. 3C is two (2) adjacent "quadrants", configuration 1053 shown in FIG. 3B is three (3) adjacent "quadrants, and configuration 1054 shown in FIG. 3A is all four "quadrants" of a circle. Configurations 1051, 1052, 1053 and 1054 are "basic" configurations, used when no Post 1251-1252 components are to be installed at the junction of two or more Floor Panel Frame 100 components, or at one or more corners of a single Floor Panel Frame 100 assembly. Configuration 1055 is a "post" configuration, used when a post 1251-1252 will be installed, or may be installed at the junction of two or more Floor Panel Frame 100 components, or at one or more corners of a single Floor Panel Frame 100 assembly. A "post" connector 1055 does not require that a post 1251-1252 be installed into it. Precise positioning of all floor panel frame connectors 1051-1052-1053-1054-1055 before installing floor panel frames 100 is not required, as individual connectors may be positionally adjusted as a floor panel frame 100 is installed.

Both the "post" 1055 configuration connector and the full-junction "Basic" connector 1054 can accept a Junction Cap 160. The Junction Cap 160 is installed into the central column of a "post" configuration Floor Panel Frame Connector 1055 when no Post 1251-1252 is installed into the "post" configuration connector 1055. A Junction Cap 160 is installed into the central column of a full-junction "Basic" connector 1054 when both "Basic" and "post" 1055 configuration connectors are used in a structure, to allow visual consistency in their finished appearance. The shorter columns 112 extending upwardly from the "floor" of all configurations of Floor Panel Frame Connector 1051-1052-1053-1054-1055 components are intended to be inserted into the holes 45 in the "legs" of Floor Panel Frame 100 components or the holes 45 in the "legs" of Edge Frame Section 1701-1702-1703-1704-1705 components, when those components are installed onto the connectors. They are equidistantly spaced in a radial pattern, two per "quadrant" of all configurations of Floor Panel Frame Connector 1051-1052-1053-1054-1055 components.

Figure 4A:
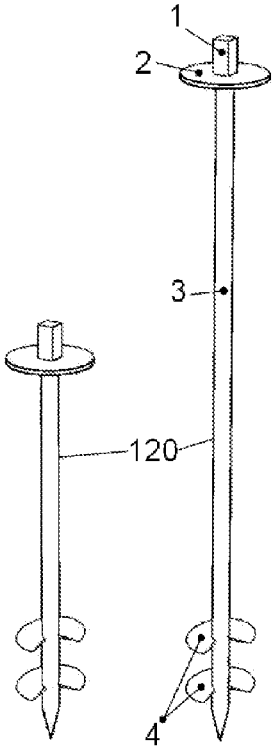
FIG. 4A is a front perspective view of an anchor component, shown in two possible shaft lengths to indicate the variability of the shaft length, to meet varying foundation depth requirements in different geographic locales.

FIG. 4A is a front perspective view of an Anchor 120 component, shown in two possible lengths to indicate the variability of the shaft 3 length. The variability in shaft 3 length of the Anchor 120 component is to allow conformity with local or regional building code requirements for foundation depth. Regardless of shaft 3 length, the configuration and dimensions of the top and bottom portions are identical. The top portion consists of a square shank 1, to be used in drilling or screwing the Anchor 120 into the installation surface. (NOTE: The statement that no tools are required applies to assembly of components; attaching or anchoring a structure or assembly to the ground is not assembly. If a structure or assembly is constructed indoors, or even temporarily outdoors on a paved surface, anchoring would not be required, or even possible.) Immediately below the shank 1 portion of the shaft is the retaining disc 2. This flat disc will, if and when the Anchor 120 component is fully installed, seat against the retaining shoulder or lip 44 at the inner bottom of the anchoring hole in the center of a Floor Panel Frame 100. This retaining shoulder 44 is identical to the retaining shoulder 44 visible in the anchoring hole of the Ramp 145 component illustrated in FIG. 8. Near the bottom of the Anchor 120 shaft are tines 4, shown here as inclined three-quarter discs. These tines 4 could also be helical in shape, similar in configuration to the tines used for heavy-duty tent stakes. The Anchor 120 component is a situational component for attaching outdoor structure assemblies to the installation surface when required or desired, and would not be used for indoor assemblies, or required for temporary assemblies on outdoor surfaces.

Figure 4B:
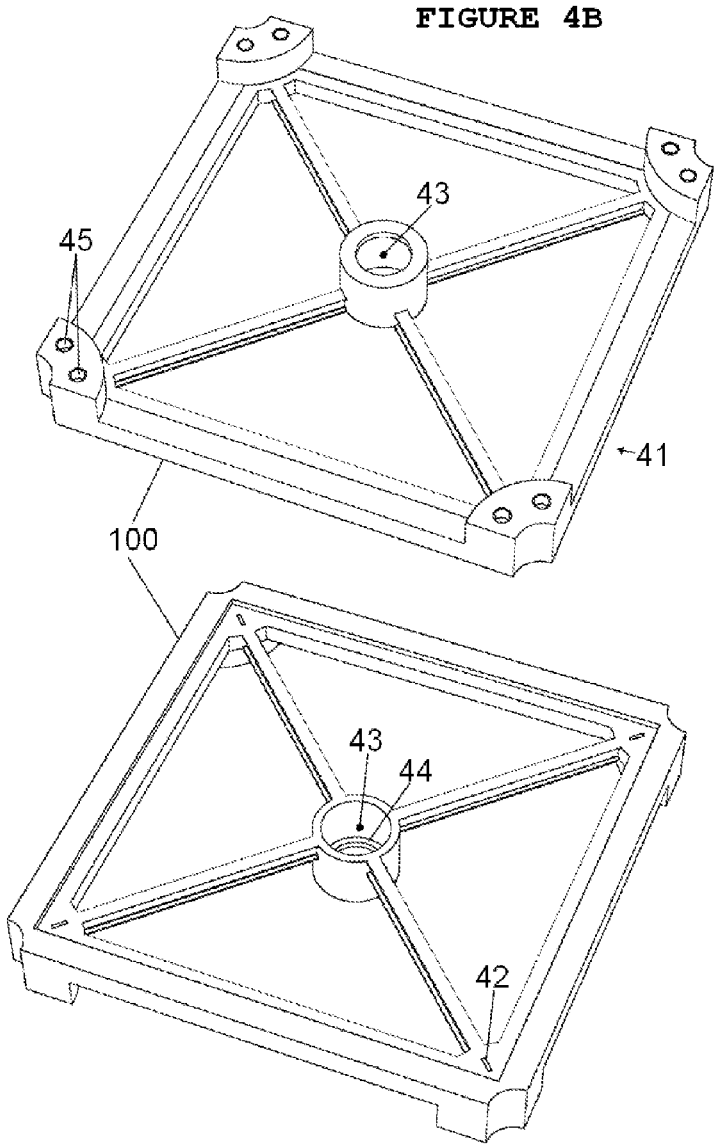
FIG. 4B is a front perspective view of a floor panel frame component, shown both inverted (41) and in its installation orientation.

FIG. 4B shows the Floor Panel Frame 100 component that is the basic assembly and supporting unit of any floored structure. It is shown in an inverted view 41, and its upright, installation orientation. It is square, with four supporting "legs", one at each corner. These legs are shaped to fit onto one "quadrant" of a floor panel frame connector 1051-1052-1053-1054-1055. In the bottom surface of each "leg" are two holes 45. The depth of these holes 45 is equal to the length, or height, of the two round columns 112 projecting upward from each "quadrant" of all Floor Panel Frame Connector 1051-1052-1053-1054-1055 components. The top center surface portion of the Floor Panel Frame 100 is recessed, or "sunken", below the top-most surface of the component. This recessed space will receive a Floor Panel 110. Diagonal cross-members extend from each inner corner of the recessed space in the top center of the Floor Panel Frame 100, and meet at the anchoring hole 43 in the center of the Floor Panel Frame 100. At the bottom inner edge of the anchoring hole is a retaining shoulder 44. It is this shoulder 44 that will receive the outer edge of the retaining disc 2 of the Anchor 120 component when it is fully installed, and it is this connection point between the two components that will secure the assembly to the installation surface. The slot visible in the top surface of each inner corner of the Floor Panel Frame 100 is the entrance to a specially shaped "latch chamber" 71 located inside the body of each inner corner of the Floor Panel Frame 100. It is this "latch chamber" 71 that will allow the Floor Panel 110, when it is installed, to be secured to the Floor Panel Frame 100.

Figure 5A:
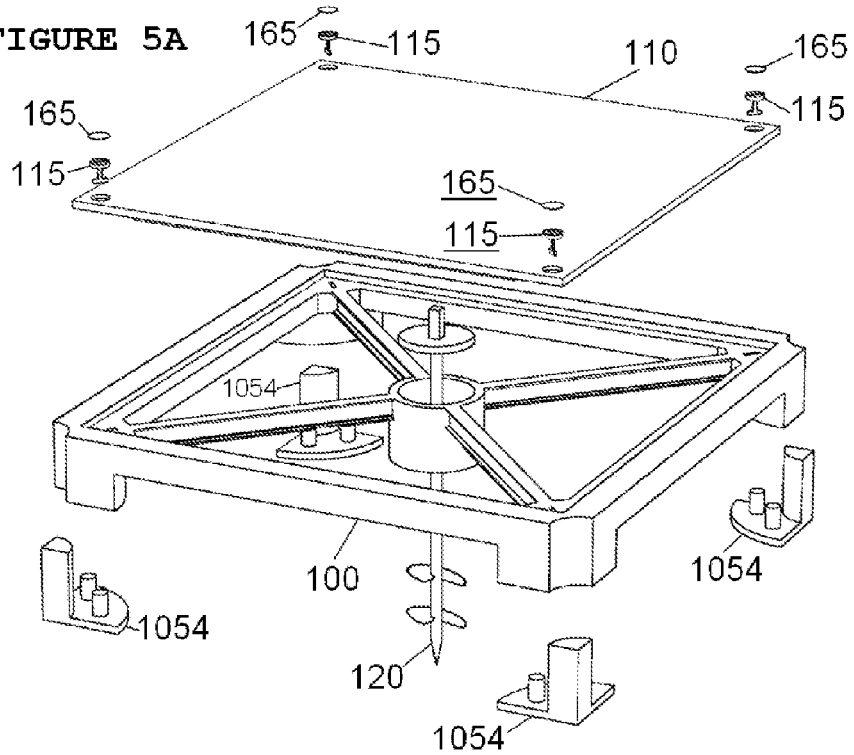
FIG. 5A is an "exploded" perspective view, from above, of a single floor panel frame assembly, with an anchor component in its installation position, if it were to be used.

FIG. 5A is a from-below perspective view of a single Floor Panel Frame 100 assembly, with optional Anchor 120. In this illustration, where a single Floor Panel Frame 100, unconnected to any other Floor Panel Frame 100, is assembled, an "outside corner" configuration of the Floor Panel Frame Connector 1051 is used. One Floor Panel Frame Connector 1051-1052-1053-1054-1055, of a configuration appropriate to the desired structure, is required at each corner of a Floor Panel Frame 100, whether or not it is, or will be, connected to one or more additional Floor Panel Frame 100 components. The base surface of the anchoring hole 43 at the center of the Floor Panel Frame 100 extends vertically below the level of the "legs" at the corners of the Floor Panel Frame 100, and the installation of a Floor Panel Frame Connector 1051-1052-1053-1054-1055 at each corner is required to make the Floor Panel Frame 100 assembly sit levelly and stably on the installation surface, as well as to provide a "finished" appearance to each corner of the Floor Panel Frame 100. The two receiving holes 45 in the bottom of each "leg" of the Floor Panel Frame 100 slide smoothly down onto and over the connector columns 112 on the inner top surface of the base of a Floor Panel Frame Connector 1051-1052-1053-1054-1055, until firmly seated. If the assembly is to be anchored into the installation surface, the Anchor 120 component is inserted through the anchoring hole 43 in the center of the Floor Panel Frame 100, and drilled or screwed into the installation surface until the Anchor 120 retaining disc 2 is firmly seated against the retaining shoulder 44 at the inner base of the anchoring hole, thereby solidly securing the Floor Panel Frame 100 and Floor Panel Frame Connector 105 components to the installation surface. A Floor Panel 110 is inserted vertically down into the recessed space in the top center of the Floor Panel Frame 100. The diagonal channels and round center recess in the bottom surface of the Floor Panel 110 fit down over and onto the cross-members and top surface of the anchoring hole 43 until they are firmly seated. These shaped and recessed spaces prevent lateral movement of the Floor Panel 110 when installed. The top surface of the installed Floor Panel 110 is flush with the top surface of the Floor Panel Frame 100 and the top surface of the Floor Panel Frame Connector 105. The Floor Panel 110 will be secured to the Floor Panel Frame 100 by installing a Floor Panel Latch 115 at each corner.

Figure 5B:
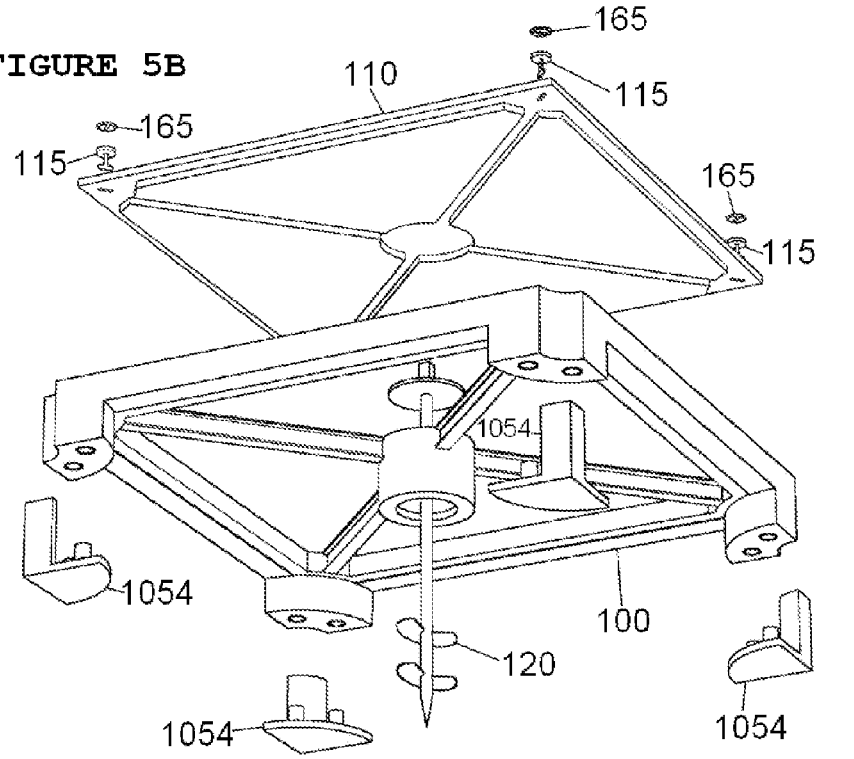
FIG. 5B is an "exploded" perspective view, from below, of a single floor panel frame assembly, with an anchor component in its installation position, if it were to be used.

FIG. 5B is a from-below perspective view of the same assembly shown in FIG. 5A.

Figure 6A:
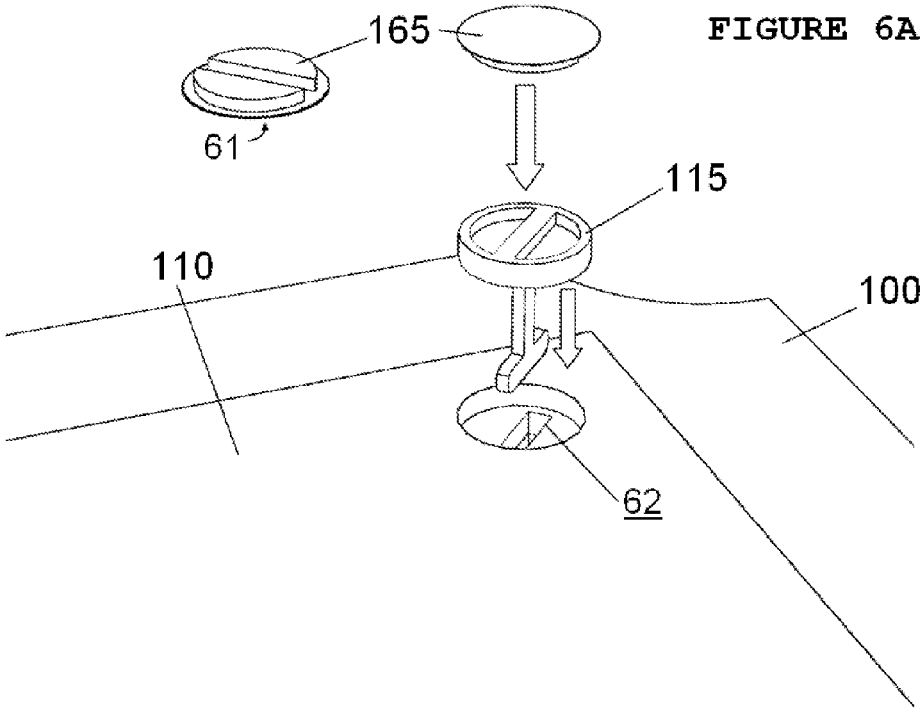
FIG. 6A is a perspective detail view of a floor panel latch in position to be inserted through one of the recessed slots in each corner of a floor panel; one latch at each corner of a floor panel secures a floor panel to a floor panel frame. Also shown is a floor panel latch cap, in its installation orientation and position, as well as inverted (61) to illustrate that it is shaped to fit down into, as well as cover, the floor panel latch.
Figure 6B:
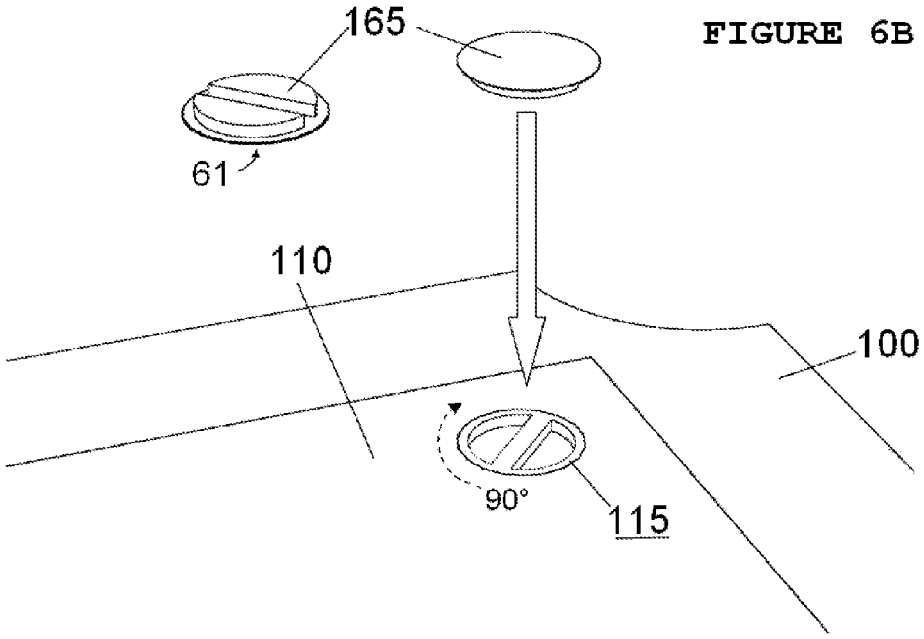
FIG. 6B is a perspective detail view of the floor panel latch illustrated in FIG. 6A after it has been inserted. The inserted latch is then rotated ninety degrees clockwise to secure the corner of the floor panel in place.

FIGS. 6A and 6B are combined front perspective views of a Floor Panel 110 being secured to a Floor Panel Frame 100 by a Floor Panel Latch 115, also illustrating a Floor Panel Latch Cap 165. The Floor Panel 110 has one (1) recessed hole in each corner. The top half of this hole is round, large enough and deep enough to allow the round top portion of the Floor Panel Latch 115 to fit snugly but smoothly inside, with the surface of the installed Floor Panel Latch 115 flush with the top surface of the Floor Panel 110. The bottom half of the hole is a rectangular slot or channel cutting through the remaining thickness of the Floor Panel 110, to allow the T-shaped flange of the Floor Panel Latch 115 to pass through the Floor Panel 110 into a corresponding rectangular slot in the Floor Panel Frame 100. The top recessed surface of the Floor Panel Latch 115 is shaped with a raised cross-bar to allow the installer's fingers to be used to rotate the Floor Panel Latch 115 when it is installed. Also illustrated is the Floor Panel Latch Cap 165, shown in an inverted view 61, as well as its installation orientation. This component, of some flexible and water-resistant natural or synthetic material, is shaped to fit down over and into the top surface of the Floor Panel Latch 115, protecting it from the weather, and also providing a visually "finished" appearance. FIG. 6A shows the Floor Panel Latch 115 in position to be installed, while FIG. 6B shows the Floor panel Latch 115 installed, but prior to being rotated.

Figures 7A, 7B, 7C, 7D:
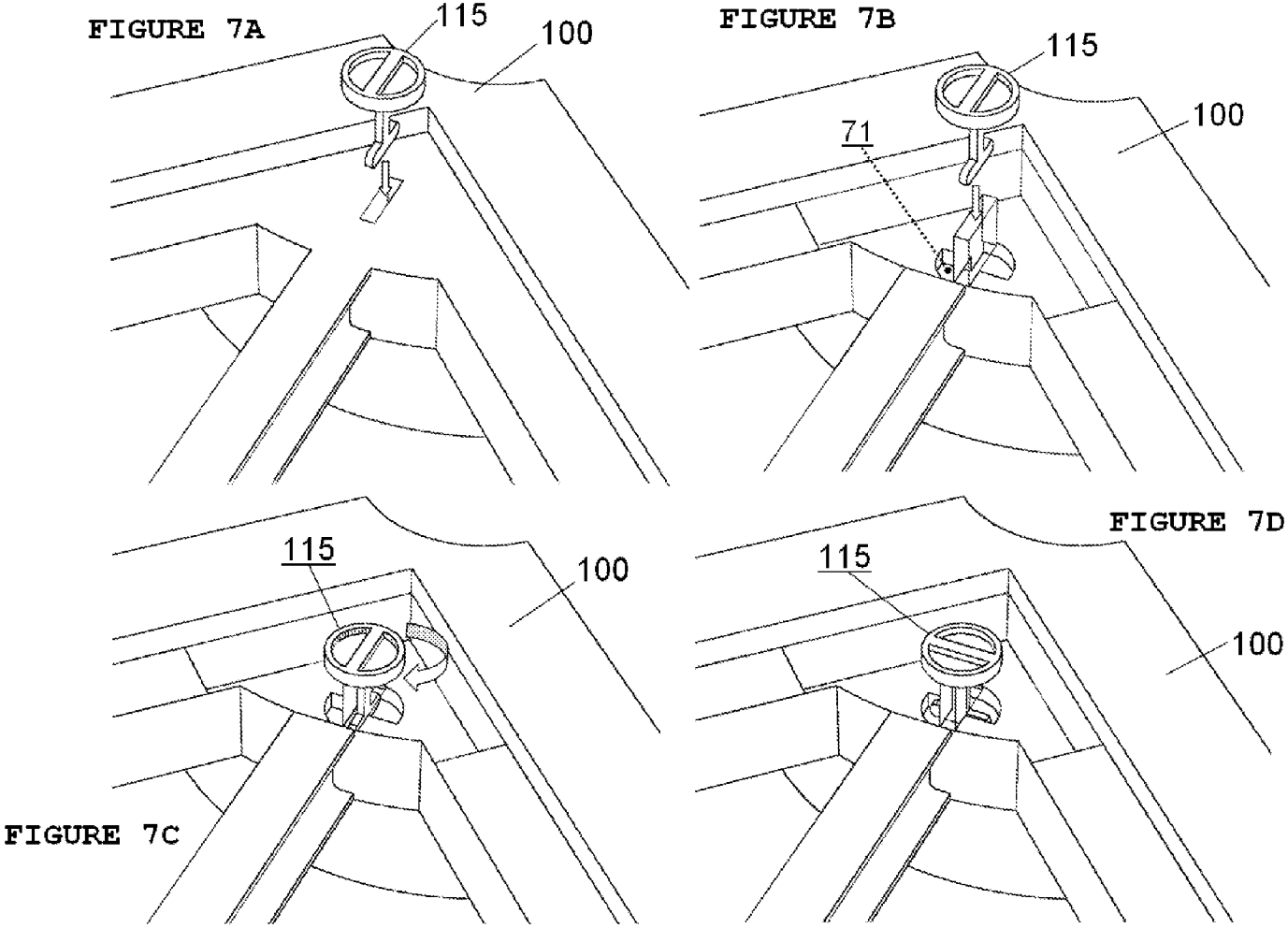
FIG. 7A is the first in a series of four (7A-7D) top perspective views of a floor panel latch being installed into one "latch chamber" 71 inside the "body" of the floor panel frame at each of the four corners. The floor panel is not shown in this view, for visual clarity.
FIG. 7B (second in the above-mentioned series) is a perspective detail view of the floor panel latch inserted in view 7A, with a portion of the corner recess of the floor panel frame shown as if transparent, with the edge-lines of the receiving slot and latch chamber 71 outlined to illustrate the shape and location of the latch chamber 71.
FIG. 7C (third in the above-mentioned series) is a perspective detail view of the floor panel latch fully inserted through the slot and into the latch chamber 71, with the arrow indicating the direction the latch will be rotated.
FIG. 7D (fourth in the above-mentioned series) is a perspective detail view of the now-rotated floor panel latch shown in FIG. 7C.

FIGS. 7A through 7D are top perspective progressive-series views of a Floor Panel Latch 115 being installed into one "latch chamber" 71 inside the "body" of the Floor Panel Frame 100 at each of the four corners. In this series of views, the Floor Panel 110 that would be secured by the installation of the Floor Panel Latch 115 components is not shown for visual clarity. FIG. 7A illustrates the Floor Panel Latch 115 in position to be inserted into the channel, or slot, at the top of the "latch chamber" 71. FIG. 7B provides the same view, but with the top recessed corner surface of the Floor Panel Frame 100 shown as if partially transparent, illustrating the location and configuration of the "latch chamber" 71. FIG. 7C shows the Floor Panel Latch 115 fully inserted into the "latch chamber" 71. The arrow indicates that, when fully inserted, the Floor Panel Latch 115 should be rotated clock-wise 90 degrees. FIG. 7D shows the Floor Panel Latch 115 after having been rotated inside the "latch chamber" 71. The T-shaped flange of the Floor Panel Latch 115 is now opposed to the slot through which it was inserted, thereby locking, or "latching", this corner of the Floor Panel 110 in place. With a Floor Panel Latch 115 installed at each corner, the Floor Panel 110 is secured in place. This view also indicates the installation of the Floor Panel Latch Cap 165, with the shaped extrusion on the bottom side inserted into the recessed top space of the Floor Panel Latch 115.

Figure 8:
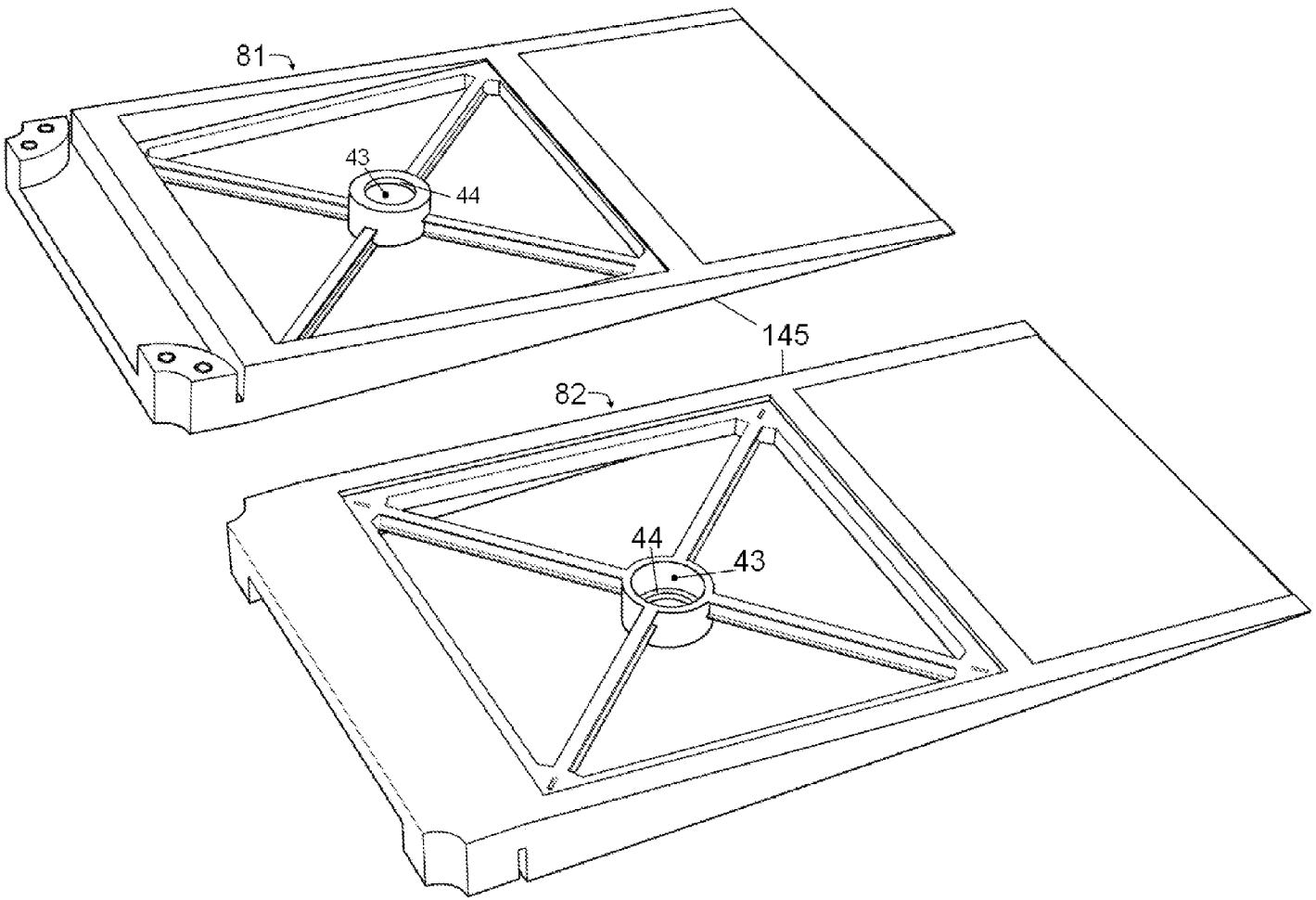
FIG. 8 is an elevated front perspective view of a ramp component, shown both inverted (81) and upright (82)

FIG. 8 is an elevated front perspective view of a Ramp 145 component, shown both inverted (81) and upright (82). The Ramp 145 provides an inclined surface between the installation surface and the horizontal surface of an assembled floored structure, allowing wheeled implements, objects, or vehicles to be rolled from the installation surface onto the floored surface. It has two "legs" identical in size and configuration to those supporting one side of a Floor Panel Frame 100. These "legs" install onto a Floor Panel Frame Connector 1051-1052-1053-1054-1055 in exactly the same manner as one side of a Floor Panel Frame 100 does, thereby connecting the Ramp 145 to a larger or more extensive structure or assembly. It has a square recessed top surface space, identical in dimension and configuration to the square recessed top space in the top surface of a Floor Panel Frame 100. This space is filled by a Floor Panel 110 identical in configuration and dimensions to the Floor Panel 110 component that is installed into a Floor Panel Frame 100. The only difference lies in the inclination of that space from the horizontal plane of the Floor Panel Frame 100. The top edge of the cylindrical anchoring hole at the center of this recessed space of the Ramp 145 slopes downward, but is nevertheless of sufficient depth that the square shank 1 of an Anchor 120 will lie below this sloped surface when and if an Anchor 120 component is used to attach this component to the installation surface. The end of the Ramp 145 opposite to the end that is installed to a Floor Panel Frame Connector 1051-1052-1053-1054-1055 has a solid (unperforated) surface with a textured, slip-resistant surface finish.

Figure 9:
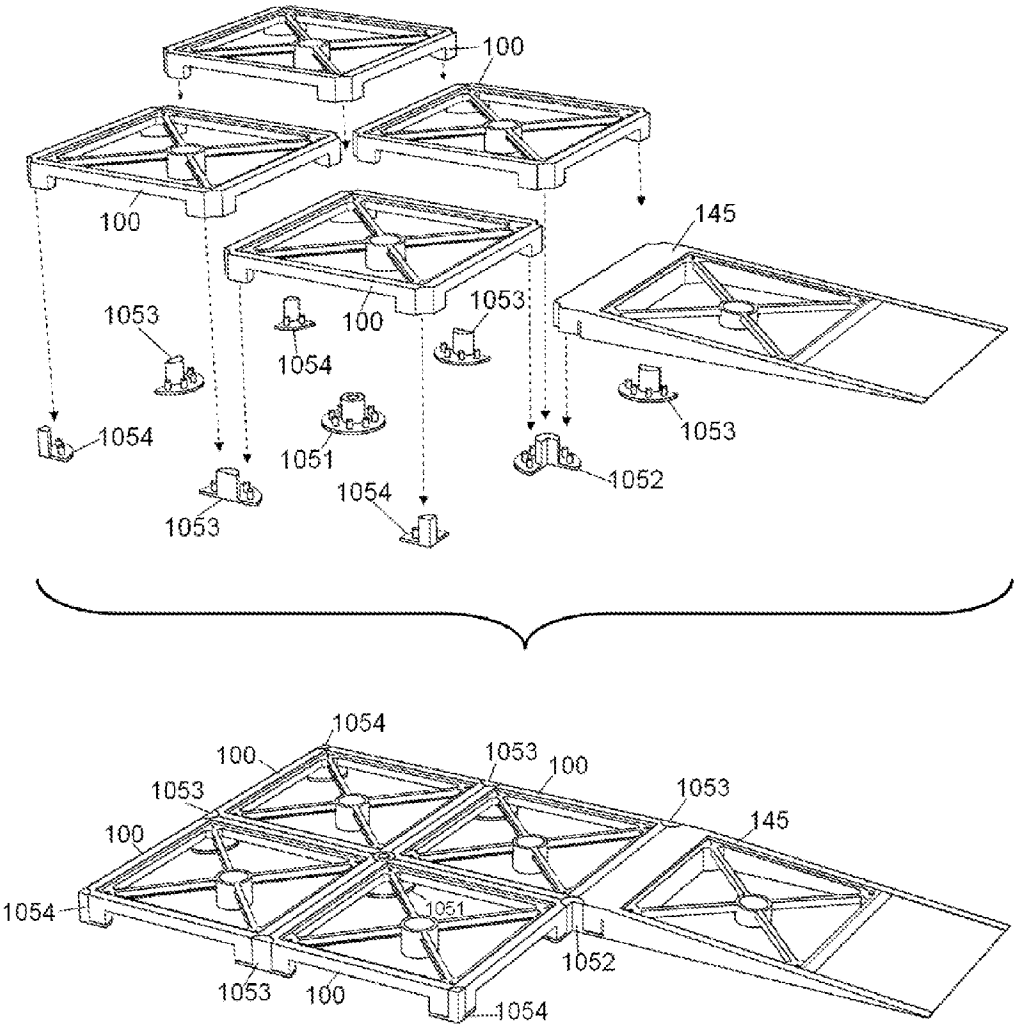
FIG. 9 is an exploded perspective view, and a combined or assembled view, of an example assembly of floor panel frame components in a square configuration.

FIG. 9 is a combined exploded and assembled perspective view of an example assembly of Floor Panel Frame 100 components in a square configuration, and the resultant assembly after the installation. It illustrates multiple Floor Panel Frame 100 components being installed to multiple "Basic" Floor Panel Frame Connector 105 components to form a square assembly, with a Ramp 145 being installed along one side of one Floor Panel Frame 100. Note that the configuration of Floor Panel Frame Connector 1051-1052-1053-1054 components at each junction or corner is determined by the configuration of each junction, and that this example makes use of Floor Panel Frame Connectors 1051, 1052, 1053, and 1054. The center junction, where four (4) Floor Panel Frame 100 components are joined requires a "full-junction" connector, either 1054 or 1055; configuration 1054 is shown here. (Configuration 1055 could be substituted for any or all of the connectors shown in this view, which would then require the use of edge framing sections. "Basic" connectors allow for a simpler and, presumably, less-costly assembly.) The side junctions, where two (2) Floor Panel Frame 100 components, or a Floor Panel Frame 100 and a Ramp 145, meet, require configuration 1052. The point where two (2) Floor Panel Frame 100 components are joined to the Ramp 145 component in an "L" shape, requires configuration 1053, while each peripheral corner requires configuration 1051. It should be apparent from this example that floored structures of an almost infinite size and configuration (floor plan) can be assembled, simply by varying the number and arrangement of components.

Figure 10:
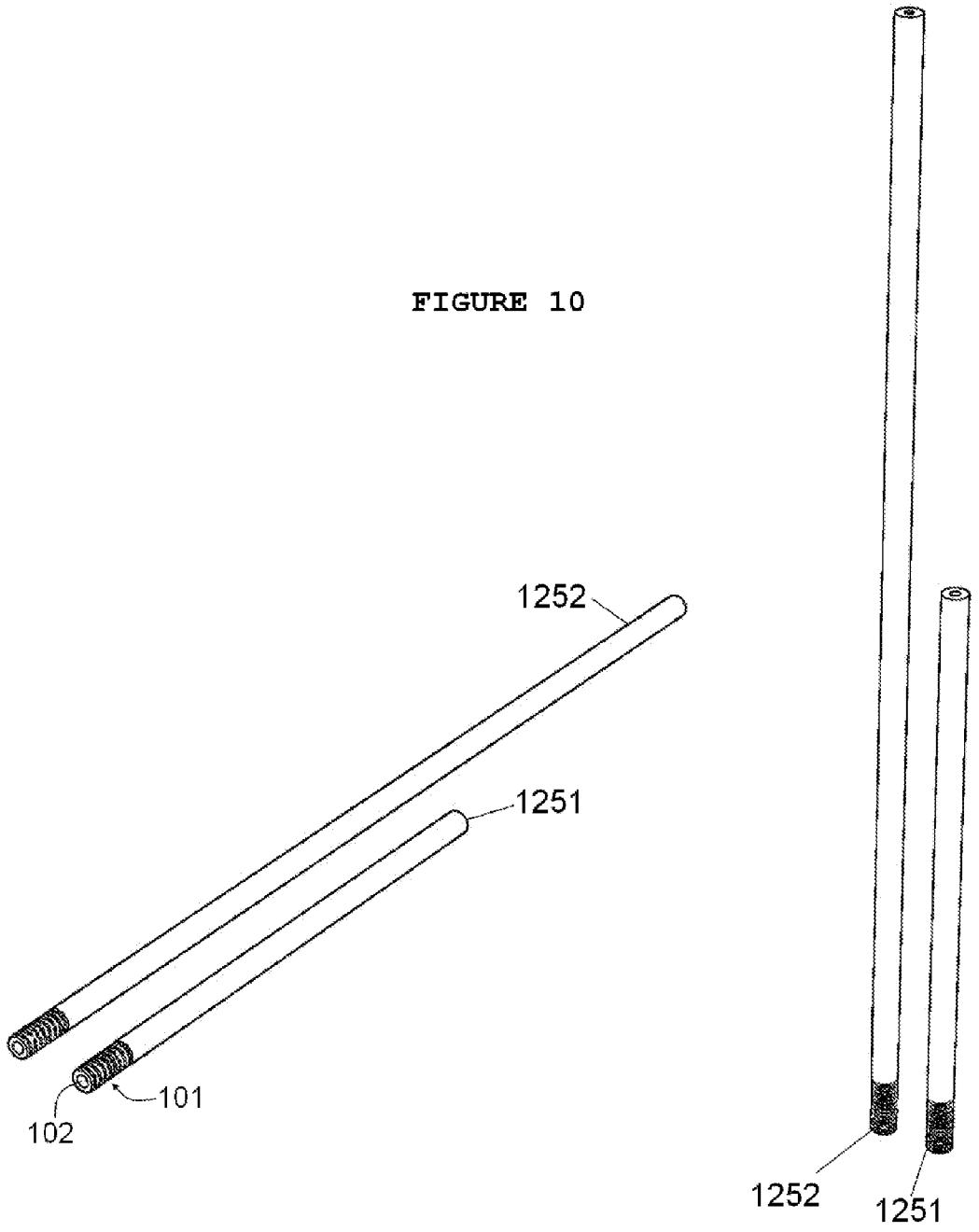
FIG. 10 is a front perspective view of half-height and full-height post components (this use of "half-height" and "full-height" should not be considered as limiting post components to the lengths shown; other lengths are possible), illustrating both lengths (1251 and 1252), the threaded outer base (101) and center hole (102), which is threaded at the top of both heights of posts.

FIG. 10 is a front perspective view of a set of half-height and full-height Post 1251-1252 components, shown both horizontally and upright. Posts 1251-1252 are necessary to provide a vertical supporting framework for the installation of Partition Panels 1351-1352-1353 and roofing components to a structure, as desired or required. Posts 1351-1352-1353 require the use of the "post" 1055 configuration of the Floor Panel Frame Connector 1051-1052-1053-1054-1055. The half-height Post 1251 allows the installation of a single level or course of Partition Panels 1351, thereby creating "fence"-height railings or walls, while the full-height Post 1252 allows the installation of two vertically adjacent levels or courses of Partition Panel 1351-1352-1353 components, thereby creating full-height walls. The only difference between the half-height 1251 and full-height 1252 Post 1251-1252 components is their overall length or height. Each Post 125 has a round central hole 102 throughout the entire length of the component. The top or upper portion of this hole is internally threaded to a depth sufficient to accept either a Finial 155 component, or a Roof Bracket 180 component. The shaft of the Post 1251-1252 is round, with the bottom portion externally threaded 101 to a length equal to the depth of the threaded hole in the central column of a "post" configuration Floor Panel Frame Connector 1055.

Figure 11:
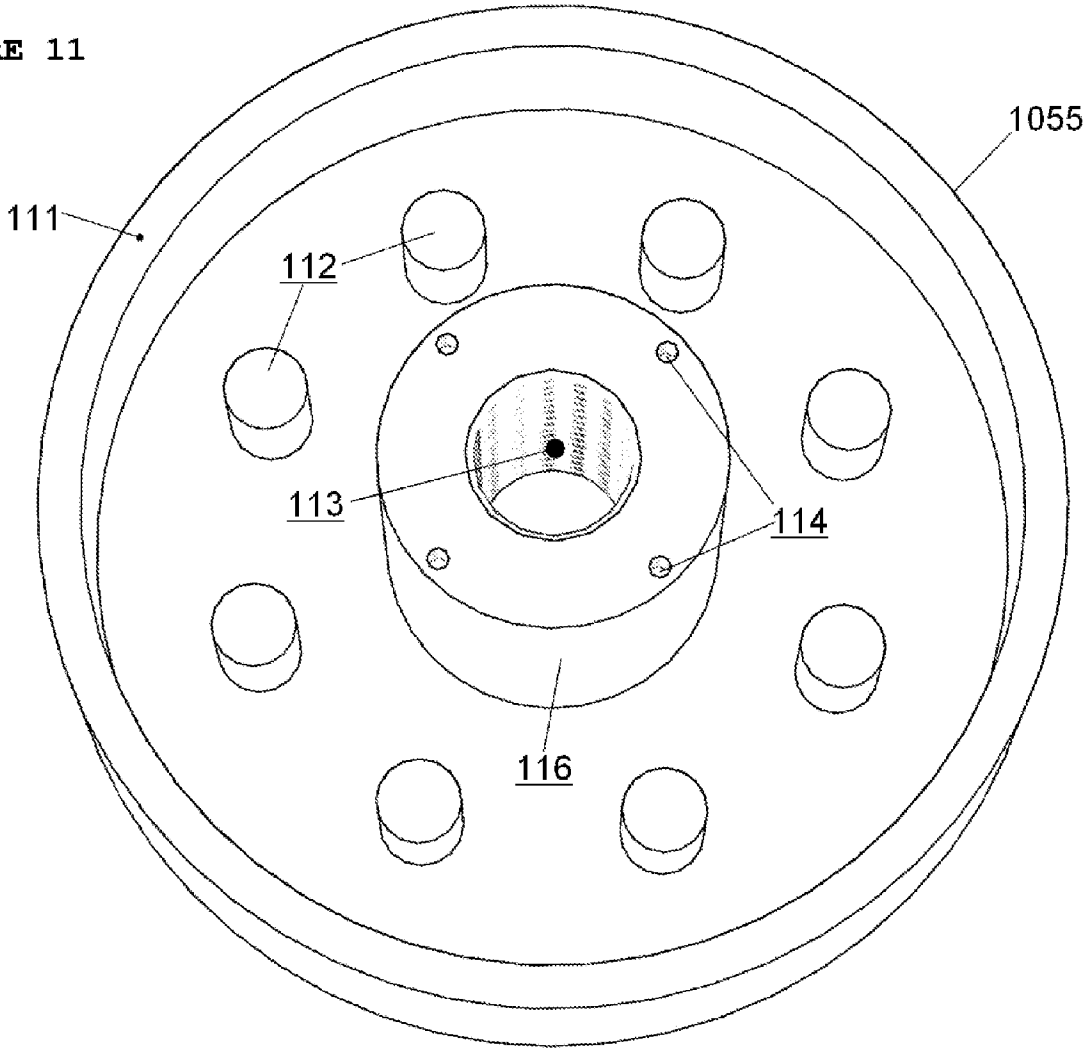
FIG. 11 is a top perspective view of a "post" configuration (1055) floor panel frame connector, configured to accept the externally-threaded end of a post component.
Figures 12A, 12B, 12C, 12D, 12E:
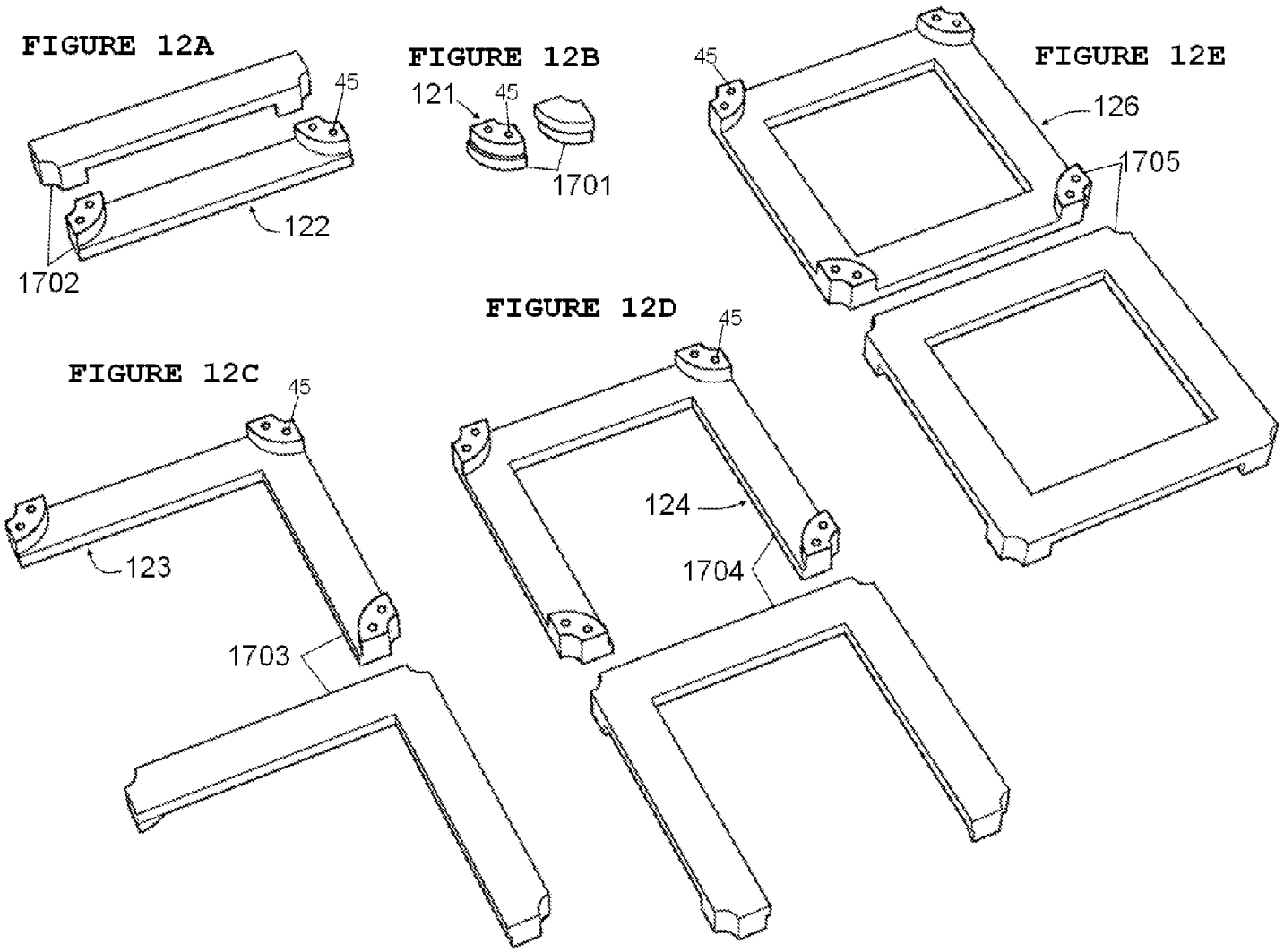
FIGS. 12A through 12D illustrate edge framing sections, intended to be used to fill quadrants of "post" configuration floor panel frame connectors (1055) not filled by floor panel frames, to prevent accrual of water, debris, etc., in those otherwise unfilled quadrants.
FIG. 12E is a top perspective view of a "square" edge framing section component, shown both upright and inverted (125)

FIG. 11 is a detail perspective view of a Floor Panel Frame Connector 1055 configured to accept the externally-threaded end 101 of a Post 1251-1252 component, as well as the "legs" of Floor Panel Frame 100 components and/or Edge Frame Section 1701-1702-1703-1704-1705 components. It is structurally equivalent to the "full junction" Basic Floor Panel Frame Connector 1054, but with the addition of an enclosing side wall 111 around the periphery of its base, and with the hole in the central shaft 113 threaded to accept the outside threaded end 101 of either a half-height 1251 or full-height 1252 Post 1251-1252 component.

FIGS. 12A through 12E are perspective views of a complete set of Edge Frame Section 1701-1702-1703-1704-1705 components. Edge Frame Section 1701-1702-1703-1704-1705 components are only necessary for a structure, or portion of a structure, that has "post" configuration Floor Panel Frame Connector 1055 components installed. There are five (5) configurations of the Edge Frame Section component. Each configuration is shown both inverted (121, 122, 123, 124, 126) and in its upright installation orientation. Straight-sided square or rectangular structure assemblies without enclosed unfloored interior spaces require only the "side" 1072 and "outside" corner 1701 configurations of the Edge Frame Section 1701-1702-1703-1704-1705 component. The "inside corner" 1703, "U" 1704, and "square" 1705 configurations are necessary for structures with irregular edges or enclosed unfloored interior spaces. Edge Frame Section 1701-1702-1703-1704-1705 components may be used in various combinations to finish the periphery of a floored structure, or interior unfloored spaces in any assembled configuration, or, without flooring at all. The "legs", or corner supports, of an Edge Frame Section 1701-1702-1703-1704-1705 are identical to the "legs" of a Floor Panel Frame 100, and install into the "post" connector configuration of a Floor Panel Frame Connector 1055 identically with the installation of a Floor Panel Frame 100, with the receiving holes 45 sliding downwardly onto Floor Panel Frame Connector 1051-1052-1053-1054-1055 posts 112.

Figure 13:
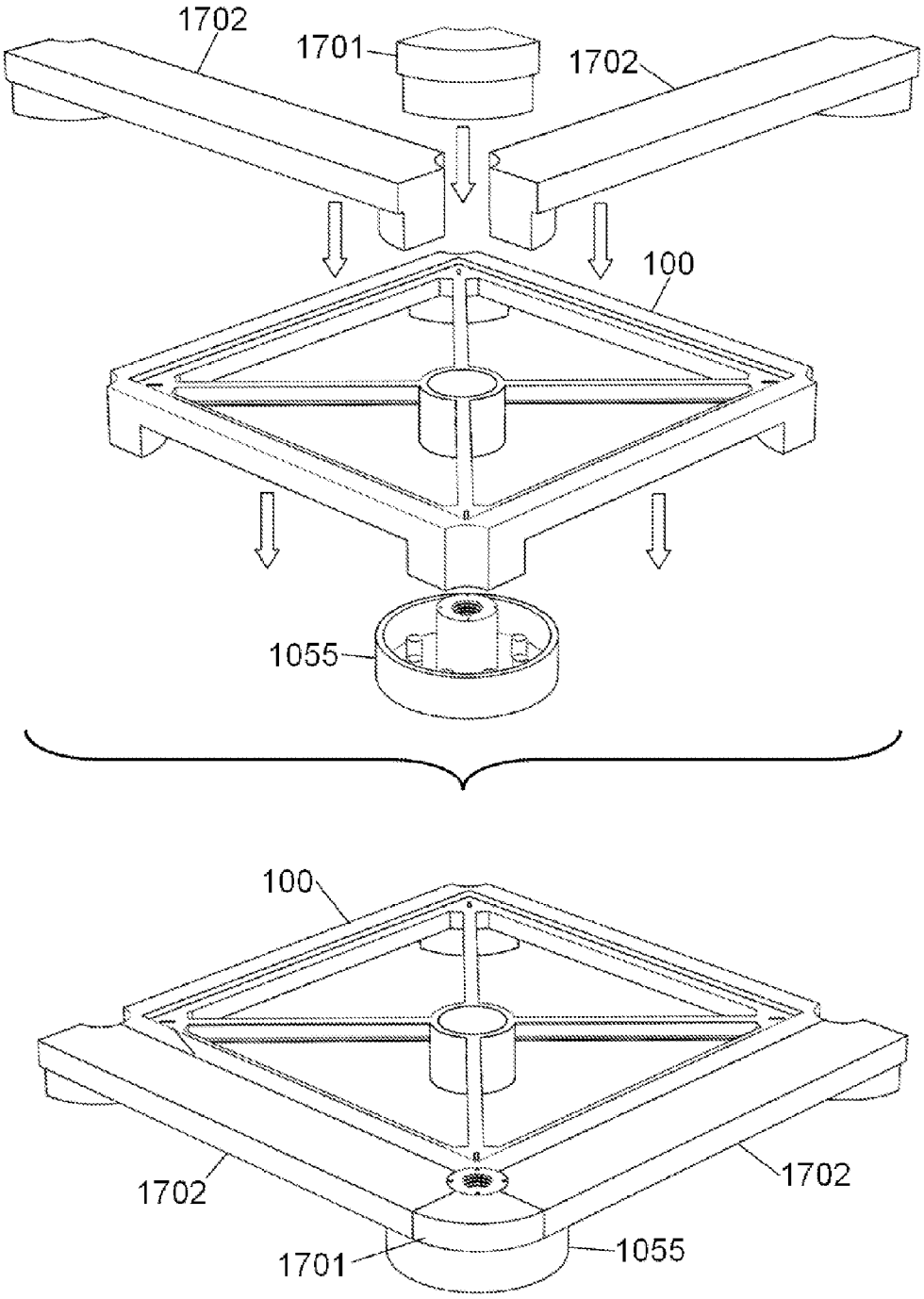
FIG. 13 is a perspective combined exploded and assembled view of an example "outside" corner assembly of flooring being finished by edge framing section components installed to a "post" floor panel frame connector.

FIG. 13 is a top perspective exploded and assembled series view of an example corner assembly of a Floor Panel Frame 100 and a "post" configuration of a Floor Panel Frame Connector 1055, being finished by Edge Frame Section 1701-1702 components. One "leg" of the Floor Panel Frame 100 occupies one quadrant of the interior space of the "post" configuration connector 1055, while the two "side" configurations 1702 and single "outside" corner configuration 1701 of the Edge Frame Section 1701-1702-1703-1704-1705 components are installed into the remaining quadrants to produce a finished appearance, and to fill the remaining three quadrants of the connector 1055. Filling all four quadrants of the "post" configuration connector 1055 provides an effectively strong and stable support base for this junction of components, and keeps detritus and precipitation from accumulating in the otherwise unfilled space.

Figure 14B:
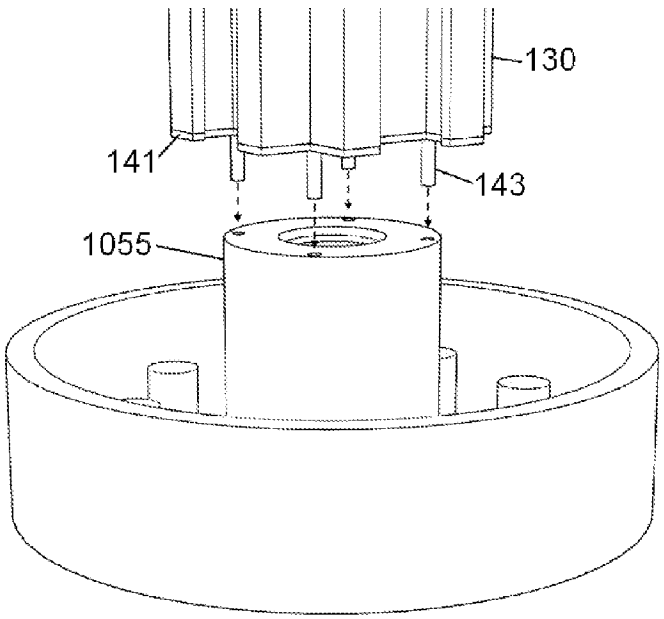
FIG. 14B is a perspective view of a post bracket in position to be installed into a "post" configuration floor panel frame connector, illustrating the positional relationship between the dowels and the four small smooth-bore holes in the top surface of the center column of the "post" floor panel frame connector. A post is not shown in this view, for visual clarity.
Figure 14A:
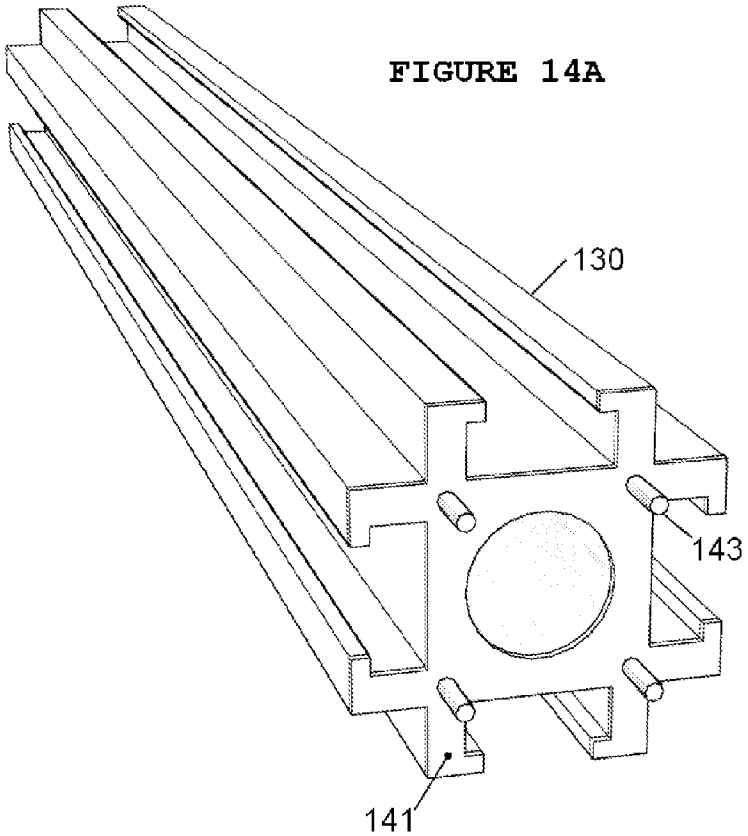
FIG. 14A is a horizontal perspective view of a post bracket, with dowels extending from the bottom surface of the post bracket; there is a layer of gasketing material or compound applied to the bottom surface of the post bracket.

FIG. 14A is a horizontal perspective view of a Post Bracket 130, with dowels 143 extending from the bottom surface of the Post Bracket 130. The center smooth-bore hole of the Post Bracket 130 allows the Post Bracket 130 to be installed by sliding the Post Bracket 130 down onto a Post 1251-1252. The Post Bracket 130 has a T-shaped channel, or "slot", on the outside of each of its four sides. These channels allow the installation of either Partition Panel 1351-1352-1353 components, one into each channel, or the installation of a Finishing Strip 150 into any channel into which a Partition Panel 1351-1352-1353 is not installed. The dowels 143 would be installed to the bottom of the Post Bracket 130 during the manufacturing process, not by the person or persons assembling a structure. The exposed, unthreaded ends of the dowels would fit down into the corresponding holes 114 in the top surface of the Floor Panel Frame Connector 1055 when the Post Bracket 130 is fully installed to the Post 1251-1252.

FIG. 14B shows a Post Bracket 130 in installation position, relative to a "post" configuration Floor Panel Frame Connector 1055, illustrating the orientation of the dowels 143 of the Post Bracket 130, relative to the receiving holes 114 in the top surface of the Floor Panel Frame Connector 1055 (the Post 1251-1252 is not shown in this view, for visual clarity). With the Post 1251-1252 fully screwed into Floor Panel Frame Connector 1055, and the Post Bracket 130 fully inserted down over the Post 1251-1252, and with the dowels fully inserted into their receiving holes 114 in the top surface of the Floor Panel Frame Connector 1055, the Post Bracket 130 cannot be rotated around the Post 1251-1252 without either lifting the Post Bracket 130 high enough to remove the dowels 143 from their receiving holes, or applying horizontally-rotating force sufficient to shear off the dowels. This also will secure, rotationally, any partition panel or panels 1351-1352-1353 installed into the Post Bracket 130.

Figure 15A:
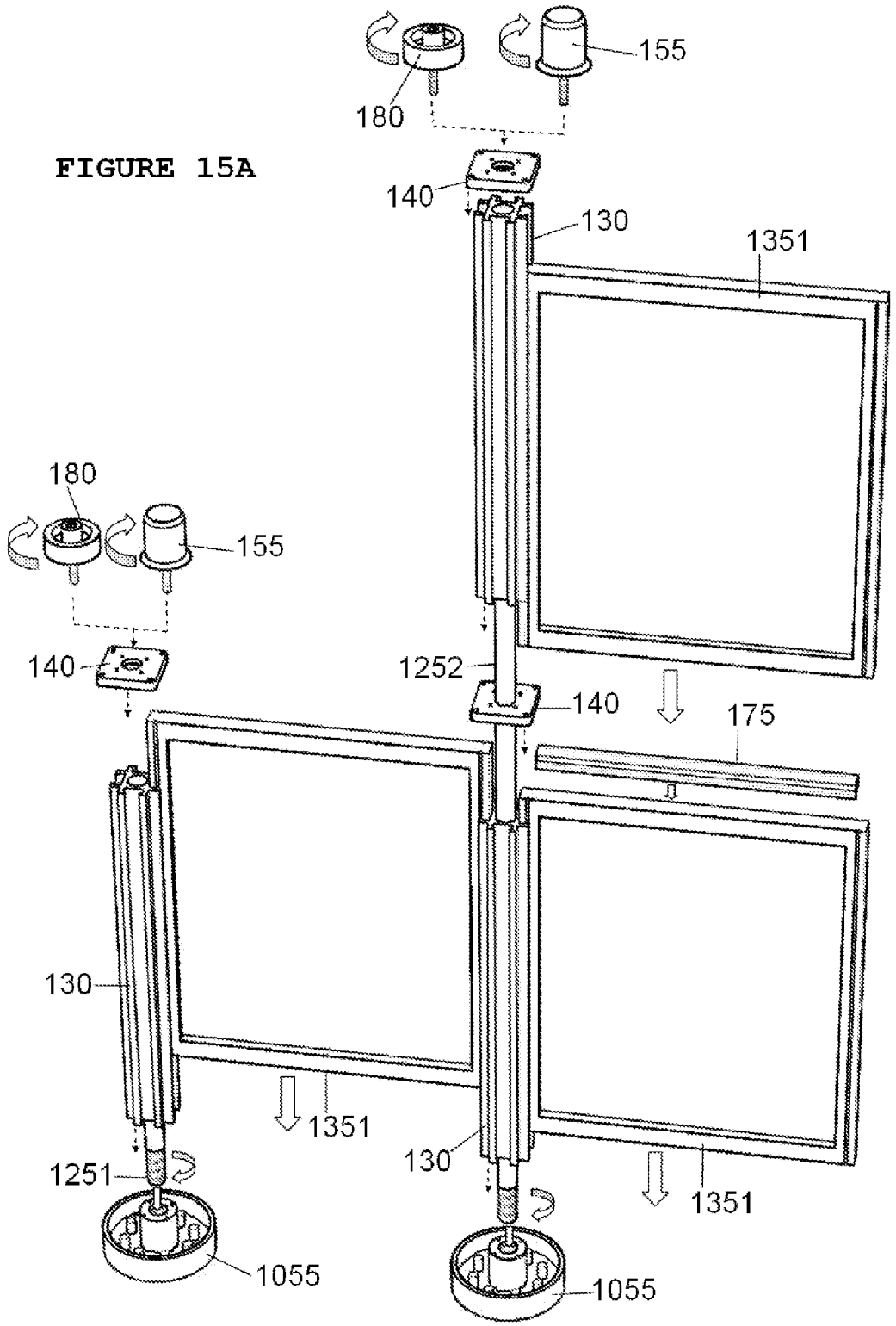
FIG. 15A is an exploded front perspective view of an example partition panel assembly. Partition panel assemblies, either stand-alone or as part of a larger or more extensive structure, may be half-height or full-height, or variable combinations thereof.

FIG. 15A is an exploded front perspective view of an example assembly, illustrating that partitioning of different heights may be created by combining different components, and how those different-height components would connect together. Creating more extensive assemblies would simply require installing additional components necessary to achieve the required or desired final configuration of the more extensive assembly. A half-height Post 1251 component and a full-height Post 1252 component are shown in their installation positions relative to Floor Panel Frame Connector 1055 components, although not shown inserted into the connectors. A single Post Bracket 130 has been slid down over the half-height Post 1251, with a Post Bracket Cap 140 in its relative installation position above it. Two Post Bracket 130 components have been slid onto a full-height Post 1252, with one Post bracket Cap 140 slid onto the full-height Post 1252 between them, and another Post Bracket Cap 140 at the top of the second upper Post Bracket 130 in its relative installation position. Above each of the top-most Post Bracket Cap 140 components are the two components that can be installed through the Post Bracket Cap 140 component into the top of either a half-height 1251 or full-height Post 1252; these are the Finial 155, and a Roof Bracket 180. (Only one or the other of these two components can be installed to the top of a single Post 1251-1252.) The Finial 155 component is used to secure a Post 1251-1252 assembly when no roofing components will be installed to a 1251-1252 assembly. The Roof Bracket 180 is used to secure the Post 1251-1252 assembly below it, while simultaneously allowing the installation of roofing components. The installation of either the Finial 155 or Roof Bracket 180 effectively secures the full Post 1251-1252 assembly, from the Floor Panel Frame Connector 1055 to the Finial 155 or Roof Bracket 180, into a single, connected unit.

The Partition Panel 1351 components of this example assembly are installed by sliding them down into the channels on the sides of adjacent installed Post Bracket 130 components. When a second, higher course of Partition Panel 1351 components is installed to a full-height Post 1252 assembly, the bottom edge surface of the second, or higher, Partition Panel 1351 will rest on the top surfaces of the Post Bracket Cap 140 components installed at the tops of the adjacent lower installed Post Bracket 130 components. This would leave a space, or gap, between the top edge surface of the lower installed Partition Panel 1351 and the bottom edge surface of the upper installed Partition Panel 1351. If desired, this gap can be closed by the installation of a Partition Panel Connector 175 component. This component fits down over the top edge of the lower Partition Panel 1351, and the bottom edge of the upper Partition Panel 1351 fits down onto the upper surface of the Partition Panel Connector 175 (refer to FIGS. 15D and 15E), thereby closing and sealing the vertical gap between the two Partition Panel 1351 components. The horizontal length of an installed Partition Panel Connector 175 is equal to the horizontal distance between adjacent installed Post Bracket Cap 140 components, and leaves no unfilled horizontal gap between those adjacent Post Bracket Cap 140 components. The Partition Panel Connector 175 is not structurally necessary.

Figure 15B:
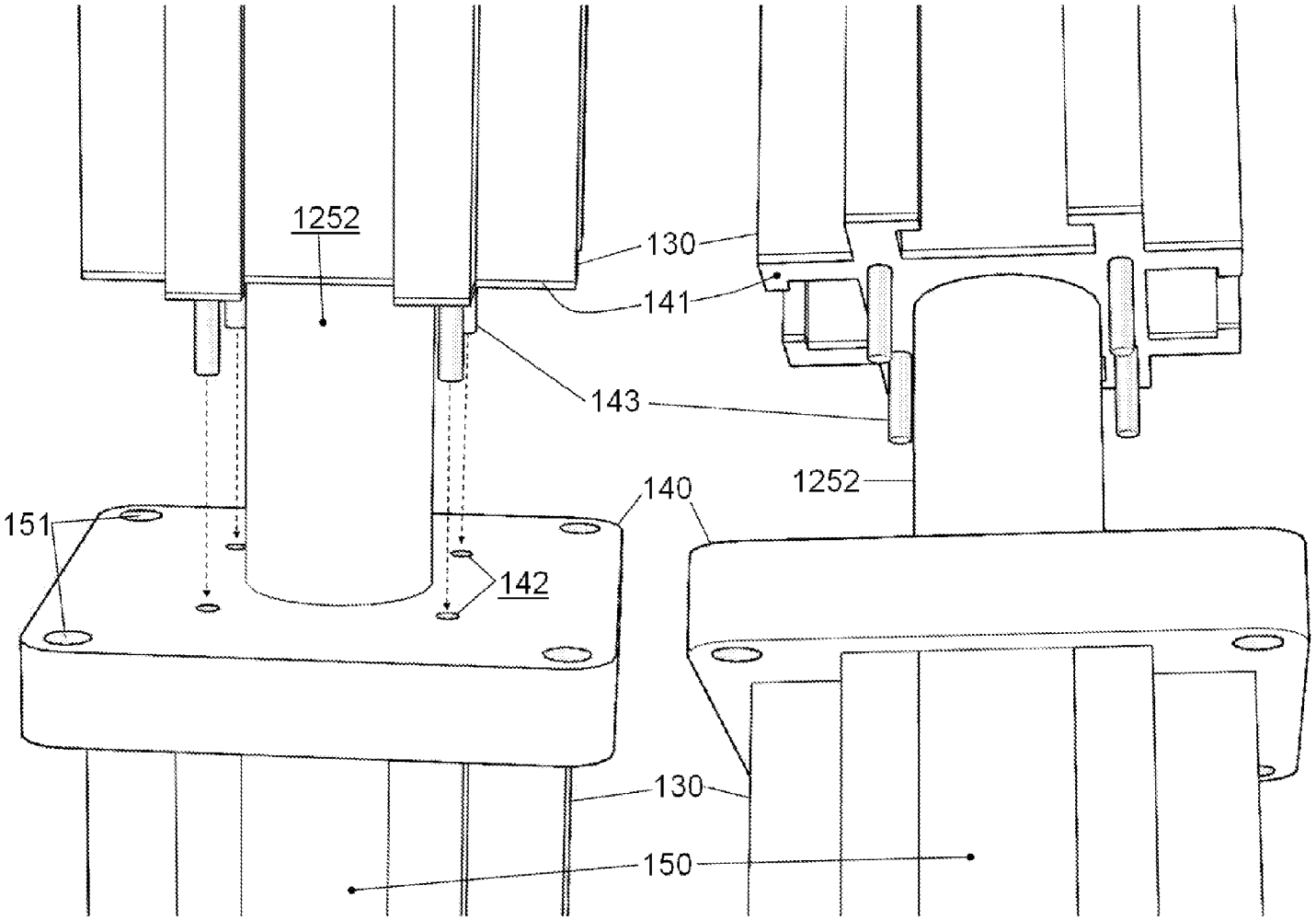
FIG. 15B is a combined from-above and from-below perspective detail view of the mid-point connection between the lower and upper post brackets of the full-height portion of the example assembly shown in FIG. 15A, illustrating the positional relationship between the dowels of the post bracket and the receiving holes in the post bracket cap.

FIG. 15B is a detail perspective view of the mid-point of the full-height Post 1252 assembly shown in FIG. 15A. The dowels 143 of the upper Post Bracket 130 would be inserted into the small-diameter smooth-bore holes 142 in the top surface of the Post Bracket Cap 140, thereby providing the same horizontally-rotational resistance to the Post Bracket 130 in this example as that provided to a Post Bracket 130 installed into a Floor Panel Frame Connector 1055. Note the Finishing Strips 150 installed into the channels of the lower Post Bracket of this example. Also note the layer of gasketing material or compound 141 on the bottom surface of the Post Bracket 130.

Figure 15E:
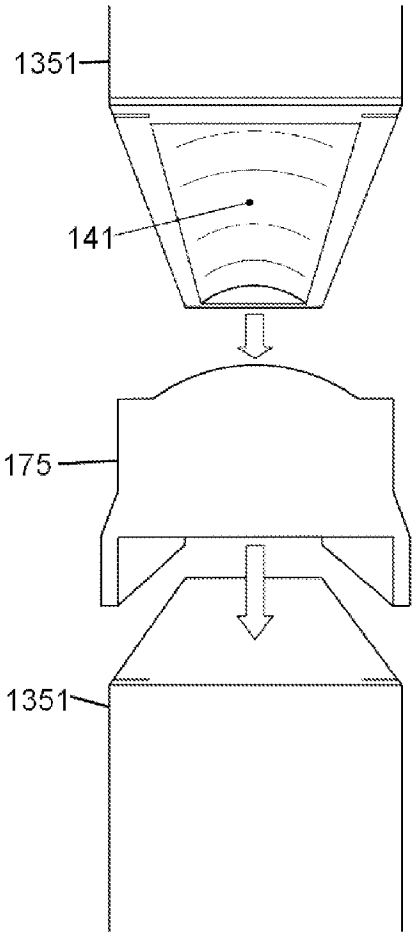
FIG. 15E is an end-on perspective view of the partition panel connector in its relative installation point, as shown in FIG. 15D, between upper and lower partition panels. This view further illustrates the concavity in the bottom surface of the partition panel frame shown in FIG. 15D.
Figure 15D:
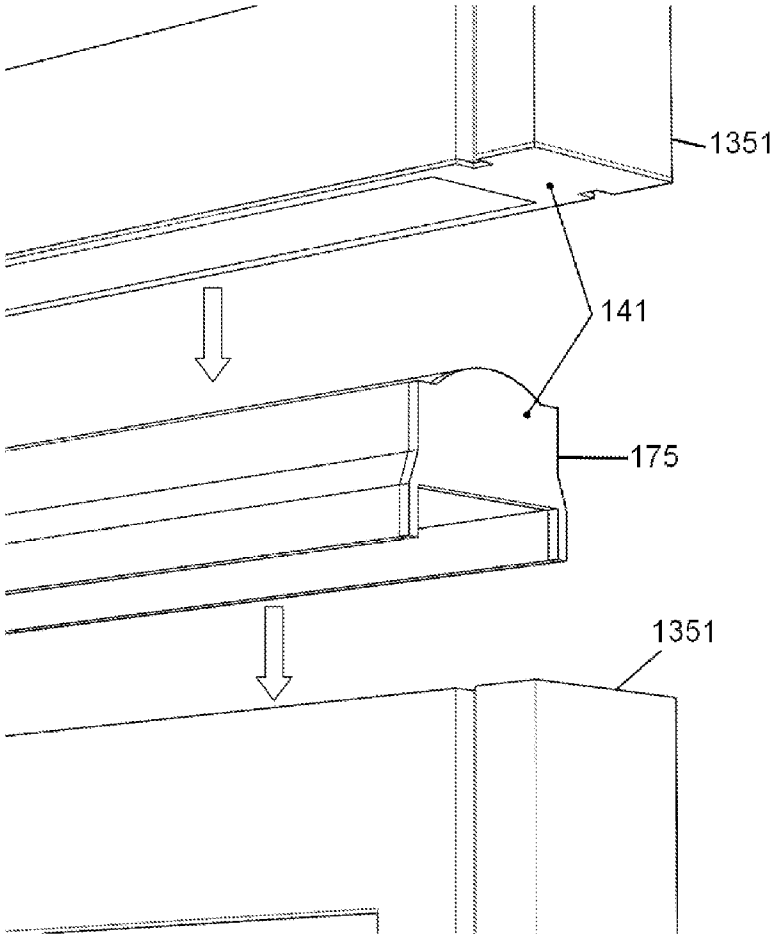
FIG. 15D is a perspective view of the partition panel connector, if used, in its relative installation point between upper and lower partition panels. The entire bottom surface of the partition panel frame, including the concavity, and the end surfaces of the partition panel connector, is covered by a layer of the same gasketing compound or material as that applied to the end surfaces of the partition panel connector.

FIGS. 15D and 15E are, respectively, diagonal and end-on perspective detail views of the complementary shapes of the top and bottom edges and surfaces of the Partition Panels 1351 shown in FIG. 15A, and the shape of the Partition Panel Connector 175, illustrating how the Partition Panel Connector 175 would seal the gap between the two partition Panels 1351.

Figure 16:
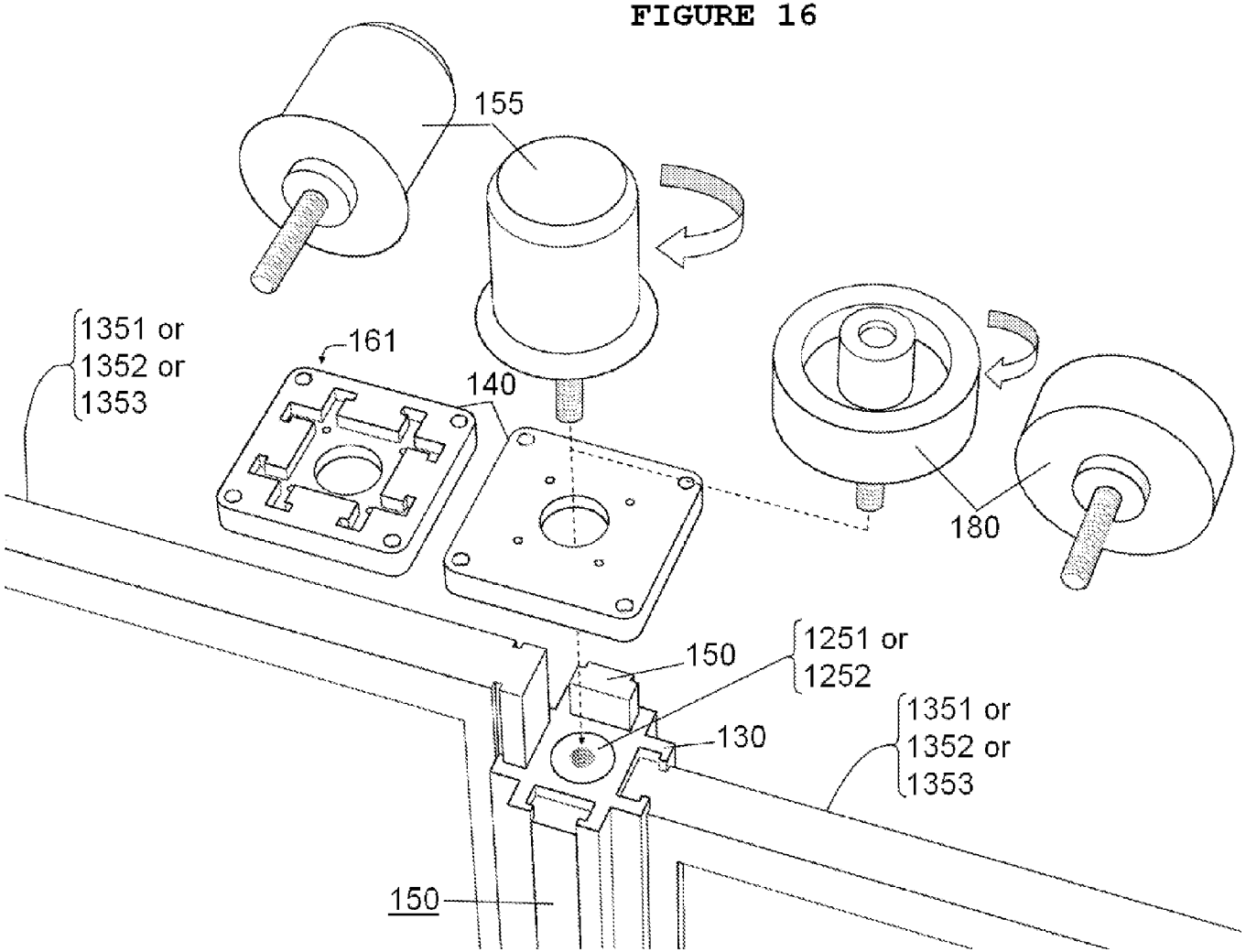
FIG. 16 is a top perspective view of a post assembly top junction, either half-height or full-height, and the partitioning and post-top components that can be installed to that junction, specifically, a post bracket cap and either a finial or a post bracket.

FIG. 16 is a top perspective view of a Post 1251-1252 and Post Bracket 130 assembly top junction, and the components that can be installed to that junction. A Post Bracket Cap 140, shown both inverted 161 and in its upright installation orientation relative to the top of a Post Bracket 130, is installed at the top of every Post Bracket 130, regardless of whether the Post Bracket 130 is installed onto a half-height Post 1251 or a full-height Post 1252. The inverted view 161 of the Post Bracket Cap 140 shows the recessed channels that will fit down over and around the top of the Post Bracket 130. The hole in the center of the Post Bracket Cap 140 top surface allows the Post Bracket Cap 140 to be installed over a full-height Post 1252 when necessary, and also allows the installation of the Finial 155 component, shown here in a simple but functional configuration, or the Roof Bracket 180 component. With the Post Bracket Cap 140 installed, the threaded "bolt" element extending from the base of both the Finial 155 and Roof Bracket 180 is screwed by hand into the threaded top portion of the longitudinal hole 102 running the length of the Post 1251-1252, until the base either of the Finial 155 or Roof Bracket 180 is firmly seated in the hole in the center of the Post Bracket Cap 140, as well as against the top surface of the Post 1251-1252. It can now be seen that, once either the Finial 155 or Roof Bracket 180 has been secured in place, the entire assembly of the Floor Panel Frame Connector 1055, Post 1251-1252, Post Bracket 130, and Post Bracket Cap 140 then would be effectively secured together.

Any channel of a Post Bracket 130 that does not have a Partition Panel 135 installed would be filled by the installation of a Finishing Strip 150. The Finishing Strip 150 component is shaped and sized to fill one channel of a Post Bracket 130, and is installed into a channel of the Post Bracket 130 by sliding it fully down into an unoccupied channel of the Post Bracket 130, thereby providing additional support and solidity to the Post Bracket 130, preventing the accumulation of detritus in the unoccupied channel, and presenting a visually "finished" appearance to the Post 1251-1252 assembly's outer surface. When installed, its top surface would be level with the top surface of an installed Partition Panel 135. Note the T-shaped vertical edges of the Partition Panels 1351-1352-1353, allowing the Partition Panels 1351-1352-1353 to be installed by sliding them down into the T-shaped channels of the Post Bracket 130.

Figure 17:
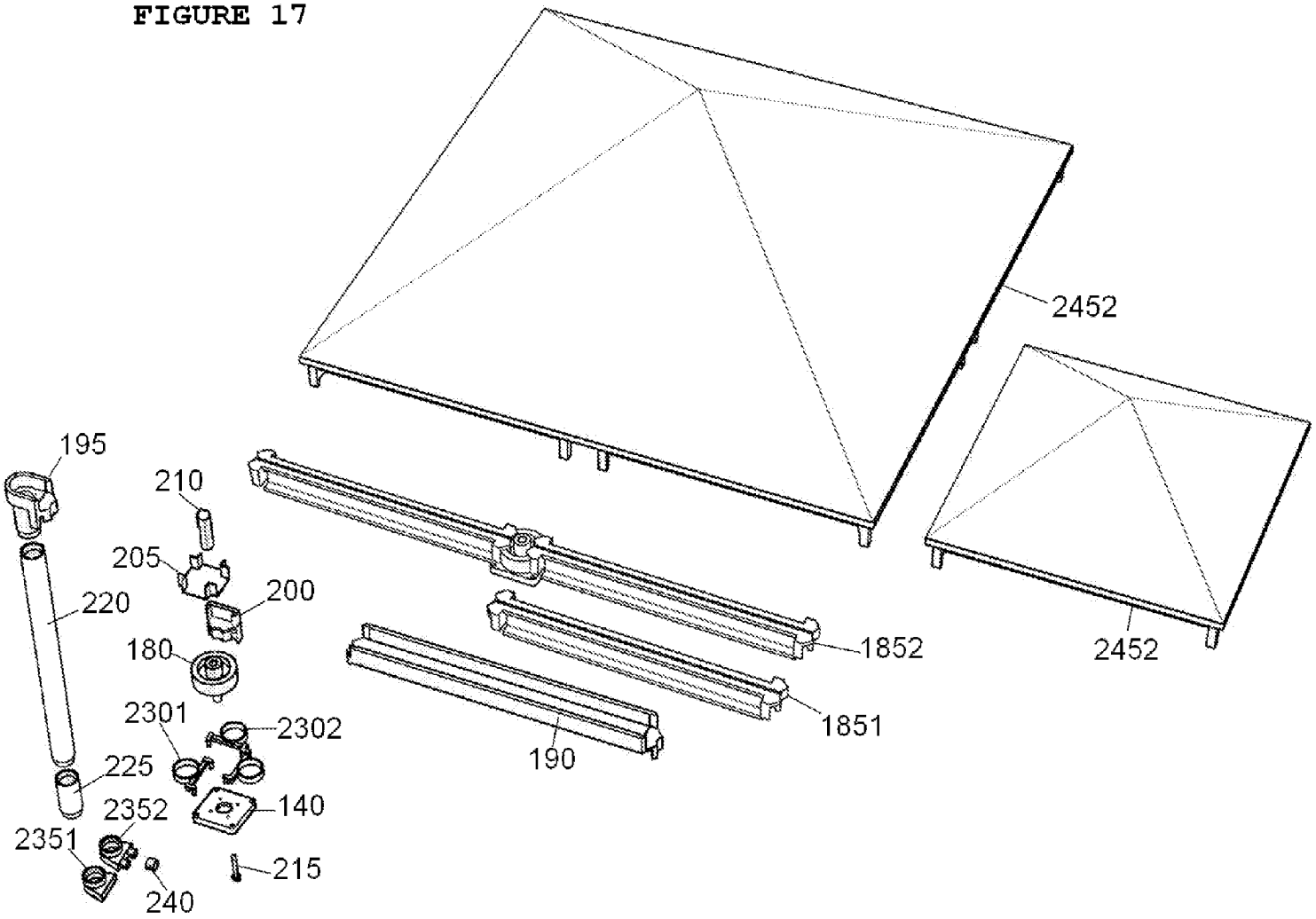
FIG. 17 is a perspective view of a subset of the complete set of system components, with the shown subset used to assemble roofing.

FIG. 17 is a top perspective view of a roofing subset of components. (The Post Bracket Cap 140 component is the only component shown in this drawing that is not exclusively for roofing.) Because structures will vary in configuration from installation to installation, depending on intended use, not all components shown in this drawing are necessary to roof every structure. However, these are all the components necessary to roof any structure that can be assembled from the Handmade Structure System components. The Roof Bracket 180 component provides the connection point for Roof Beam 1851-1852, Gutter Block 200, and Integrated Gutter Section 190 components installed at the top of an installed Post 1251-1252 component. The Roof Beam 1851-1852, in either single-length 1851 or double-length 1852 configuration, provides horizontal support for the Integrated Gutter Section 190 components. The Integrated Gutter Section 190 component is so-called because it performs two functions: (1) it collects and conveys liquid precipitation from the roofed area of a structure to the periphery of a structure, and (2) it provides the installation point and structural support for the Roof Panel 2451-2452 components. The Downspout 195 component collects, redirects, and conveys the precipitation conveyed by the Integrated Gutter Section 190 components downward through one or more assemblies of Downspout Pipe 220 and Downspout Pipe Extension 225 components toward the installation surface. Gutter Block 200 components prevent the outflow of collected precipitation at one quadrant of a roof junction where a Downspout 195 is not installed. The Junction Seal 205 component provides a water-tight seal at the junction of Roof Beam 185, Integrated Gutter Section 190, Roof Bracket 180, Downspout 195, and Gutter Block 200 components. Roof Bolt 215 components provide a secure connection of all roofing components installed at the top of an installed Post 1251-1252 assembly, either half-height 1251 or full-height 1252. The Downspout Pipe Stabilizer 2301-2302 component is used when all or a portion of a full-height structural assembly is roofed. It provides a secure vertical midpoint connection for an assembly of Downspout Pipe 220/Downspout Pipe Extension 225 components on a full-height structure. Water Fitting 2351 (dispersal) and Water Fitting 2352 (harvesting) components, installed at the bottom terminus of a Downspout Pipe 220 assembly, allow this collected and directed precipitation flow to be either dispersed away from an assembled structure over the installation surface, connected to an external water storage system, or conveyed to a more distant dispersal/collection point, such as a drainage ditch, sewer, etc. Various configurations of Downspout Pipe 220 and Downspout Pipe Extension 225 assemblies and Water Fitting 2351-2352 components allow connection to a water storage system that is either above or below ground, Any water collection/storage/conveyance system is external to the Handmade Structure System components, and is neither described in, nor a part of, this invention.

Figures 18A, 18B:
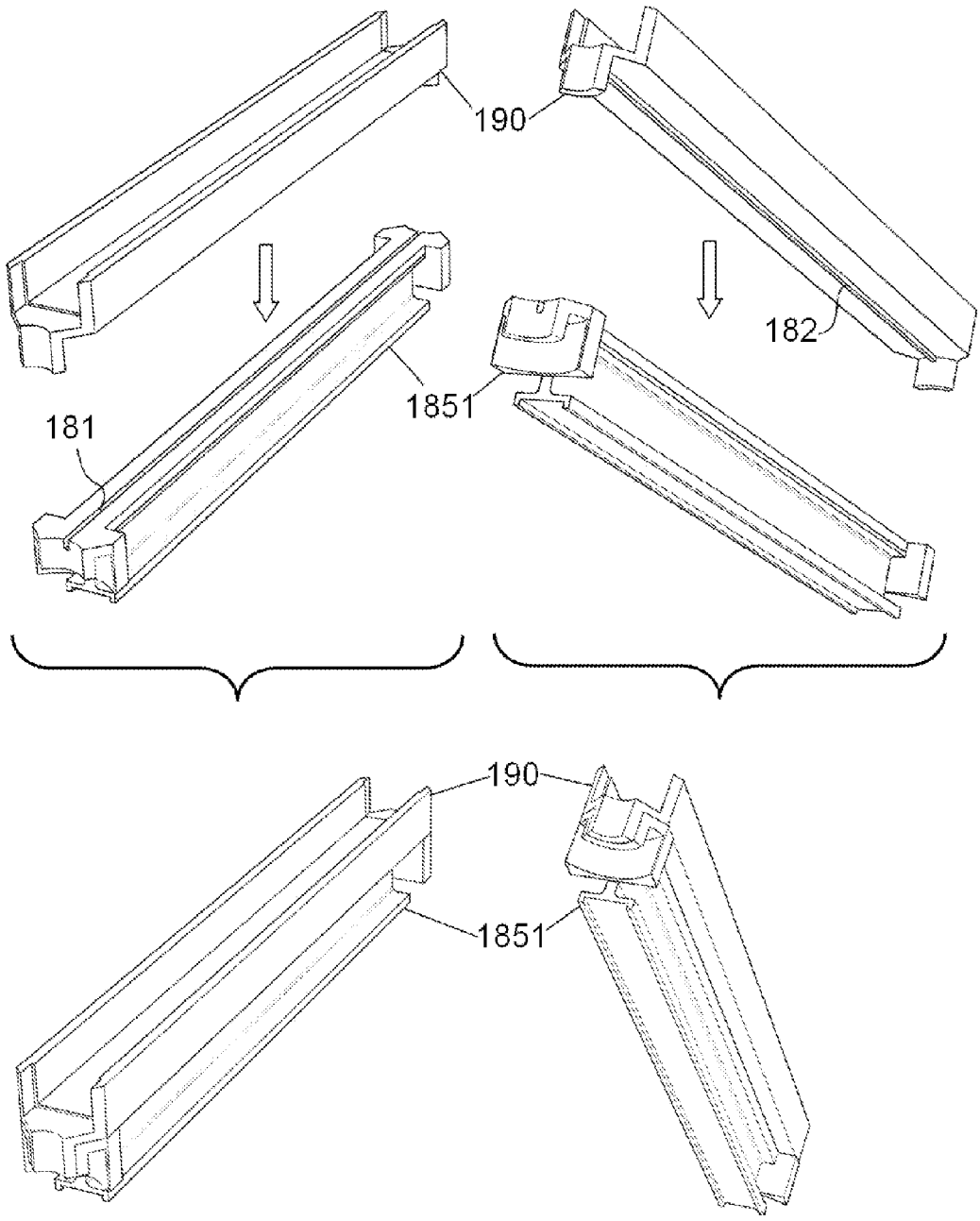
FIG. 18A is a from-above exploded perspective view, and an assembled perspective view, of an integrated gutter component and a "single" roof beam, in their relative installation positions, indicating the channel (181) intended to accept the bottom-surface tab (182) shown in FIG. 18Bof the integrated gutter section.
FIG. 18B is a from-below exploded perspective view, and an assembled perspective view, of an integrated gutter component and a "single" roof beam, in their relative installation positions, indicating the tab (182) intended to fit into the channel (181) of the roof beam, shown in FIG. 18A.

FIGS. 18A and 18B are, respectively, top and bottom combined exploded and assembled perspective views of an Integrated Gutter Section 190 and a "single" Roof Beam 1851, in their relative installation positions. The Roof Beam 1851 is basically an "I" beam with specially configured end connections and top and bottom surfaces, and provides full horizontal support for the Integrated Gutter Section 190. The top surface of the Roof Beam 1851 is shaped to accept the installation of an Integrated Gutter Section 190. The bottom surface of the Roof Beam 1851-1852 is shaped to be installed over the top edge of a Partition Panel 1351-1352, if one is installed beneath the Roof Beam 1851, although it is not required that a Partition Panel 135 be installed beneath a Roof Beam 185. The Integrated Gutter Section 190 fits down over and onto the Roof Beam 1851-1852. The "channel" 181 in the top longitudinal surface of the Roof Beam 185 accepts the "tab" extrusion 182 along the bottom longitudinal surface of the Integrated Gutter Section 190. This prevents lateral shifting between the two surfaces when the Integrated Gutter Section 190 is installed onto the Roof Beam 1851-1852. Each end of the Roof Beam 1851-1852 is shaped as one quadrant (a 90-degree segment of the 360 degrees) of a full circle, with a downward extension of the outer edge of this curved shape equal in depth to the depth of the inner "channel" of a Roof Bracket 180, into which it will be inserted. Each end of the Integrated Gutter Section 190 has a shape identical to the one-quadrant shape of the Roof Beam 1851-1852 ends, and a downward extension of that "quadrant" shape edge, of a vertical length that brings the bottom of that curved extension flush with the bottom of the vertically downward extension of the Roof Beam 1851-1852 end when the Roof Beam 1851-1852 and Integrated Gutter Section 190 are in their installed positions. The curved, downward extensions at the ends of both the Roof Beam 1851-1852 and Integrated Gutter Section 190 are of equal horizontal thickness, and the combined thickness of these extensions is equal to the horizontal radius of the Roof Bracket 180 inner "channel". When both a Roof Beam 1851-1852 and Integrated Gutter Section 190 are installed into one quadrant of a Roof Bracket 180, that quadrant of the inner "channel" of the Roof Bracket 180 will be completely filled.

Figure 18E:
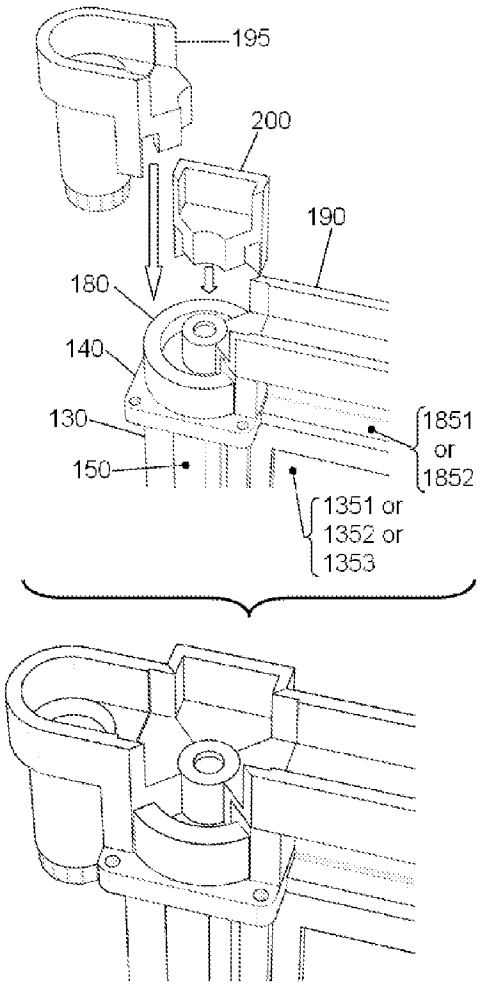
FIGS. 18C through 18E show examples of the interconnecting and interlocking forms of roof beams, downspouts, integrated gutter sections, and gutter block components, being installed to a roof bracket.
Figure 18D:
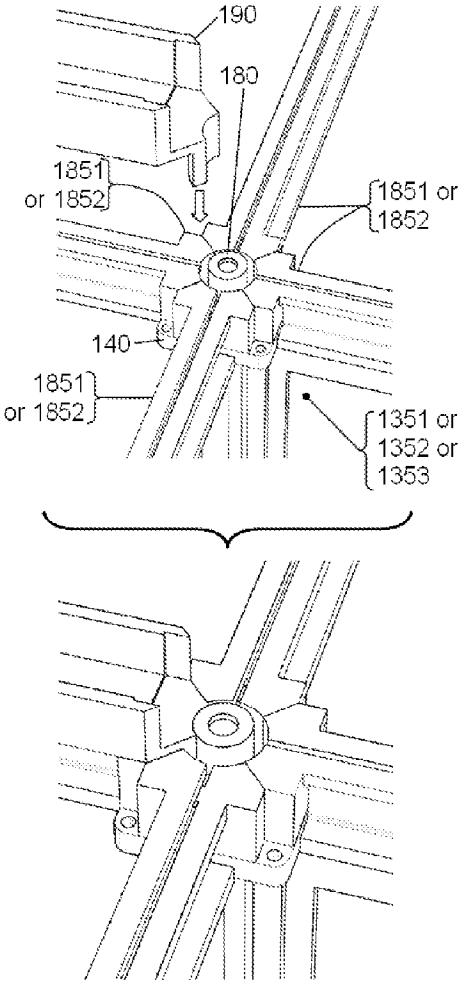
Figure 18C:
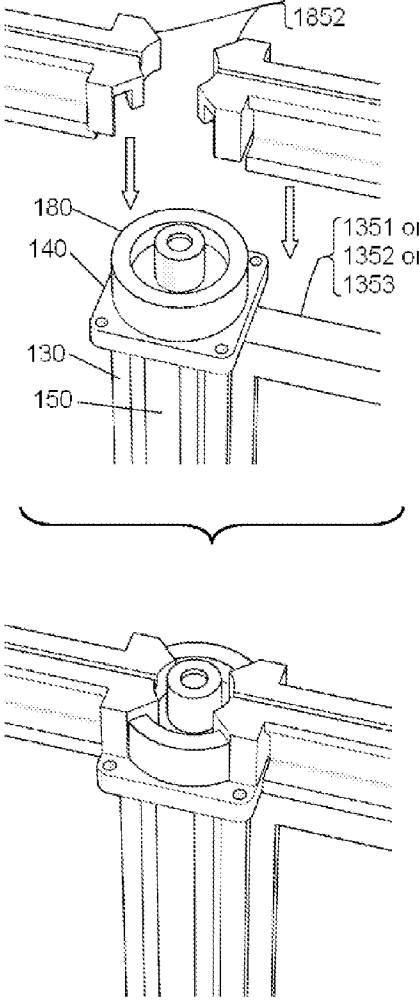

FIGS. 18C through 18E show examples of various combinations of Roof Beams 1851-1852, Integrated Gutter Sections 190, a Downspout 195 and a Gutter Block 200 being installed to a Roof Bracket at the top of a Post 1251-1252 assembly; note the inter-locking of the various elements of the components. Note that it is possible to install Roof Beams 1851-1852 whether a Partition Panel 1351-1352-1353 is installed beneath them or not.

Figure 19:
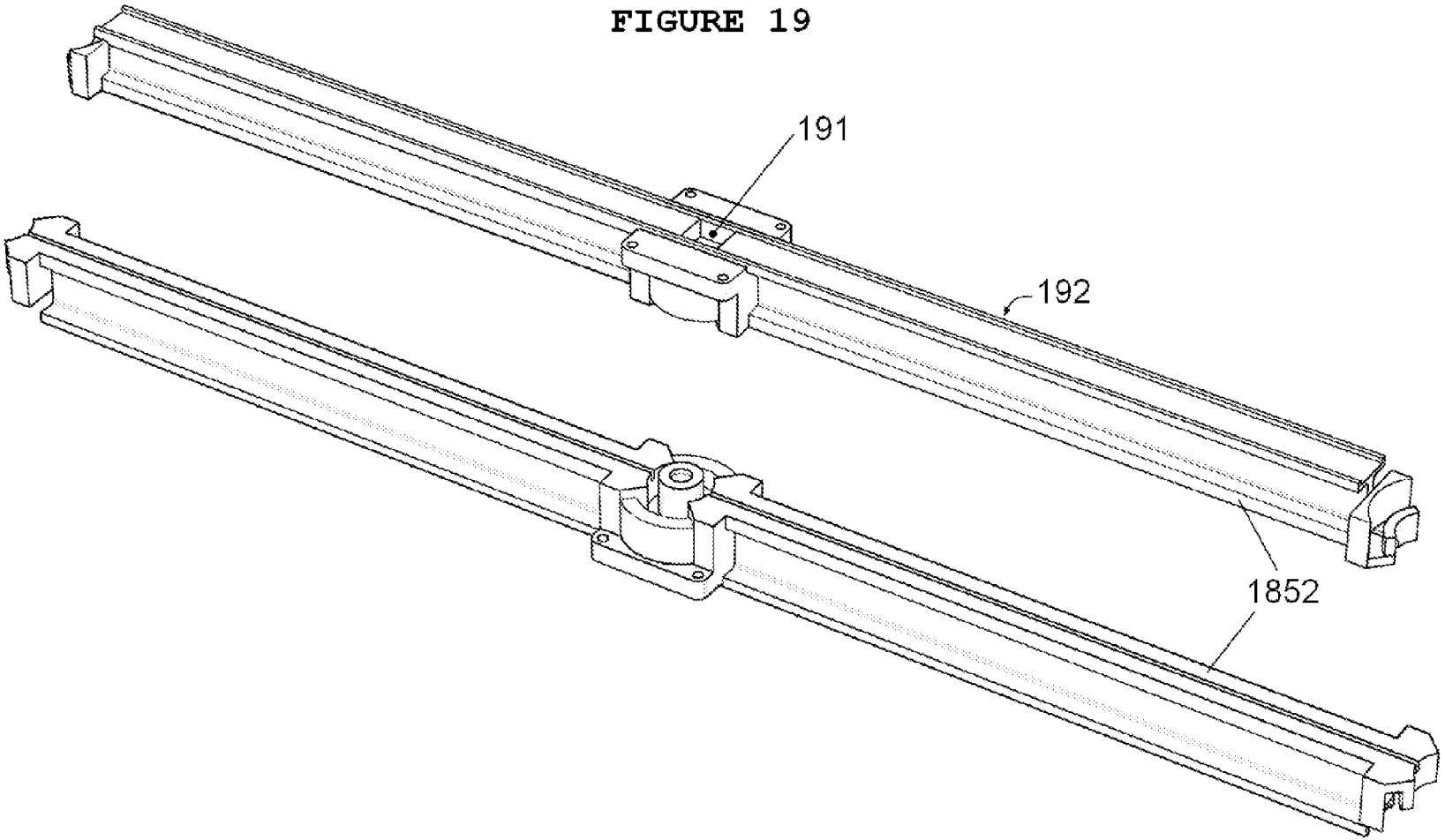
FIG. 19 is a top and bottom perspective view of a double roof beam, shown both inverted (192) and upright. A "double" roof beam is functionally equivalent to a roof bracket installed over a post bracket cap, with two single roof beams installed end-to-end into the roof bracket, but produced as a single unified component. Note the square receptacle (191) in the bottom center surface of the roof beam; this receptacle will receive the tab (22) in the top center of a double-width, full-height partition panel frame (1353)

FIG. 19 is a top and bottom perspective view of a "double" Roof Beam 1852. A "double" Roof Beam 1852 is structurally equivalent to a combination of two "single" Roof Beam 1851 components, installed into a Roof Bracket 180, with the Roof Bracket 180 itself installed to a Post Bracket Cap 140, but as one solid piece. This component allows for a greater span between installed Post 1251-1252 components without a Post 1251-1252 being installed beneath the midpoint, thereby allowing more unobstructed floor space within an assembled structure. The bottom surface of that portion of the "double"

Roof Beam 1852 that is structurally equivalent to a Post Bracket Cap 140 varies from an actual Post Bracket Cap 140 in that it has no channels in its bottom surface shaped to fit over a Post Bracket 130. Instead, it has a single square cavity 191, intended to accept an identically-shaped extrusion at the top center of a double-width variation of a Partition Panel 1353 configured as a double door or window, if one is installed beneath the "double" Roof Beam 1852. (The configuration, materials, form, or functionality of a panel element (hinged or sliding doors, bifold doors, glass or screen panel elements, etc.) of a Partition Panel 1353 that would make use of the square cavity just described is a possible and optional component configuration, and is not included in this specification; only the Partition Panel 1351-1352-1353 frame element is included.) As with the "single" Roof Beam 1851, the installation of a Partition Panel 1351-1352-1353 beneath a "double" Roof Beam 1852 is not required.

Figure 20:
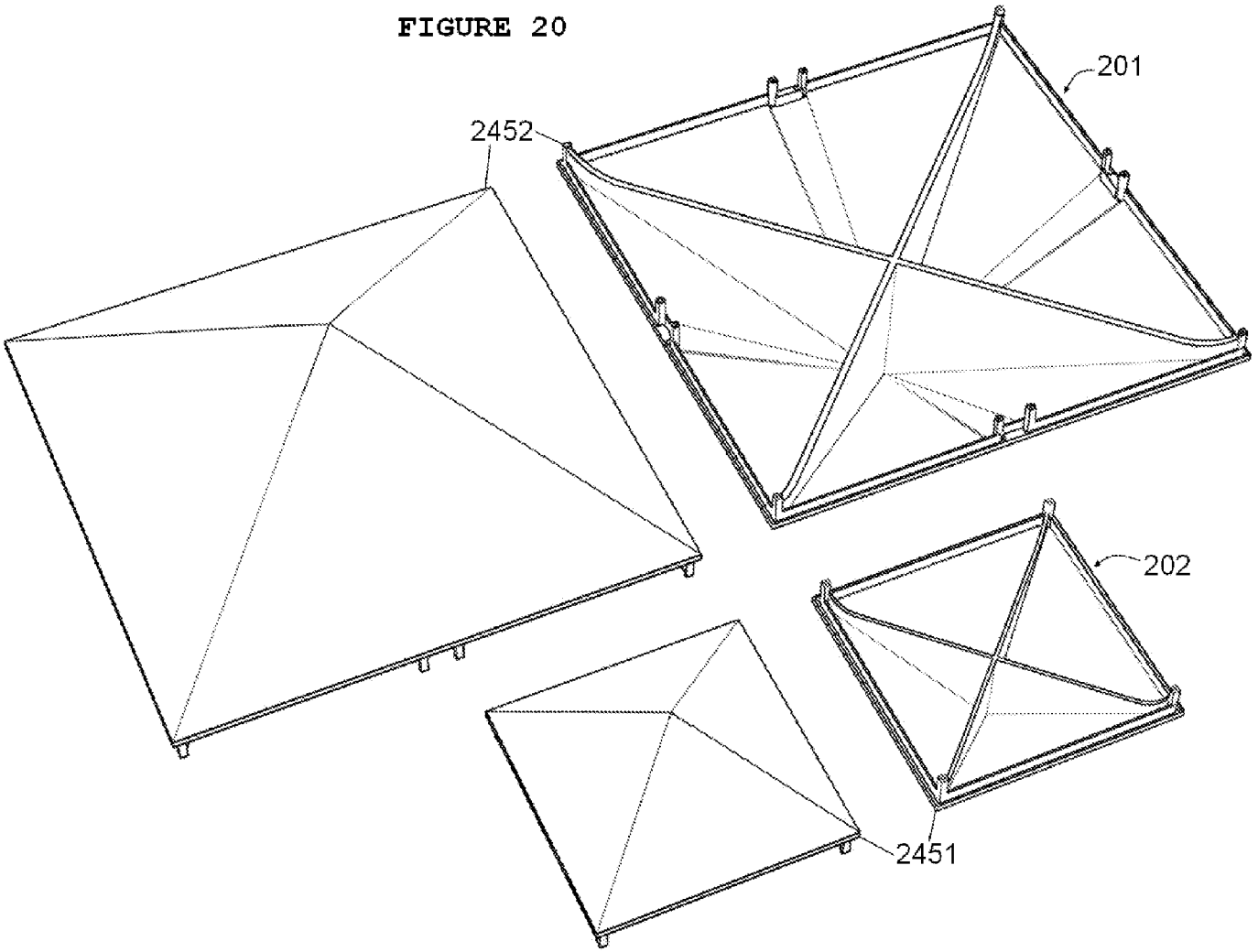
FIG. 20 is a top and bottom perspective view of a "single" (2451) roof panel and a "quad" (2452) roof panel. A "single" roof panel covers the surface area of a flooring assembly of one floor panel frame, while a "quad" roof panel covers the surface area of a flooring assembly of four floor panel frames assembled in a two-by-two, square configuration.

FIG. 20 is a top and bottom perspective view of a "single" 2451 and a "quad" Roof Panel 2452. A "single" Roof Panel 2451 is used to roof over an area equal to that of a single Floor Panel Frame 100. A "quad" Roof Panel 2452 is used to roof over an area equal to that of four Floor Panel Frame 100 components assembled into a square. Both configurations of the Roof Panel 2451-2452 have a continuous channel 211 around their bottom periphery. The configuration of elements at the four corners of both "single" and "quad" Roof Panel 2451-2452 components is identical in dimension and structure. Both configurations of the Roof Panel 2451-2452 component have four corner posts, with a hole 212 in the bottom surface of each of the posts threaded to accept a Roof Bolt 215. Each of the corner posts is positioned to align with the hole 151 in each corner of a Post Bracket Cap 140. Both configurations have diagonally-intersecting vertical members to provide rigidity and support, although other configurations of these diagonals are possible. These diagonals merge into the posts at each corner.

A "single" Roof Panel 2451 is installed onto four Integrated Gutter Section 190 components contiguously installed at right angles to each other onto four equal-height Post 1251-1252 assemblies in a square configuration above a surface area that would be roughly equal to the surface area of a single Floor Panel Frame 100 assembly, with their four inner side walls effectively forming an open "box" framework. A "single" Roof Panel 2451 will be installed down onto the top of this "box". The continuous channel around the bottom periphery of the "single" Roof Panel 2451 fits snugly down over and onto the top side/edge surface of each of the four Integrated Gutter Section 190 components, thereby sealing the "top" of the aforementioned "box", and conveying precipitation from each of the four sloped surface planes of the Roof Panel 2451 into the four Integrated Gutter Section 190 components onto which it is installed.

A "quad" Roof Panel 2452 is installed onto a larger square "box" frame formed by two Integrated Gutter Section 190 components installed end-to-end on each of the four sides of this larger "box". The end-to-end Integrated Gutter Section 190 components forming each side of this larger "box" may be installed onto a "double" Roof Beam 1852, or two "single" Roof Beam 1851 components. Because each side of the "quad" Roof Panel 2452 spans the gap between two Integrated Gutter Section 190 components installed end-to-end, the midpoint of each side of the "quad" Roof Panel 2452 is configured with two (2) equivalents of the posts in each corner, for a total of twelve (12) posts. The "quad" Roof Panel 2452 has thickened portions 214 at the underside center of each sloped plane, to provide additional strength and support for the larger surface area of each plane. These thickened portions 214 taper in horizontal width from each of the side connecting points of the "quad" Roof Panel 2452 to the underside apex of the "quad" Roof Panel 2452.

Figure 21A:
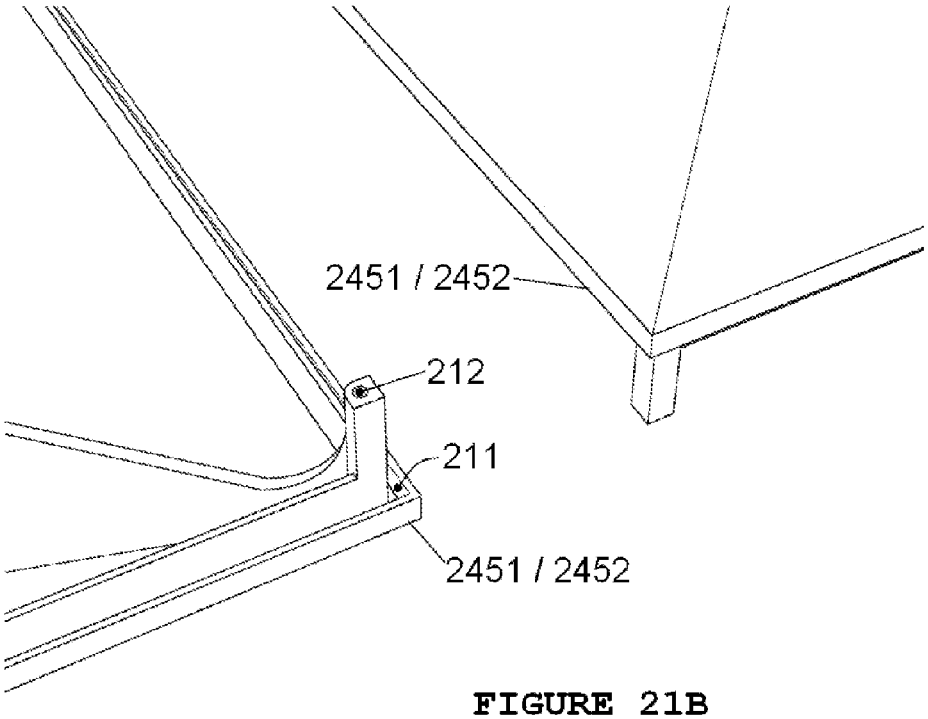
FIG. 21A is a combined top and bottom perspective detail view of a corner connection point of both "single" and "quad" roof panel components. It illustrates the threaded holes (212) in the posts at each corner of both sizes (2451/2452), the continuous channel (211) at the periphery of both sizes of roof panels.
Figure 21B:
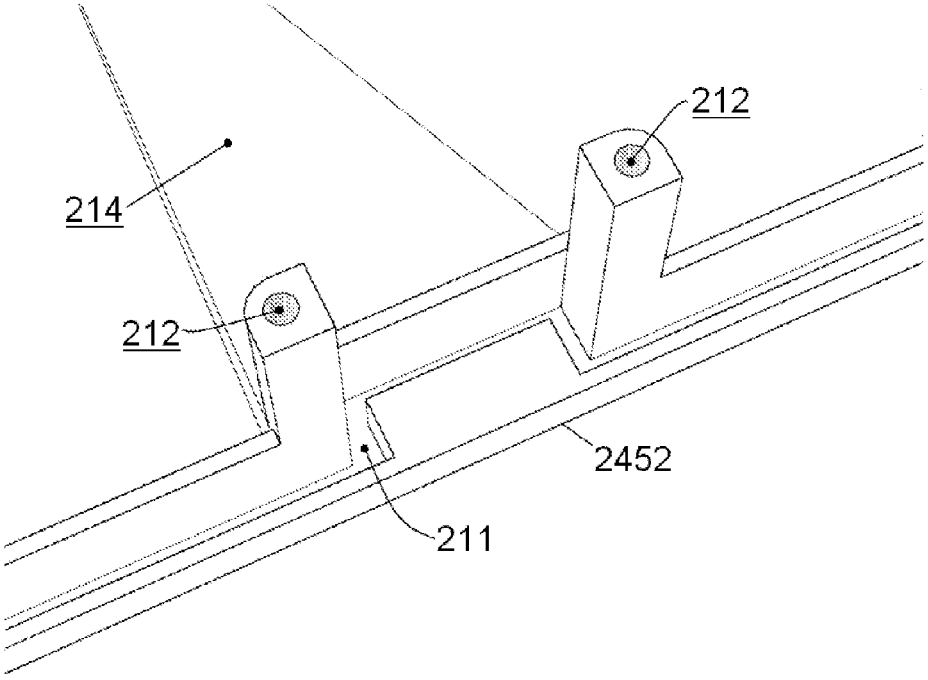
FIG. 21B is an inverted perspective detail view of one side middle connection point of a "quad" roof panel. It illustrates the change in the shape of the continuous channel at the midpoint of each of the four sides of the "quad" roof panel to allow installation to a gutter block component at this point on all four sides, and the thickened "rib" portion (214) of the "quad" panel surface (214)

FIG. 21A is a top and bottom perspective detail view of a corner connection point of both "single" 2451 and "quad" 2452 Roof Panel 2451-2452 components, while FIG. 21B is an inverted view of one of the four side connection points of a "quad" Roof Panel 2452. When either configuration of the Roof Panel 2451-2452 is in its installed position, the threaded hole 212 in each of these posts will align with the unthreaded holes 151 in each corner of the Post Bracket Cap 140 upon which the bottom surface of the Roof Panel 2451-2452 posts rests, or the structural equivalent of a Post Bracket Cap 140 at the center of a "double" Roof Beam 1852. This alignment allows the upward insertion of a Roof Bolt 215 through the unthreaded hole 151 in the corner of the Post Bracket-Cap 140, or the structural equivalent of the Post Bracket Cap 140 at the center of a "double" Roof Beam 1852. The Roof Bolt 215 components are then screwed by hand into the threaded holes 212 in the bottom of the Roof Panel 245 corner posts. Four (4) hand-tightened Roof Bolt 215 components are required to secure a "single" Roof Panel 2451 in place, while twelve (12) Roof Bolt 215 components are required to secure a "quad" Roof Panel 2452; one at each corner, and two at each side connection point.

Figure 22:
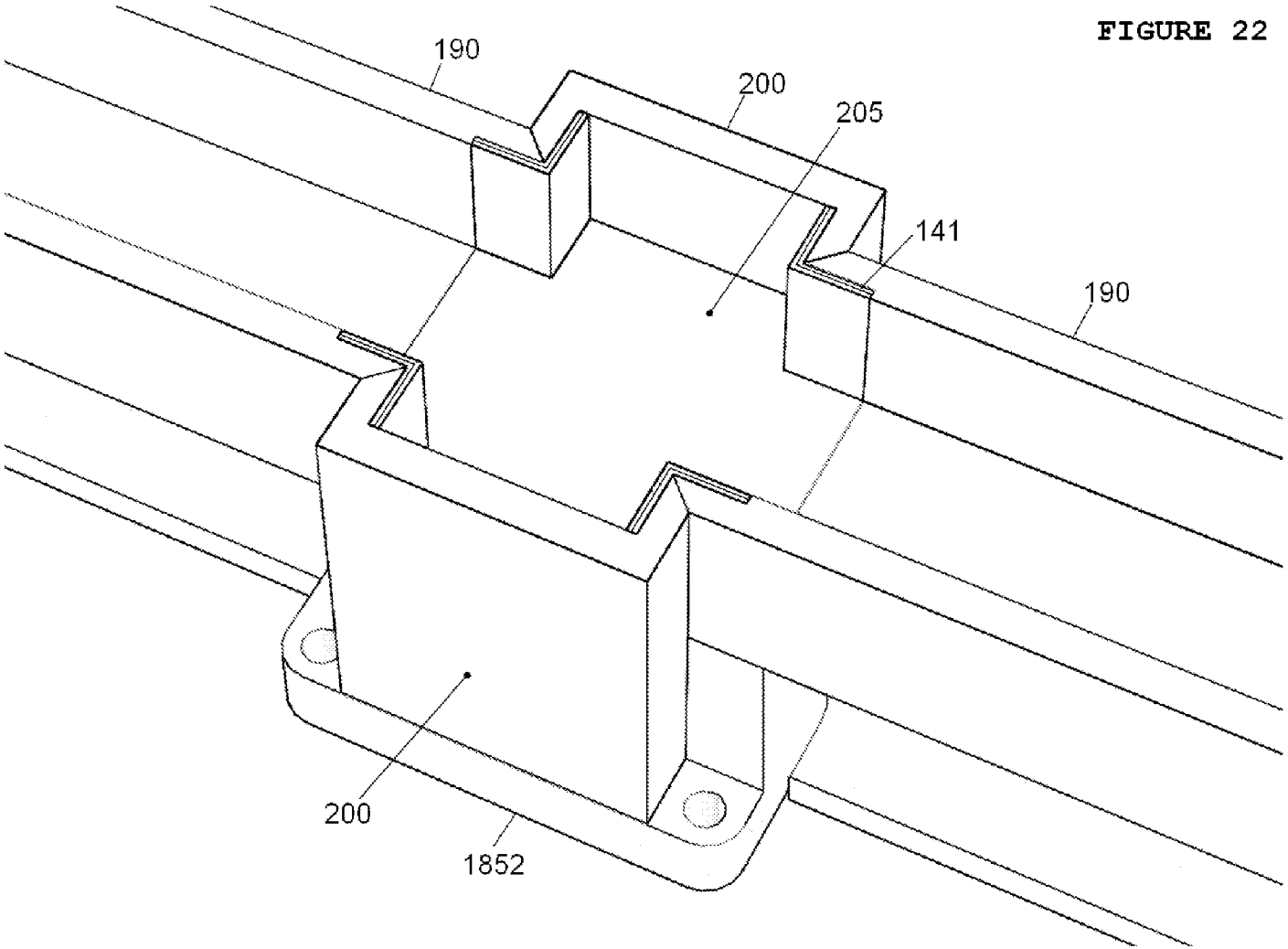
FIG. 22 is a top perspective view of an installed junction seal component. It is installed at any junction of any combination of integrated gutter sections, downspouts, and gutter blocks, to cover and seal the seams between those components. The junction seal has a layer of gasketing material or compound (141) on every surface that comes in contact with other roofing components installed at the junction. In this particular example, the installation is at the midpoint of a "double" roof beam.

FIG. 22 is a top perspective view of a roofing-connection-and-sealing-components assembly at one side connection location for a "quad" Roof Panel 2452. In this particular example, the two (2) Integrated Gutter Section 190 components have been installed onto a "double" Roof Beam 1852, but could have been installed onto two "single" Roof beam 185 components installed end-to-end. Both sides of this particular Roof Bracket 180 assembly have been filled with Gutter Block 200 components. Note the shape formed by the top edge surfaces of the Integrated Gutter Section 190 components and the Gutter Block 200 components, and how that shape matches the shape of the peripheral channel 211 at the midpoint of the "quad" Roof Panel 245 shown in FIG. 21. Each midpoint connection point of the "quad" Roof Panel 2452 will fit down over and onto an identical configuration of Integrated Gutter Section 190 and Gutter Block 200 components at each side of the square being roofed by the "quad" Roof Panel 2452.

Figure 23A:
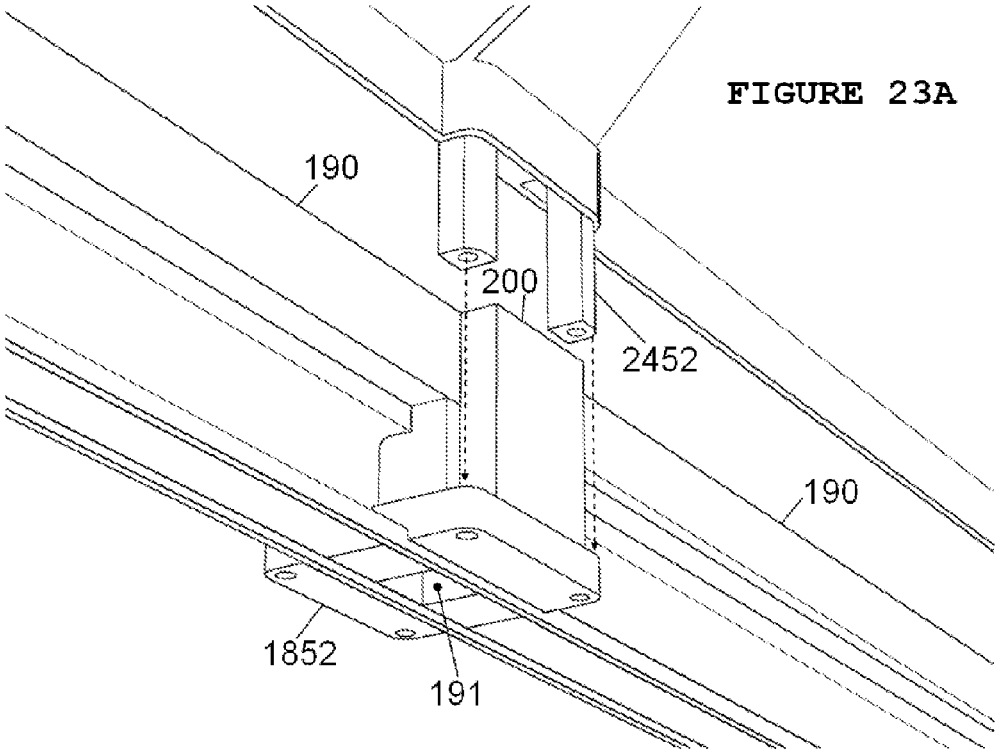
FIG. 23A is a bottom perspective detail view of the side midpoint connection location of a "quad" roof panel being installed to the midpoint of a "double" roof beam. Again, note the square receptacle (191)
Figure 23B:
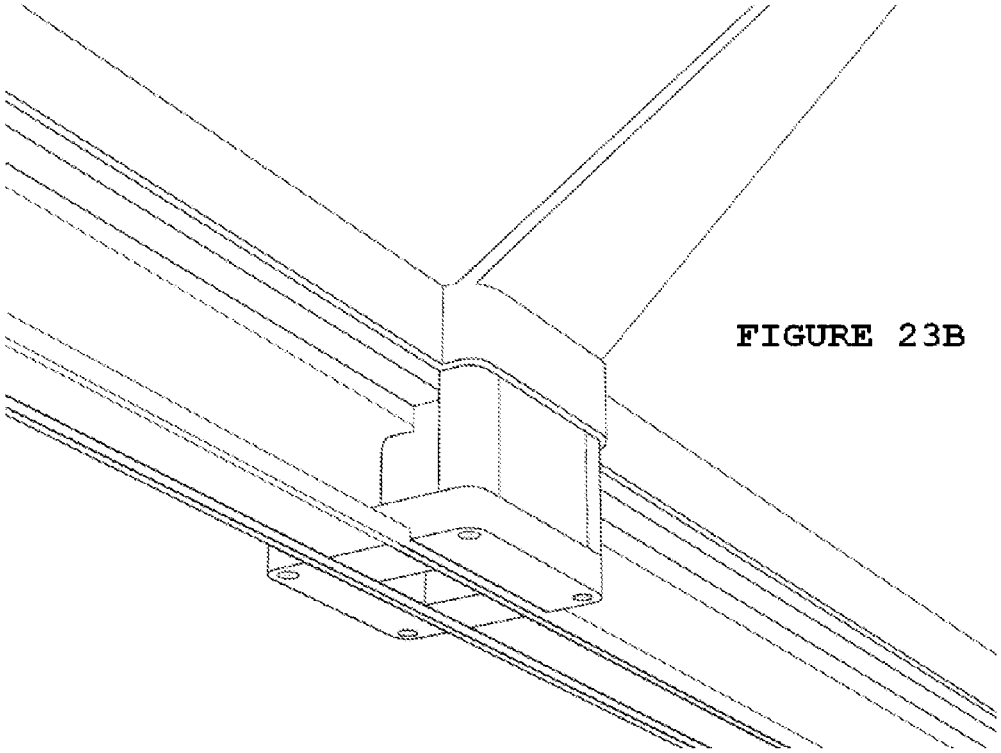
FIG. 23B is a bottom perspective detail view of the side midpoint connection location of a "quad" roof panel after being installed to the midpoint of a "double" roof beam. Note that the threaded holes of the roof panel post elements align with the corner holes of the post bracket cap element of the double roof beam.

FIGS. 23A and 23B are perspective views of a "quad" Roof Panel 2452 being installed to the midpoint of a "double" Roof Beam 1852 (FIG. 23A), and in its installed location (FIG. 23B). These figures illustrate how the positioning of the "quad" Roof Panel 2452 brings the two posts at each midpoint of that "quad" Roof Panel 245 into alignment with the corner holes 151 of the Post Bracket Cap 140, or its structurally equivalent portion of a "double" Roof Beam 1852, at that midpoint. FIG. 23A shows the "quad" Roof Panel 2452 in position to be lowered onto the installed Integrated Gutter Section 190 and Gutter Block 200 components at this side of the "quad" Roof Panel 2452. FIG. 23B shows the "quad" Roof Panel 2452 in its installed position, relative to the other components at this location. Each of the "quad" Roof Panel 2452 component's four (4) side midpoints will fit onto and over the components at their respective locations. With all components at this location installed, one (1) Roof Bolt 215 will be upwardly inserted through each of the four (4) holes 151 in the corners of either the Post Bracket Cap 140, or, as in this example, the structurally-equivalent portion of a "double" Roof Beam 1852, and screwed into the threaded holes 212 of the "posts" of the Roof Panel 245, if one is installed, or into the threaded holes of Roofing Clamp 210 components otherwise.

Figure 24A:
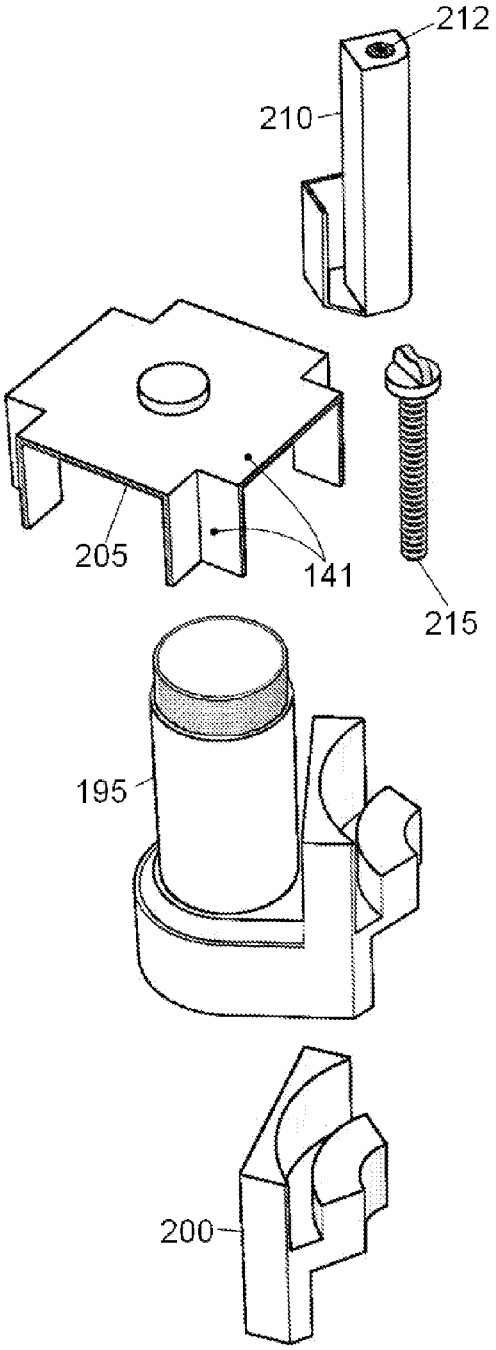
FIG. 24A is an inverted perspective view of the remaining roofing components from the subset of roofing components shown in FIG. 17, specifically the roofing clamp, junction seal, roofing bolt, downspout, and gutter block.
Figure 24B:
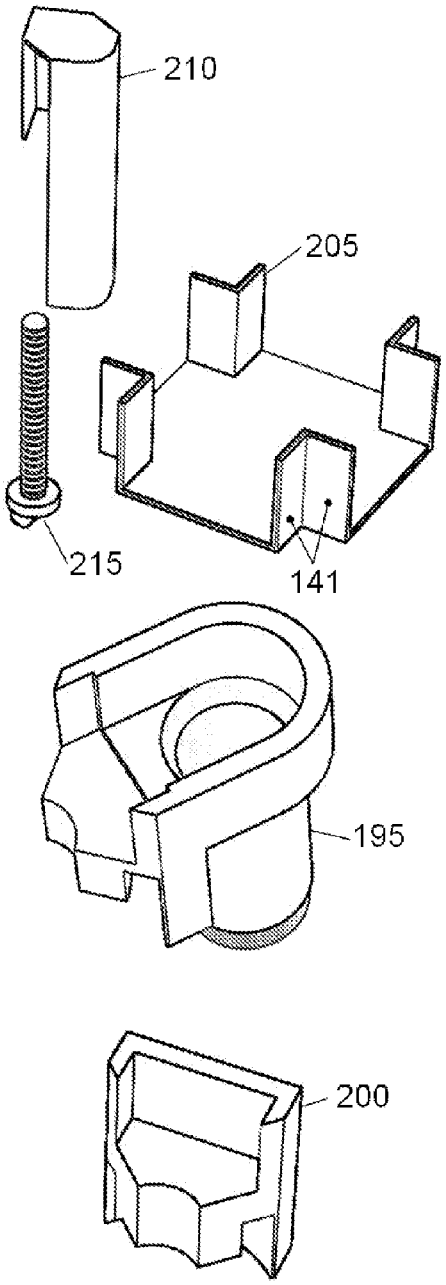
FIG. 24B is a perspective view of the remaining roofing components from the subset of roofing components shown in FIG. 17, specifically the roofing clamp, junction seal, roofing bolt, downspout, and gutter block, shown here in their upright installation orientations.

FIGS. 24A and 24B are, respectively, inverted and upright perspective views of connecting and sealing components for roofing.

From top to bottom, in each figure, respectively, the components are: 1) the Roofing Clamp 210. This component is used to secure each corner joint of a roofing component juncture that is not occupied by the corner and post element of a Roof Panel 2451-2452 at one corner of an installed Post 1251-1252 assembly, either half-height 1251 or full-height 1252. The Roofing Clamp 210 has a vertical post element, analogous to the corner posts of a Roof Panel 245. The vertical element of the Roofing Clamp 210, like the corner posts element of a Roof Panel 2451-2452, has a threaded hole 212 in its center bottom surface. The top portion of the Roofing Clamp 210 is shaped to fit snugly down over the corner joint formed by the juncture of two Downspout 195 components, or the juncture of two Gutter Block 200 components, or the juncture of a Downspout 195 and a Gutter Block 200, installed adjacently and at right angles to each other, into a single Roof Bracket 180, and after the installation of a Junction Seal 205 component. The bottom surface of the vertical post element of a Roofing Clamp 210 will rest on the top corner surface of either a Post Bracket Cap 140, or the structurally-equivalent portion of a "double" Roof Beam 185; 2) the Roof Bolt 215 component. The Roof Bolt 215 has a shaft threaded to screw into either the threaded hole 212 in a Roofing Clamp 210, or the threaded hole in the posts of a Roof Panel 2452451-2452. The head of the Roof Bolt 215 has a large "tang" to enable the hand-installation of the bolt; 3) the Junction Seal 205 component. This component is formed to fit down into the "four-cornered" junctions of Downspouts 195, Gutter Blocks 200, Integrated Gutter Sections 190, or any combination thereof, installed at the top junction of Post 1251-1252 assemblies, the configuration of said assemblies determined by the desired or required roofing configuration of an assembled structure. It seals all the vertical seams between these components, and also seals the horizontal seams between components installed into the Roof Bracket 180 that supports the entire grouping of roofing components installed to the Roof Bracket 180. The round extrusion on the bottom surface of the Junction Seal 205 fits into the hole in the top of the central column of a Roof Bracket 180, to prevent lateral shifting of its bottom surface relative to the top surface of the Roof Bracket 180 onto which it is installed; 4) the Downspout 195 component. This component captures liquid precipitation flowing to it from the Integrated Gutter Section 190 components, and redirects that precipitation downwardly through its "pipe" element downwardly into a Downspout Pipe 220 toward the installation surface. The top "floor" of the Downspout 195 has a hole with a beveled or chamfered "lip" to facilitate water flow into the downwardly-oriented "pipe" element of the Downspout 195. The ends of the side wall are vertically angled at 45 degrees to allow them to fit flush with adjacently-installed Downspout 195 components, or Gutter Block 200 components, or Integrated Gutter Section 190 components, whichever might be installed adjacent to the Downspout 195. The top surface of the Downspout 195 "floor" that is installed over and into a Roof Bracket 180 is "stepped down" from the remaining "floor" surface, to allow the Junction Seal 205 component, when installed, to bring the entire top surface of this junction of components to a horizontally flush and even level with the top "floor" of the Integrated Gutter Section 190. The bottom end of the "pipe" element of the Downspout 195 is threaded on its outside surface to allow Downspout Pipe 220 or Downspout Pipe Extension 225 components to be screwed by hand onto the "pipe" element of the Downspout 195. That curved and downwardly projecting portion of the Downspout 195 that will be inserted into the Roof Bracket 180 is shaped identically with those portions of the Roof Beam 1851-1852 and Integrated Gutter Section 190 components that insert into the top inner channel of a Roof Bracket 180. The thickness of the curved downwardly-extending portion of the Downspout 195 is equal to the combined thickness of the portions of the Roof Beam 185 and Integrated Gutter Section 190 components that are inserted into the circular channel on top of the Roof Bracket 180, thereby entirely filling one quadrant of the circular channel of the Roof Bracket 180, when installed. The remaining portion of the "base" element of the Downspout 195 will rest on the top surface of the Post Bracket Cap 140 installed below it, or the structurally-equivalent portion of a double Roof Beam 1852, with the curved inner surface of the "base" element of the Downspout 195 resting flush against the round outer side wall of the Roof Bracket 180; 5) the Gutter Block 200 component is shown. This component is physically equivalent to the supporting "base" portion of a Downspout 195, and the curved connecting portion that is inserted into the Roof Bracket 180, but with a straight and solid "back" wall at a right angle to its side walls, instead of the curved vertical side wall of the Downspout 195. It installs in exactly the same manner as a Downspout 195, and is used to close one quadrant of a Roof Bracket 180 assembly at which no Downspout 195 is installed. Like the Downspout 195, the curved inner surface of its supporting "base" will rest flush against the round outer side wall of the Roof Bracket 180. It will prevent water from flowing out of one quadrant of one junction of roofing components at the top of a Post 125 assembly.

Figure 25:
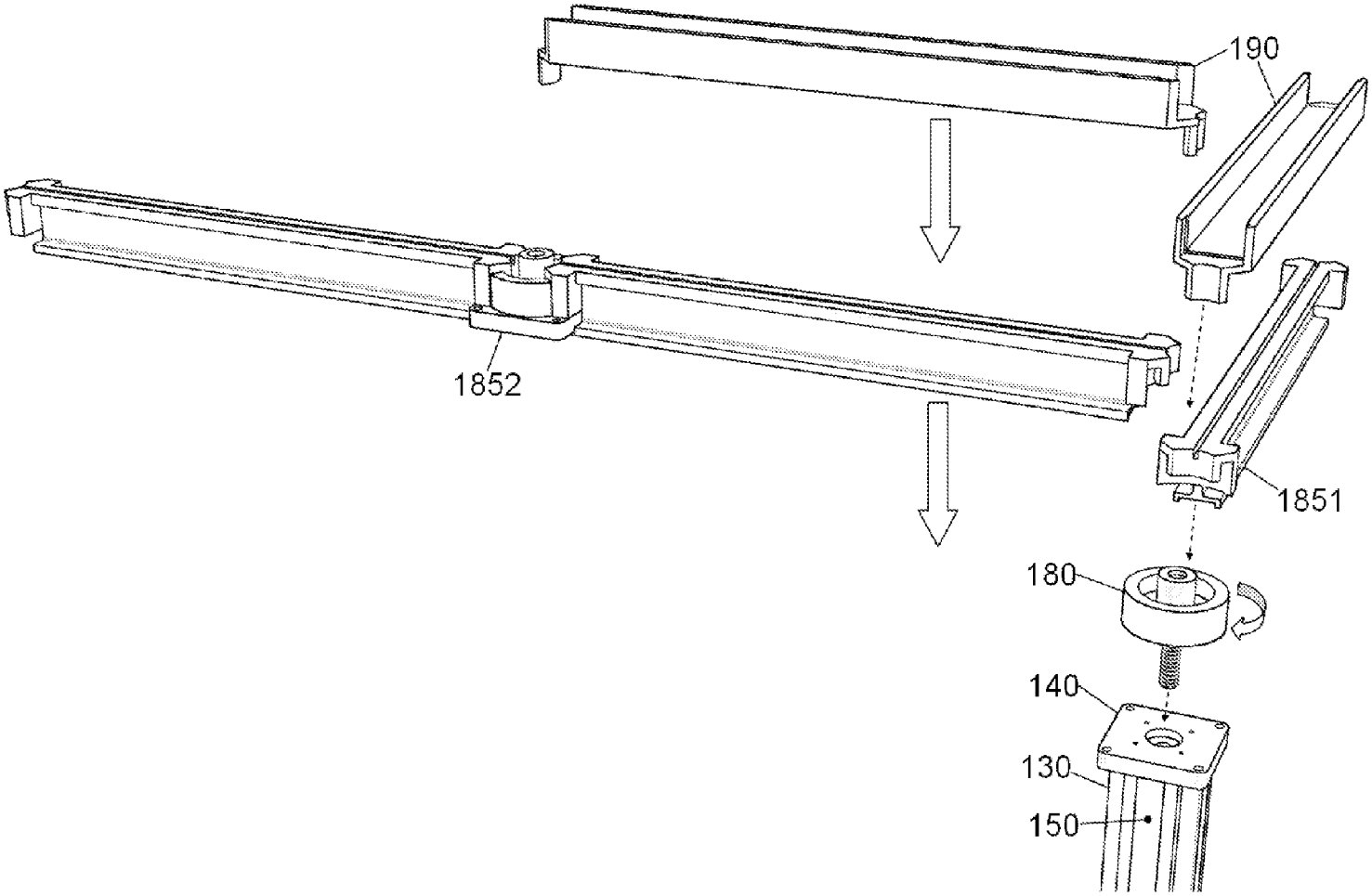

FIG. 25 is a front exploded perspective view of an example corner assembly of supporting and connecting components for a Roof Panel 2451 installation. In this example, a Post Bracket Cap 140 will be installed atop an installed Post 1251-1252, with a Post Bracket 130 having been slid down over the Post 1251-1252, and Finishing Strip 150 components installed into the side channels of the Post Bracket 130. This Post 1251-1252 assembly may be either half-height 1251 or full-height 1252, as both half-height and full-height structures may be roofed. The threaded "bolt" element of a Roof Bracket 180 will be inserted through the Post Bracket Cap 140 and screwed into the threaded hole 102 in the top of the Post 1251-1252. In this example, a "single" Roof Beam 1851 will be installed into one quadrant of the Roof Bracket 180, and a "double" Roof Beam 1852 will be installed into an adjacent quadrant of the Roof Bracket 180. Two (2) Integrated Gutter Section 190 components are shown being installed, one onto the "single" Roof Beam 1851 and one onto the "double" Roof Beam 1852.

Figure 26:
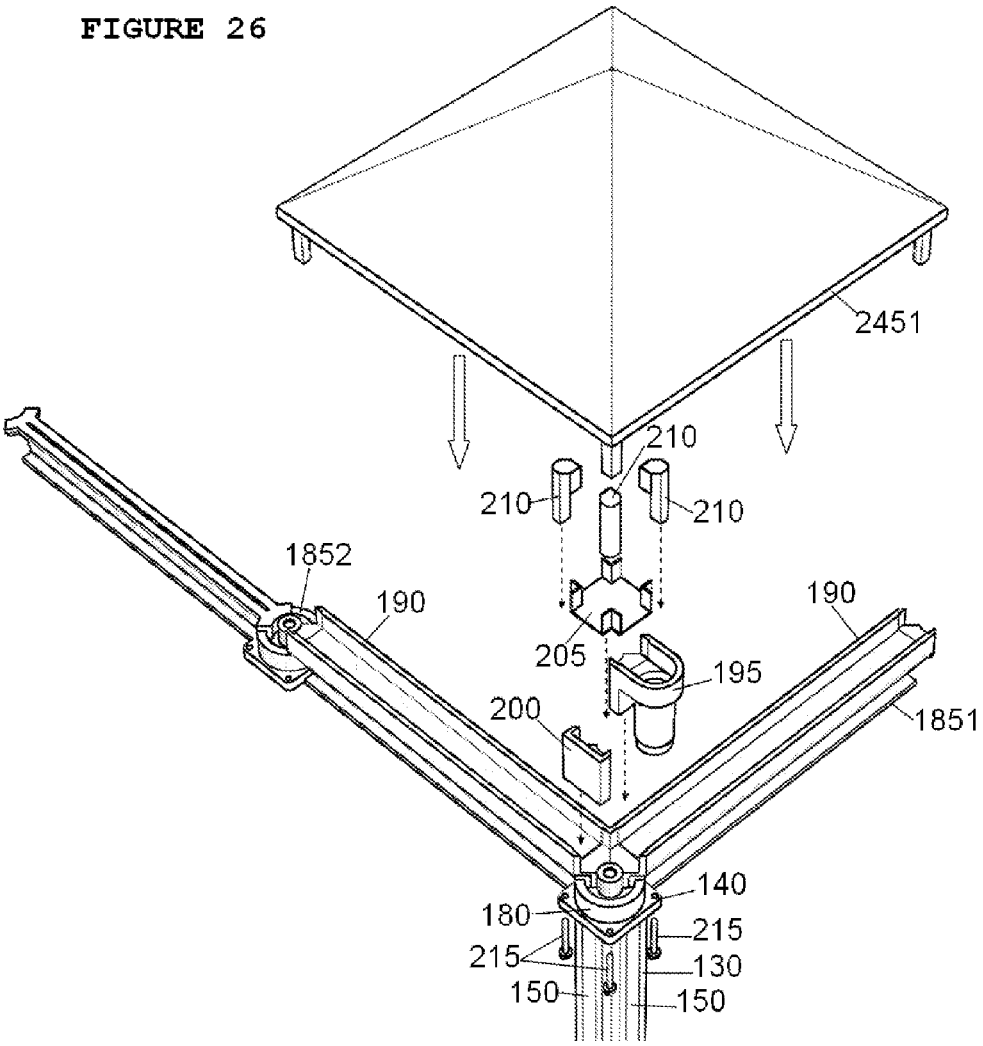

FIG. 26 is an elevated front perspective view of the same example corner assembly shown in FIG. 25, showing the relative installation positions of precipitation-directing and sealing components after the components shown in FIG. 25 have been installed. With the Roof Beam 1851-1852 and Integrated Gutter Section 190 components installed, this example corner assembly will be completed by installing a Downspout 195 and a Gutter Block 200 into the quadrants of the Roof Bracket 180 not filled by Integrated Gutter Section 190 components, with a Junction Seal 205 then installed to seal this junction of components at the Roof Bracket 180. Then a "single" Roof Panel 2451 will be installed downwardly into the corner formed by the Integrated Gutter Section 190 components. Three (3) Roofing Clamp 210 components will be installed down over the three "outside" corners of the junction. Three (3) Roof Bolt 215 components will be inserted upwardly through the respective corners 151 of the Roof Bracket 180 Cap and screwed into the threaded holes 212 in the Roofing Clamp 210 components, while a fourth Roof Bolt 215 (not visible here) will be inserted through the fourth (inside) corner hole 151 of the Post Bracket Cap 140 and screwed into the threaded hole 212 in the immediate corner post element of the "single" Roof Panel 2451.

Figures 27A, 27B:
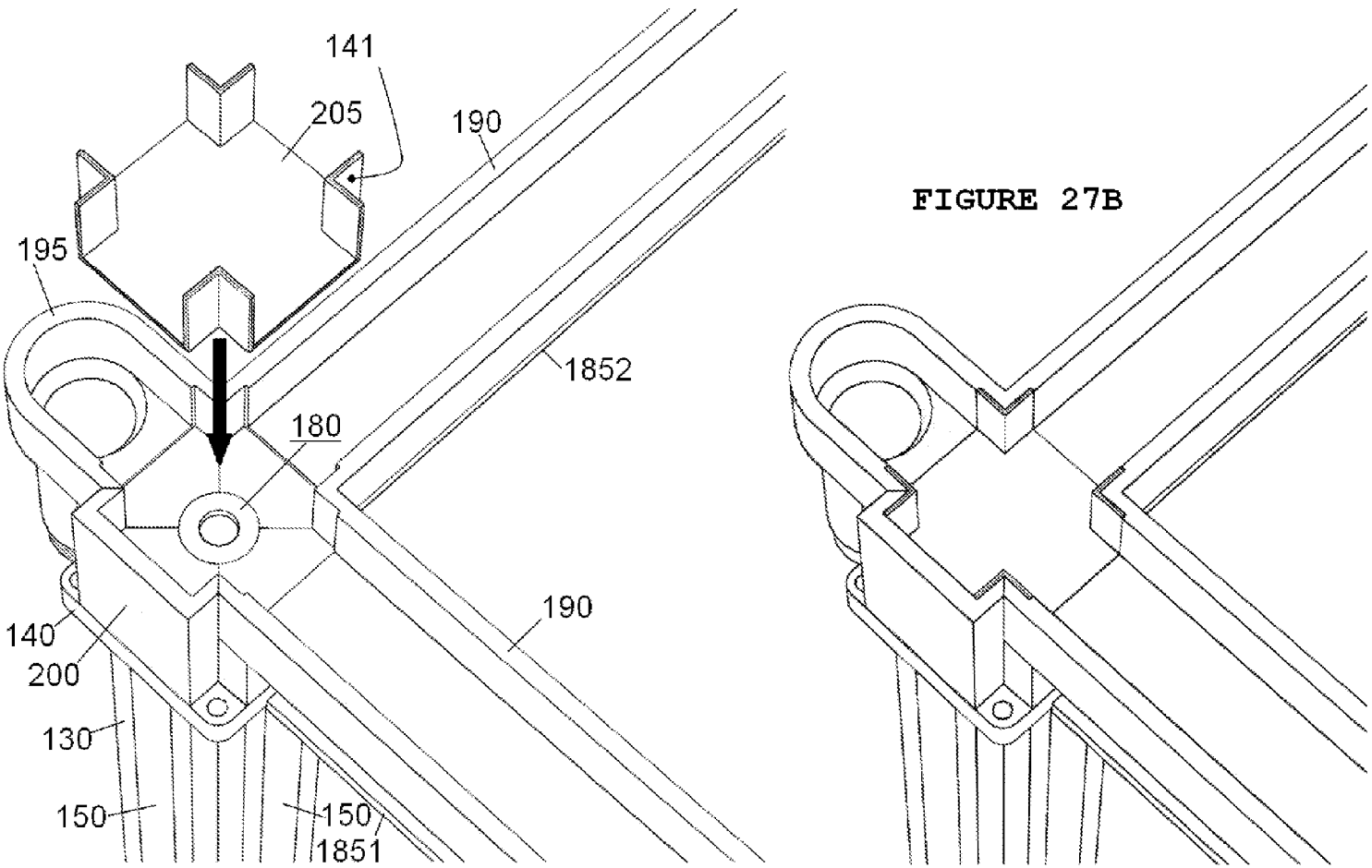
FIG. 27A is an elevated front perspective detail view of the installation of a junction seal component onto the junction of precipitation-conveying components installed at this example junction assembly; note the gasketing compound or material (141) on those surfaces of the junction seal component that cover the seams between the other components at this example junction of roofing components.
FIG. 27B is an elevated front perspective detail view of the now-installed junction seal component shown in FIG. 27A.

FIGS. 27A and 27B are, respectively, an elevated front perspective view of the installation of a Junction Seal 205 component onto the junction of components installed at this example junction assembly as shown in FIGS. 25 and 26, and, in FIG. 27B, an elevated front perspective view of the now-installed Junction Seal 205 component. The Downspout 195 and Gutter Block 200 components are shown in their installed positions relative to the Roof Bracket 180, Roof Beam 1851-1852 and Integrated Gutter Section 190 components. This view further illustrates the manner in which a variable combination of components can be arranged at the Roof Bracket 180 to accommodate any desired or required configuration of roofing assembly. The Junction Seal 205 completes any combination of installed components at a Roof Bracket 180, making it ready for the installation of Roof Panel 2451-2452 and/or Roofing Clamp 210 components.

Figure 28:
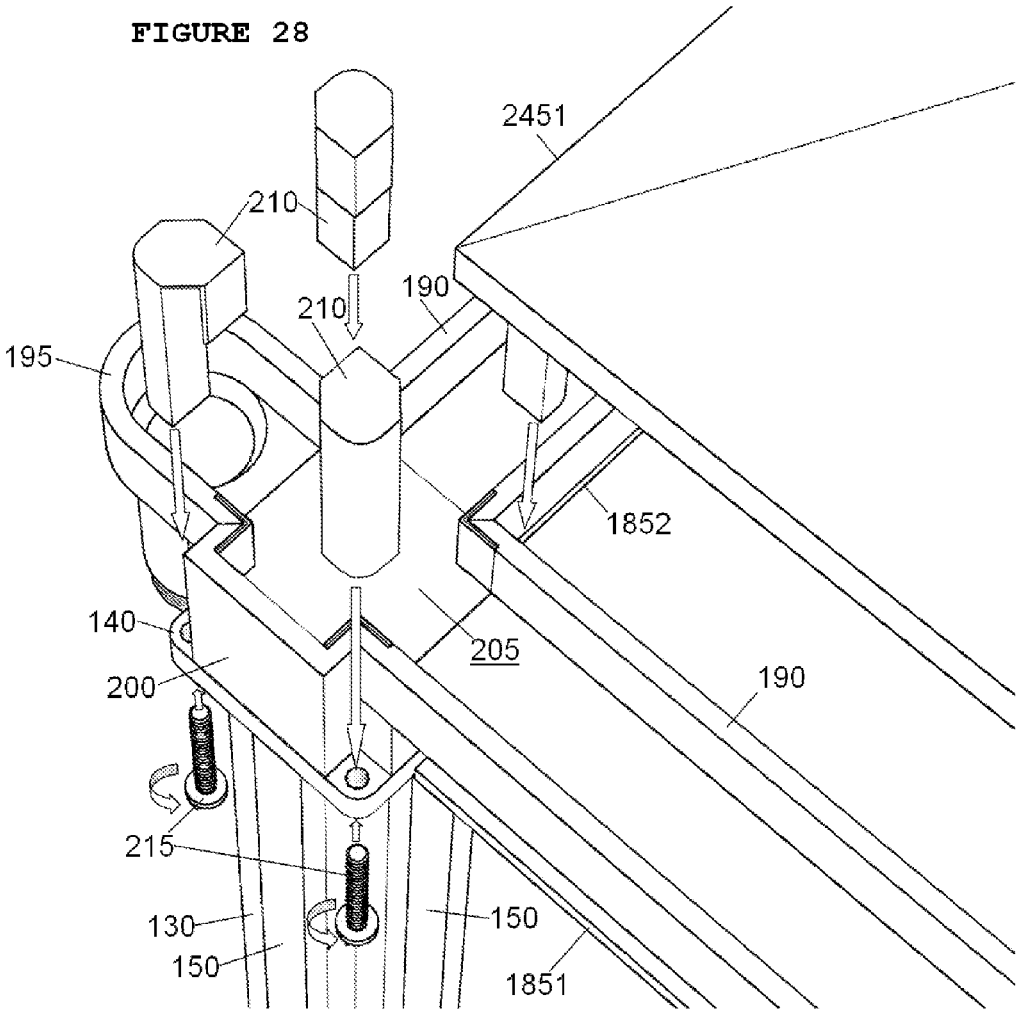

FIG. 28 is an exploded front perspective view of the relative installation positions of the final connecting and sealing components at this example junction. With the completed assembly of all other components at this example junction assembly, the Roofing Clamp 210 and Roof Panel 2451 components are installed. With the Roofing Clamp 210 and Roof Panel 2451 components in their installed positions, four (4) Roof Bolt 215 components will be inserted upwardly through the holes 151 in the corners of the Roof Bracket 180 Cap, and screwed into the threaded holes 212 in the Roofing Clamp 210 and Roof Panel 2451 post elements.

Figure 29:
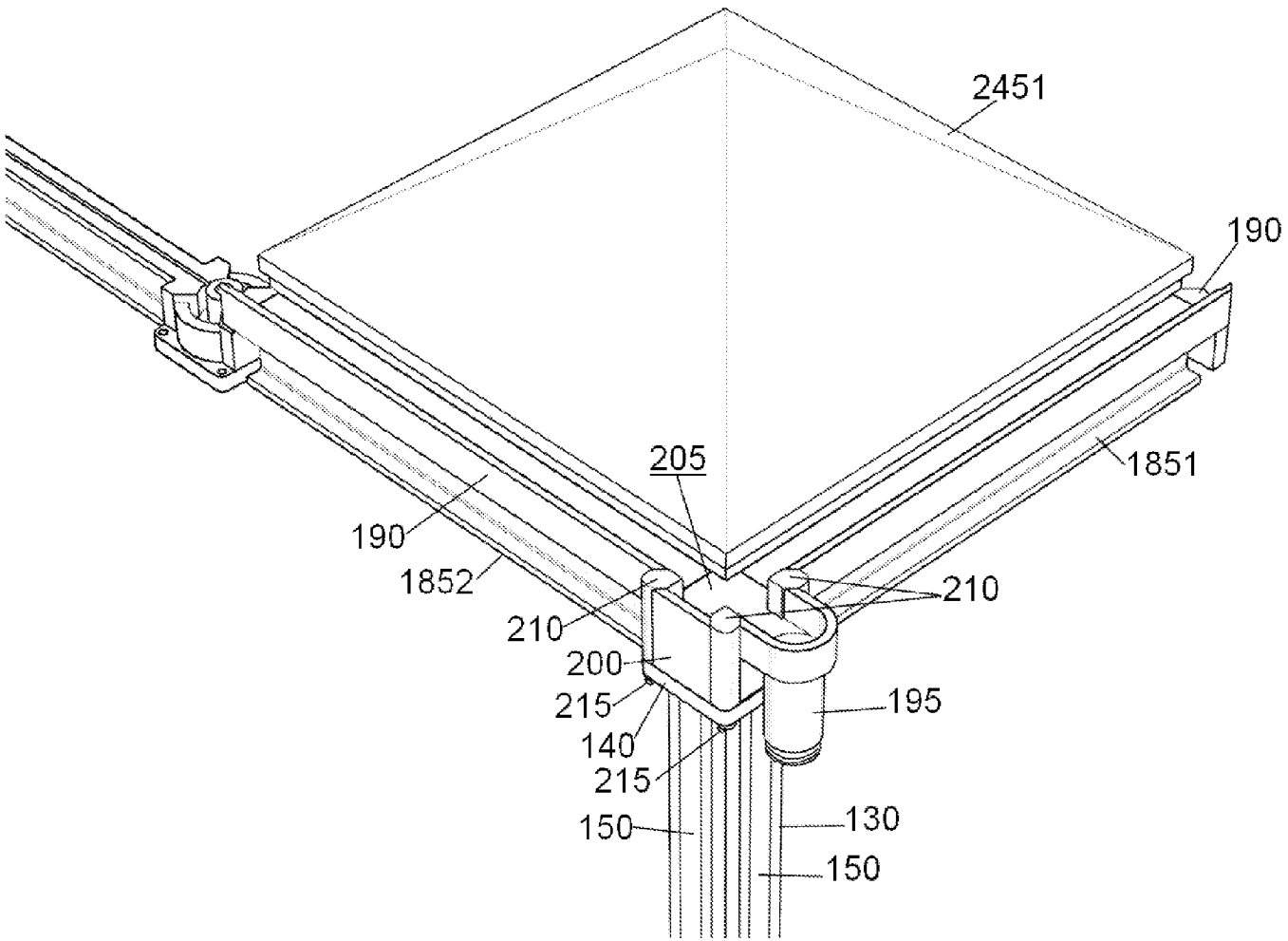

FIG. 29 is an elevated front perspective view of the completed example corner installation of roofing components shown in FIGS. 25 through 28. With four (4) Roof Bolt 215 components at each junction (one at each corner) regardless of the combination of components joined at the junction, each junction is securely fastened to the Post 1251-1252 assembly beneath it. The installation of a variety of roofing components is possible at any junction, depending on the desired configuration of the assembled structure, and the desired configuration of the roofing. It is not necessary to roof an entire structure. It is possible to roof only a portion of an assembled structure, and the area covered by the roofed portion need not correspond to the floored portion of the assembled structure.

FIGS. 30A through 30D are front exploded perspective views of an example series of possible combinations of Downspout 195, Downspout Pipe 220, Downspout Pipe Extension 225 and Water Fitting 2351-2352 component combinations. The pipe components are configured in two (2) lengths. The longer of the two is the Downspout Pipe 220, while the shorter is the Downspout Pipe Extension 225. The tops of the Downspout Pipe 220 and Downspout Pipe Extension 225 are threaded along their inner surfaces at a length equal to the length of the threading on the outside surface of the "pipe" portion of the Downspout 195. The Downspout Pipe 220 and Downspout Pipe Extension 225 components may be screwed together by hand in any desired or required configuration, and either may be screwed by hand onto the threaded "pipe" portion of the Downspout 195, thereby extending the water-conducting length of that component downward toward the installation surface.

The Downspout Pipe Extension 225 typically would be used to connect two (2) Downspout Pipe 220 components assembled to a full-height roofed structure, allowing the water flow to reach near the installation surface.

Depending on the height of the structure to which the Downspout 195 and its related components are to be installed, and also depending on the purpose desired by the installer, the combinations of these components for any particular assembly is completely variable.

Figure 30A:
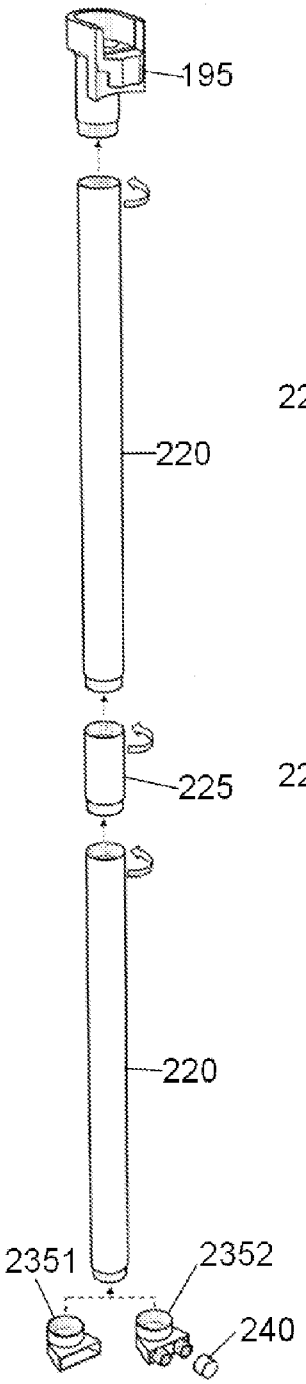
FIGS. 30A through 30D are exploded perspective views of four typical, but different, combinations of downspout, downspout pipe, downspout pipe extension, and water fitting components. These combinations vary depending on the height of the post assembly to which they are installed, and the final disposition of the water conveyed via the various assemblies.

The assembly shown in FIG. 30A could be used at a Downspout 195 assembly on a full-height structure to convey precipitation to a point near the installation surface, there to be either dispersed or harvested. At this near-installation-surface level, the harvesting configuration of the Water Fitting 2352 would allow connection to an underground water storage system, or conveyance of the water to a drainage system at some distance from the assembled structure, while the dispersal configuration Water Fitting 2351 would allow the dispersal of the water horizontally across and onto the installation surface. Refer to FIG. 32C for examples of the assembly shown in FIG. 30A.

Figure 30B:
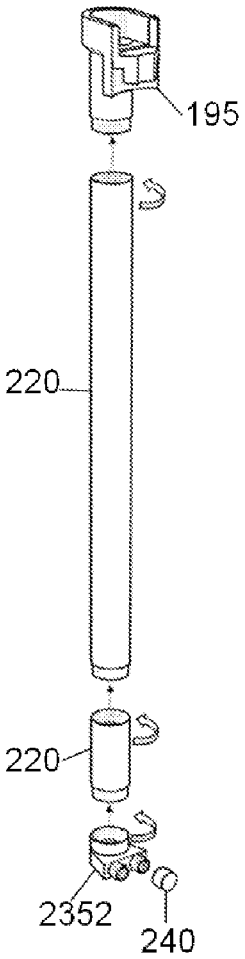

The assembly shown in FIG. 30B would allow connection at a point from just below the vertical midpoint of a full-height structure to an above-ground water storage system, such as a rain barrel or trough, for example. FIG. 32C also shows an example of this assembly.

Figure 30C:
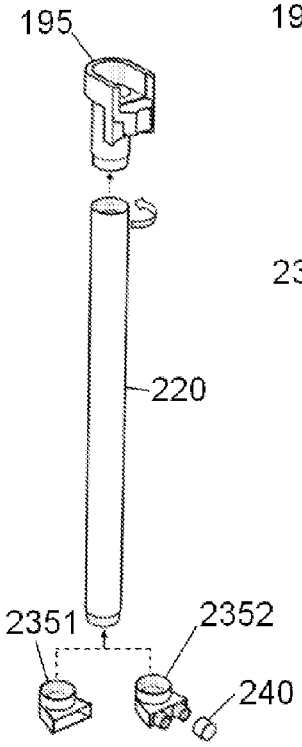

The assembly shown in FIG. 30C allows precipitation directed from a half-height roofed structure to be either dispersed over the installation surface, or connected to an underground storage system, or conveyed to a more distant drainage system. FIG. 32D shows an example of this assembly.

Figure 30D:
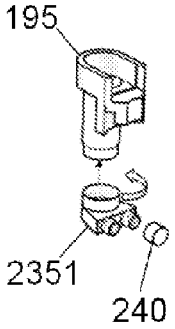

The assembly shown in FIG. 30D would allow precipitation directed from a half-height roofed structure to be connected to an above-ground storage system, such as a rain barrel or trough, for example. FIG. 32D also shows an example of this assembly.

As stated, these are only some of the possible configurations. Other configurations could be assembled, as desired or required. In each assembly where the harvesting configuration Water Fitting 2352 is used, the Water Fitting Cap 240 would be used to seal a threaded coupler of Water Fitting 2532 where a connection to a water storage system from both threaded couplers of Water Fitting 2352 is not made.

Figure 31:
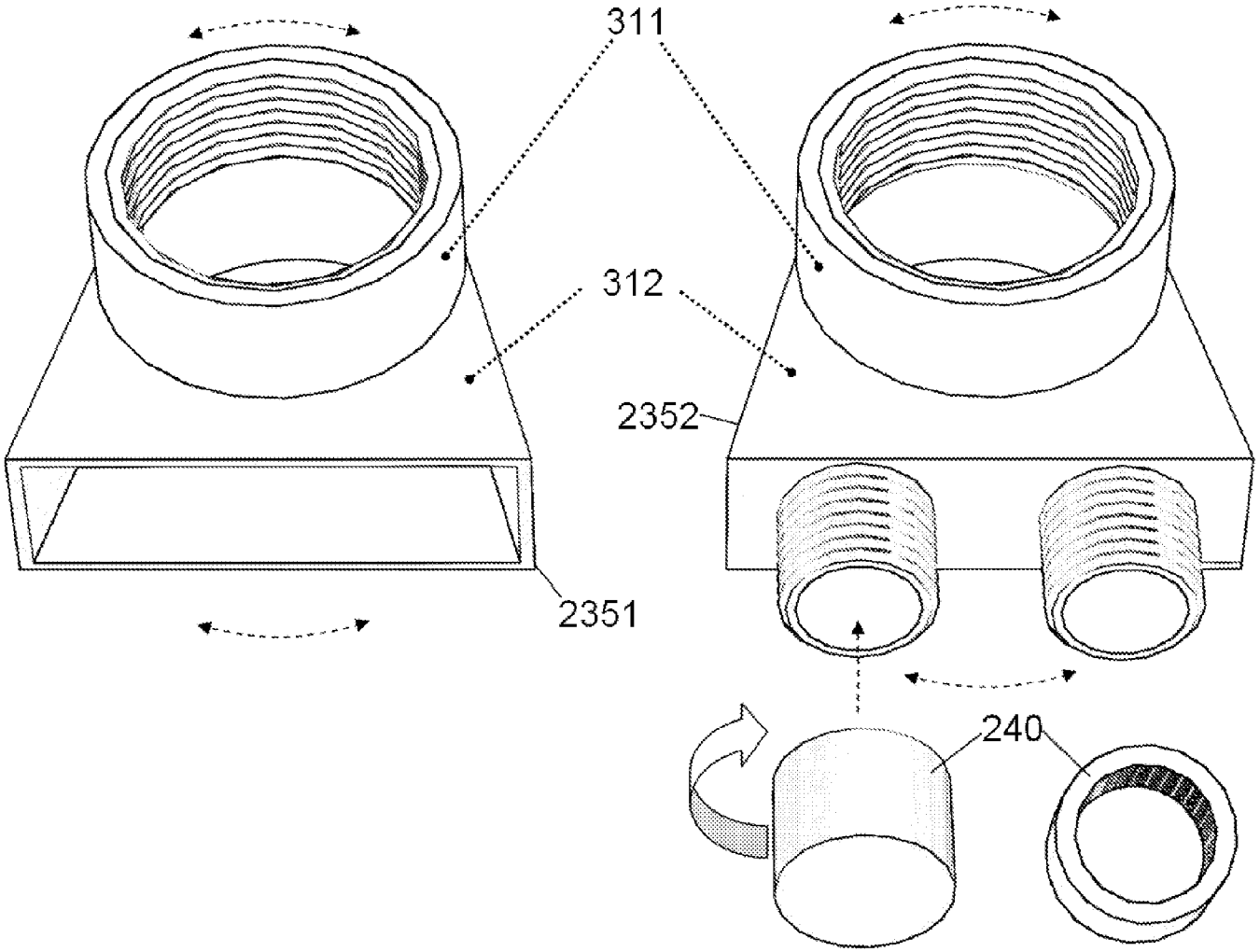
FIG. 31 is a front perspective view of a "dispersal" water fitting (2351), and a "harvesting" water fitting (2352). The top portion (311) of both configurations rotate freely and independently of the bottom portion (312), like the threaded coupling of a standard garden hose, as indicated by the directional-movement arrows.

FIG. 31 is a front perspective view of configurations of Water Fitting 2351-2352 components. If precipitation conveyed from the roofed portion of a structure is to be dispersed over the installation surface, then the dispersal configuration of the Water Fitting 2351 would be used. If this conveyed precipitation is to be collected (harvested) into a water storage system, the harvesting configuration of Water Fitting 2352 would be used. It is possible to use both fittings on the same assembled structure, although only one Water Fitting 2351-2352 component can be installed at the bottom terminus of any individual Downspout Pipe 220 assembly at a time. Except for the fan-shaped "exit" portion, both configurations are identical. The dispersal configuration simply redirects the flow of water at a horizontal 90 degree angle, presumably away from the assembled structure. The harvesting configuration has two threaded connectors set into a "plate" or "wall" obstructing the fan-shaped "exit" portion of Water Fitting 2351. These threaded connectors are of a size and threading to allow the connection of standard garden hoses or their equivalents to the two threaded outlets. The Water Fitting Cap 240 is used to seal a connector when no connection is made between one of the threaded outlets of the harvesting configuration and a water storage system. Like the threaded connector at each end of a standard garden hose and the body of the hose itself, the top 311 and bottom 312 portions of both Water Fitting 2351-2352 components rotate freely and independently of each other about their connecting juncture, allowing the Water Fitting 2351-2352 to be oriented to any desired or required direction.

Figure 32A:
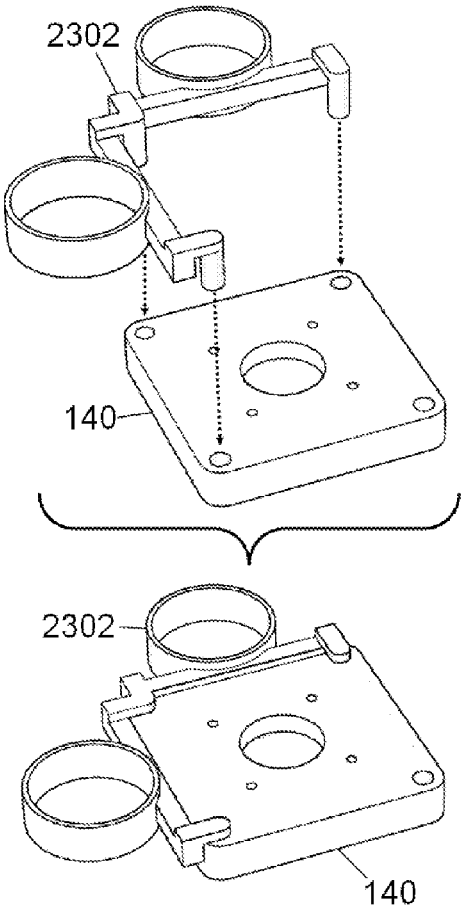
FIG. 32A is a combined exploded and installed perspective view of the "corner" configuration of downspout pipe stabilizer, shown in its installation position relative to the post bracket cap into which it would be installed, with a view of the downspout pipe stabilizer component after installation.
Figure 32B:
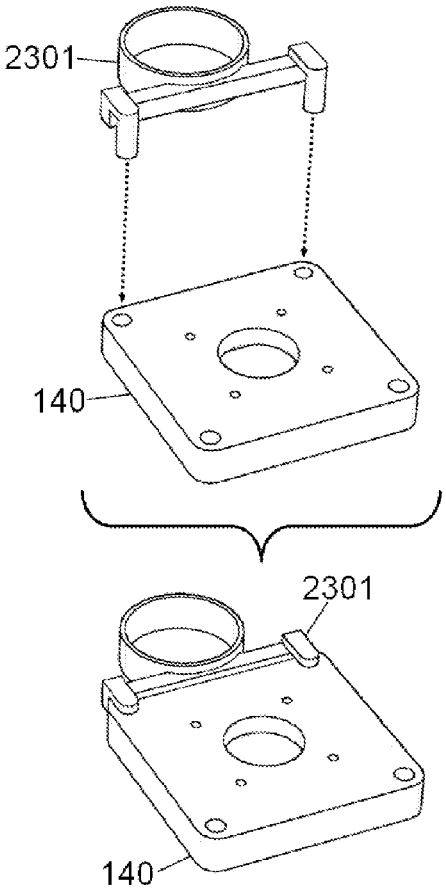
FIG. 32B is a combined exploded and installed perspective view of the "side" configuration of downspout pipe stabilizer, shown in its installation position relative to the post bracket cap into which it would be installed, with a view of the downspout pipe stabilizer component after installation.
Figure 32C:
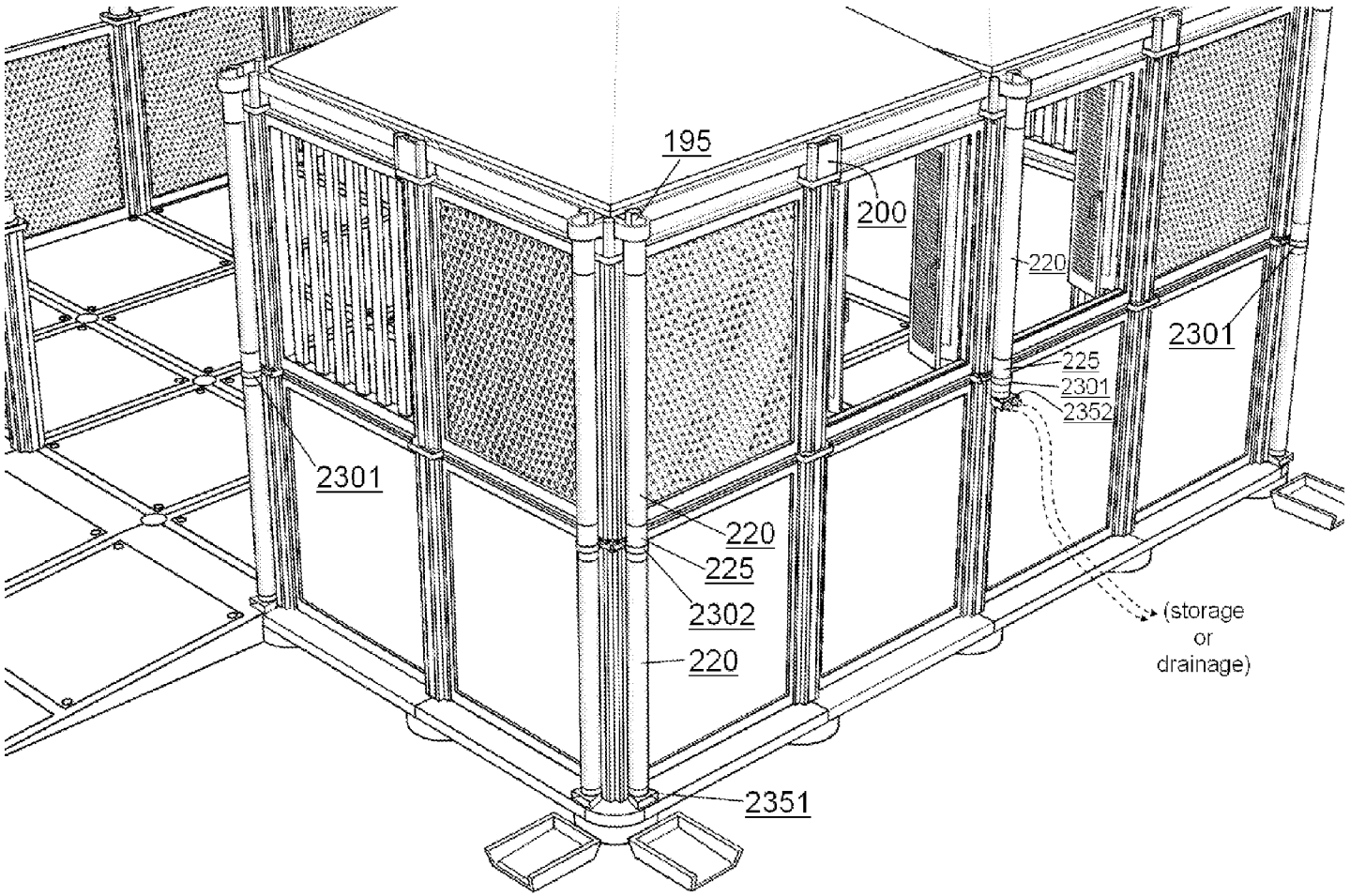
FIG. 32C is a perspective view of the full-height portion of an example structure, illustrating the downspout and pipe assemblies of FIG. 30A and FIG. 30B with the downspout pipe stabilizers in their installed locations, and also indicating the variable locations at which the assemblies may be installed, including two FIG. 30A assemblies immediately adjacent to each other at the near corner of the structure.
Figure 32D:
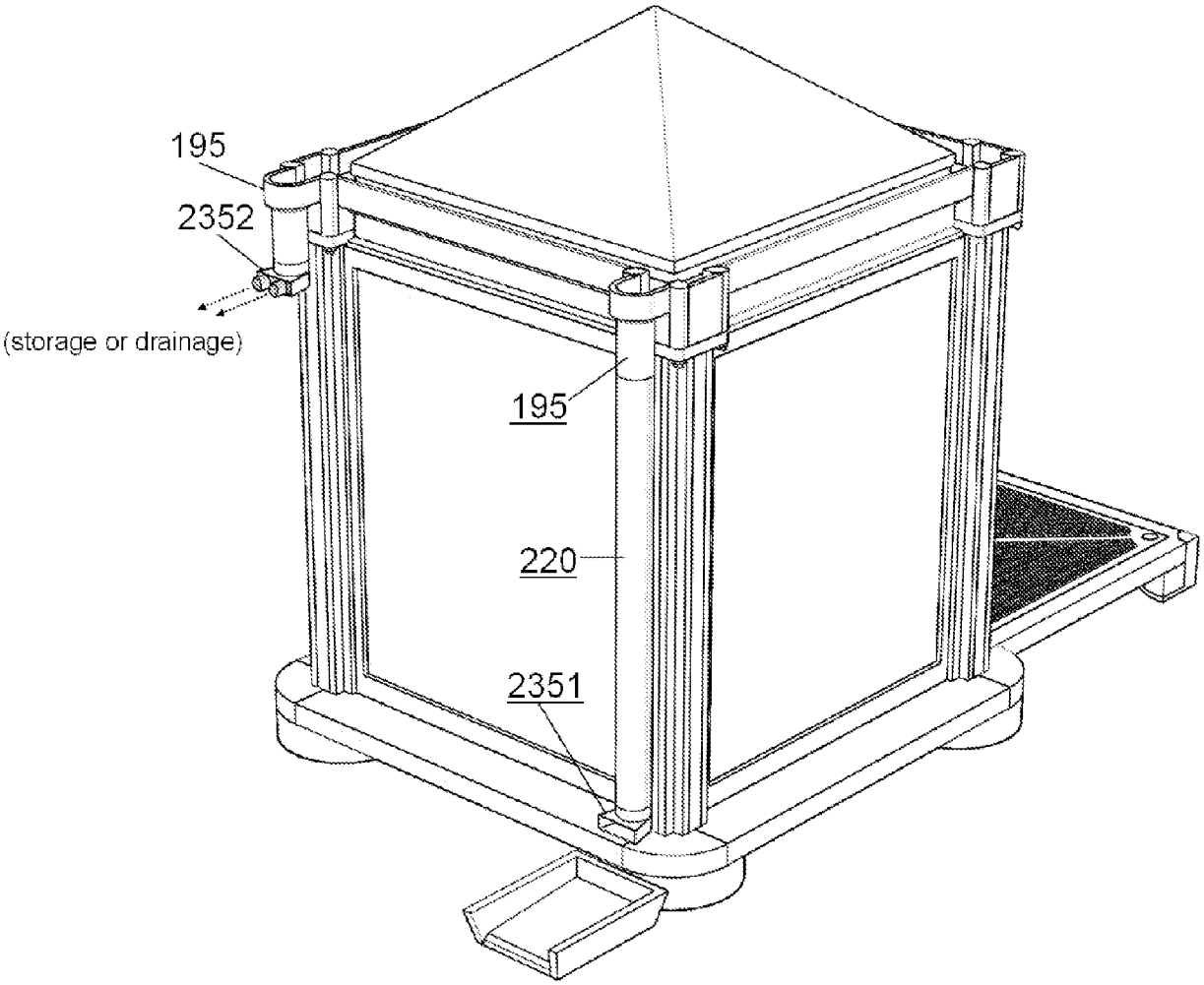
FIG. 32D is a perspective view of a half-height example structure, illustrating the downspout and pipe assemblies of FIG. 30C and FIG. 30D installed to a half-height structure.

FIGS. 32A and 32B are, respectively, a top and bottom perspective exploded and assembled views of an installation of Downspout Pipe Stabilizer 230 components into the corner holes 151 of a Post Bracket Cap 140. Downspout Pipe Stabilizer 230 components are typically used only with full-height assembled structures at those locations that have Downspout 195 assemblies installed. The Downspout Pipe Stabilizer 230 component has two configurations: 1) "Corner" 2301, and 2) "Side" 2302. The corner configuration 2302 is used at an "outside" corner of an assembled structure, when two Downspout 195 assemblies are installed adjacent at a right angle to each other at a single Post 1252 assembly. The "side" 2301 configuration is used at any other location where a Post Bracket Cap 140 has two adjacent corner holes available and a Downspout 195 assembly is installed. (Note: Downspout 195 assemblies, including Downspout Pipe Stabilizer 230 components, cannot be installed at an "inside", or ninety-degree L-shaped, corner of an assembled structure.)

The Downspout Pipe Stabilizer 230, in either configuration, consists of a ring element with an inside diameter large enough to allow a Downspout Pipe 220 or Downspout Pipe Extension 225 to fit snugly but smoothly through it. It is used at the approximate vertical midpoint of a full-height Downspout 195 assembly, or near the bottom of a Downspout 195 assembly extending downward from a Downspout 195 installed to approximately the vertical midpoint of a full-height structure (refer to FIG. 30B), typically for connection to an above-ground water storage system.

The "side" 2301 configuration has two (2) downward-projecting cylindrical extrusions at each end of a horizontal connecting bar. The two extrusions insert into two adjacent corner holes 151 of a Post Bracket Cap 140. The ring element is thus aligned with an installed Downspout 195 assembly, with the Downspout Pipe Extension 225 fitting inside the ring. This component provides stability to the Downspout 195 assembly by limiting vibration or other lateral movement of the Downspout 195 assembly caused by wind or the flow of water downward through the assembly. The "corner" configuration has an L-shaped horizontal connecting bar, with three (3) cylindrical downward-projecting extrusions, and is installed into three (3) Post Bracket Cap 140 corner holes 151. It provides the same stability for two Downspout 195 assemblies installed adjacent at a right angle to each other at an outside corner of an assembled full-height structure, that the "side" configuration provides for a single Downspout 195 assembly.

FIGS. 32C and 32D are perspective views of example structures illustrating possible combinations of Downspout 195, Downspout Pipe 220, Downspout Pipe Extension 225, and Water Fitting 2351-2352 components, as they could be installed to either half-height or full-height structures or assemblies. The tray-like implements shown beneath certain installed combinations of Downspout 195, Downspout Pipe 220, Downspout Pipe Extension 225, and Water Fitting 2351-2352 components, are not components of the invention in this disclosure, and are shown for illustrative purposes only.

Figure 33:
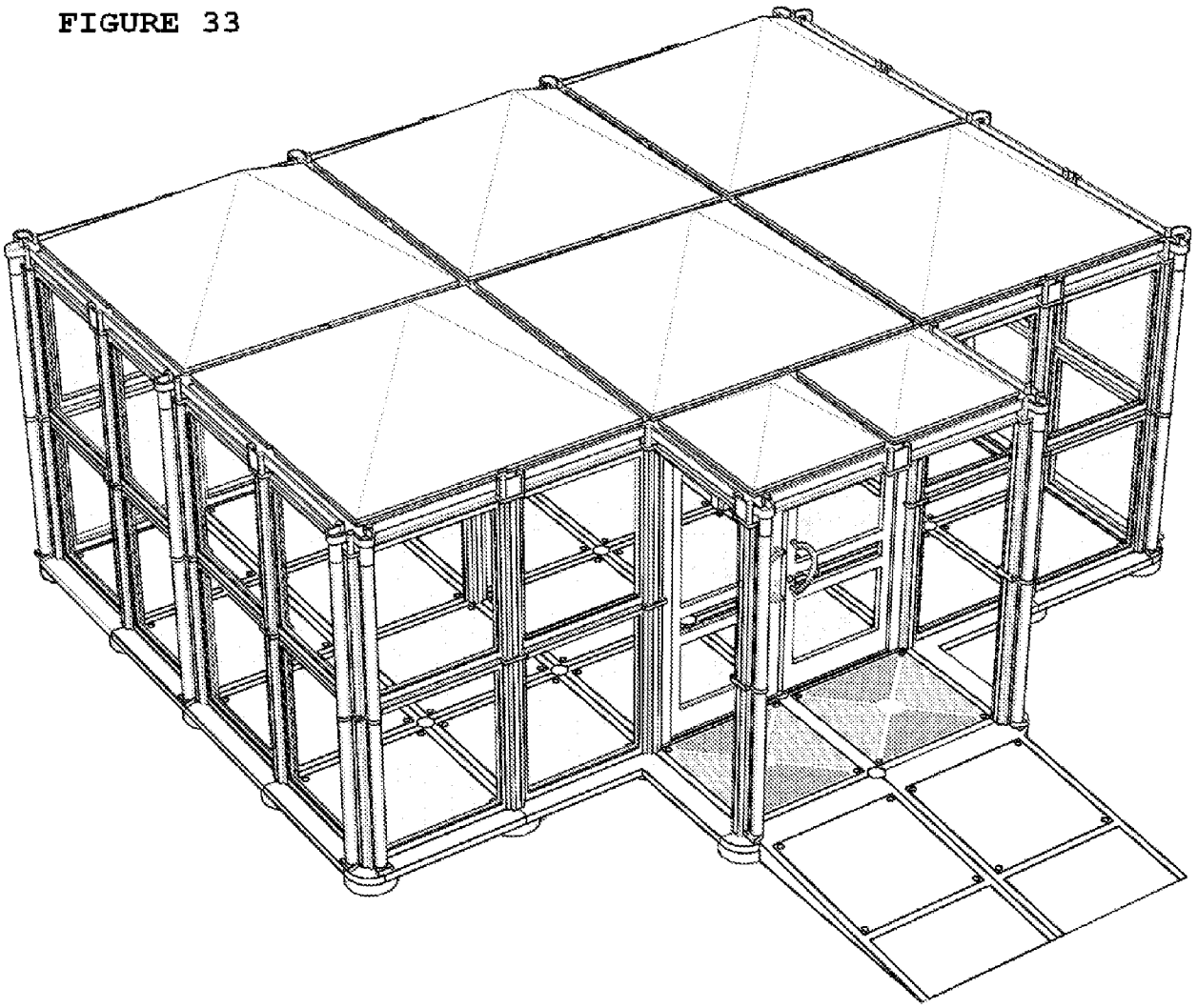
FIG. 33 is an elevated front perspective view of an example fully-enclosed and roofed structure.

FIG. 33 is an elevated front perspective view of an example fully-enclosed and roofed structure. This example structure illustrates some possible combinations of the Handmade Structure System components, and is intended to give a general idea of the possibilities for assembling structures using this invention. Although this example structure is basically rectangular, the inclusion of the roofed "porch" illustrates that this system of components is not limited to rectangular structures, nor is there any inherent limitation to the size or configuration of an assembled structure. The roofed "porch" also illustrates that the two Roof Panel 2451 and 2452 configurations and sizes can be used in a single structure. The Partition Panel 1351-1353 components shown in this example illustrate the variability of materials used for the interior "panel" portion of the Partition Panel 1351,1352, 1353, as they are shown here as being of a mesh screen material, rather than a solid (unperforated) "panel" element as illustrated in previous figures. Again, materials, configuration, functionality, etc. of the "panel" element is not included in this disclosure; any "panel" elements of a Partition Panel 1351-1352-1353 shown in this disclosure are shown only for illustration. The Floor Panel 110 components used to provide the floored surface of the "porch" illustrate that the Floor Panel 110 surface need not be solid (unperforated), but could also be "slotted" or "ventilated" (perforated), to allow precipitation to drain through the Floor Panel surface. The surface finish, materials, and decoration of the "panel" portions of Partition Panel 1351, 1352, and 1353 components, as well as the top surface of Floor Panel 110 components, is completely variable, allowing great flexibility in both the appearance and utility of these surfaces. Only the physical configuration and dimensions of the elements of floor panels and partition panels that fit into or connect with other components of the system are fixed or required. With the appropriate fittings installed to either a Partition Panel 135 or Floor Panel 110, it would be possible to conduct water, electricity, or heating/cooking gas into a structure. The configurations of Partition Panel 1351, 1352, 1353 components make possible fully functional windows in a variety of forms, bifold doors, wire-mesh panels, etc. While this example illustrates a full-height structure, it is possible to create fully-enclosed and roofed half-height structures (refer to FIG. 32D), or partially-enclosed and/or partially-roofed structures, and structures with separate sections or portions of variable height, enclosure, roofing, etc.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A system of integrated structural components for assembling variably-configured structures, with connection and support of said integrated structural components allowing said variably-configured structures to to be assembled without requiring the use of any tools by each of the integrated structural components being designed to slide together, screw together, or latch together, the system of integrated structural components comprising:

one or more floor panel frames, each of said one or more floor panel frames providing a supporting framework for a floor panel, said floor panel configured to be lowered into place and to fit into one of said one or more floor panel frames, wherein said one or more floor panel frames are shaped as a square table top with four legs, one of each of said four legs being located at a bottom corner of said square table top, said square table top comprising a square vertically recessed area, said square vertically recessed area consisting of: a square peripheral shoulder or rim with corners; a center; and horizontal support members extending diagonally from the corners of said square peripheral shoulder or rim toward the center of said square vertically recessed area and merging into a hollow, downwardly-projecting cylinder, a bottom surface of said hollow, downwardly-projecting cylinder providing a center support for said one or more floor panel frames and said floor panel, the bottom also providing an insertion point for a foundation anchor; a bottom opening of said hollow, downwardly-projecting cylinder having a smaller diameter than a top opening of said hollow, downwardly-projecting cylinder, thereby forming an obstructing shoulder or lip at said bottom opening;

said four legs each having a horizontal cross-section shaped as one quadrant of a flat toroid, each of said four legs insertable into a floor panel frame connector, with said four legs providing corner support for said one or more floor panel frames; wherein each of said four legs further comprising two round holes in a bottom surface extending upwardly into each of said four short legs, wherein said two round holes to receive a corresponding connector column of said floor panel frame connector; in a top surface of each corner of said square peripheral shoulder or rim of said square vertically recessed area is a slot, said slot connecting downwardly to a latch chamber, said latch chamber in the shape of two diagonally opposed quarter-circles;

said floor panel having corners and a horizontally-projecting top surface rim or lip, said horizontally-projecting top surface rim or lip resting on and supported by said square peripheral shoulder or rim of said square recessed area of said square table top of said one or more floor panel frames, and with a bottom surface shaped to fit onto and over and around upper surface portions of said horizontal support members and said hollow, downwardly-projecting cylinder of said one or more floor panel frames; wherein said floor panel is installed to said one or more floor panel frames by being lowered into place and secured at each corner to said one or more floor panel frames by a floor panel latch; said floor panel also having a slot in each corner, said slot centered within a round counter-sunk surface and vertically penetrating said floor panel;

said floor panel latch being configured for securing said floor panels to said one or more floor panel frames, said floor panel latch comprising a round top and a downwardly-projecting T-shaped flange, said round top having a cross-bar protruding upwardly from a vertically-recessed surface to allow said floor panel latch to be rotated horizontally by hand; wherein when said T-shaped flange is inserted through said slot in said each said corner of said floor panel, with said T-shaped flange continuing into said latch chamber, said floor panel latch is rotated ninety degrees clockwise, thereby placing said T-shaped flange in opposition to said slot in a top surface of each said corner of said square peripheral shoulder or rim of said square vertically recessed area of said one or more floor panel frames, thereby securing said corner of said floor panel to said one or more floor panel frames;

said floor panel frame connector comprises a plurality of variously-configured floor panel frame connectors for connecting and supporting two or more of said one or more floor panel frames into a variable horizontal arrangement or floor plan, wherein at least one of said plurality of variously-configured floor panel frame connectors being configured to receive a post wherein said post provides vertical support for a post bracket;

said plurality of variously-configured floor panel frame connectors being individually configured to receive, support, and connect said four legs of one, or two, or three, or four of said one or more floor panel frames in a right-angle, four-quadrant radial pattern, said one or more floor panel frames being installed by being lowered into place onto said plurality of variously-configured floor panel frame connectors;

a first connector configuration of said plurality of variously-configured floor panel frame connectors comprising a full-circle flat base having a periphery and an upwardly-projecting round center column, with eight connector columns symmetrically and radially arranged and spaced around said round center column, each of said connector columns equidistant between the periphery of said full-circle flat base and a side surface of said upwardly-projecting round center column, and projecting upwardly from a surface of said full-circle flat base;

three additional different connector configurations of said plurality of variously-configured floor panel frame connectors deriving from a full-circle configuration comprising three-quarters of said full-circle configuration, one-half of said full-circle configuration, and one-quarter of said full-circle configuration; each of the additional different connector configurations comprising a round center column containing a vertical unthreaded bore hole in the center of a top surface of said round center column;

a fifth connector configuration of said plurality of variously-configured floor panel frame connectors comprising a threaded hole in a top center surface of an upwardly-projecting round center column, and an upwardly-projecting sidewall around a periphery of a full-circle flat base; said threaded hole configured to accept a threaded end of a variable-height post, thereby allowing the installation of partitioning components or roofing components;

said variable-height post includes a plurality of variable-height posts comprising a threaded bottom outer surface, a center hole running a full length of said variable-height post, said center hole being threaded at a top portion of said variable-height post, allowing for screw-in installation of either a finial or said roofing components;

edge frame sections for providing filler to said plurality of variously-configured floor panel frame connectors and providing a finished edge; said edge frame sections having downwardly-projecting leg elements identical in configuration to said four legs of said one or more floor panel frames, a post bracket, consisting of a square core having four sides, with a center bore hole running a full length of said square core of said post bracket, and with a T-shaped channel running a full length of each of the four sides of said square core, said T-shaped channel for receiving a partition panel frame or a finishing strip; and wherein said post bracket is installed by sliding said post bracket down onto and over said plurality of variable-height posts;

partition panel frames configured to be slidably inserted into said T-shaped channel running the full length of said each of the four sides of said square core of said post bracket, said partition panel frames being of a generally rectangular shape, and having a vertical side element with a horizontally-oriented T-shape, said horizontally-oriented T-shape corresponding to said T-shaped channel of said post bracket;

said finishing strip configured to be installed into said T-shaped channel of said post bracket into which no partition panel frame is installed;

a junction cap, said junction cap configured to be installed to any of the plurality of variously-configured frame connections to prevent the accumulation of water, debris or other detritus;

a post bracket cap, fitted to said post bracket, for providing a physical support and functional connection at a top of said post bracket for said roofing components or said finial; said post bracket cap configured as a square, with a bore hole in a center top surface of said post bracket cap, said bore hole extending vertically through a body of said post bracket cap; said post bracket cap also having vertical bore holes in each corner of, and extending through the body of, said post bracket cap; said post bracket cap also having four smaller-diameter vertical bore holes arranged symmetrically around said vertical bore hole in said center top surface of said post bracket cap, said vertical smaller-diameter bore holes extending through the body of said post bracket cap; a bottom surface of said post bracket cap has channels corresponding to a shape of the top upwardly-projecting surface of said post bracket, with said channels in said bottom surface of said post bracket cap being of a depth sufficient to cover and envelop said top upwardly-projecting surface of said post bracket; and said finial having a variably-configurable upper body element and a downwardly-projecting threaded bolt element, said finial installed by screwing said threaded bolt element into said variable-height posts.

2. The system of integrated structural components in accordance with claim 1, further comprising said roofing components, wherein said roofing components comprise:

a roof bracket configured as a hollow cylinder with a smaller-diameter cylindrical central column projecting upwardly from a floor of said hollow cylinder, with a bore hole in a top surface of said cylindrical central column, with a resultant circular channel between a sidewall of said hollow cylinder and a vertical side surface of said smaller-diameter cylindrical central column, with said roof bracket also having a threaded bolt element projecting downwardly from a base of said roof bracket; wherein said roof bracket is installed by inserting said bolt element through the bore hole of said post bracket cap, said post bracket cap serving as a support for said base of said roof bracket, with said bolt element screwed into said variable-height posts; said circular channel of said roof bracket receiving downwardly-projecting curved tangs at the ends of roof beams, gutter blocks, and downspouts, with one said roof beam, said gutter block, and said downspout installed into said circular channel of said roof bracket said roof beams, each of said roof beams having end elements with said end elements of said roof beam configured to be inserted into said roof bracket, with said roof beam of a variable length and a mid-point configuration for providing connectivity and horizontal support for said roofing components; said end elements, having an outermost curved downwardly-projecting tang shorter than an innermost curved downwardly-projecting tang, said outermost and innermost curved downwardly-projecting tangs configured to fit over and onto said roof bracket, with the outermost downwardly-projecting tang inserted into said circular channel of said roof bracket while the said innermost curved downwardly-projecting tang rests on and is supported by a top edge surface of said post bracket cap; said outermost curved downwardly-projecting tang of said roof beam only fills one-half of a horizontal radial thickness of said circular channel; said roof beam having two different configurations consisting of a single configuration and a double configuration having longitudinal supporting elements, wherein the longitudinal supporting elements are formed as I-beam elements, and said double configuration of said roof beam provides for a greater span of support and said single configuration of said roof beam accepts one integrated gutter section, while said double configuration of said roof beam accepts two said integrated gutter sections; a top surface of said I-beam element is longitudinally divided by a continuous channel running a full length of said I-beam element; each end of said top surface of said I-beam element is wedge-shaped so as to occupy only one-quadrant of a top circumferential area of said roof bracket, thereby allowing up to four said roof beams to be installed into one said roof bracket;

said integrated gutter sections configured to be inserted into said roof bracket and onto said roof beams for providing a conduit for conveying precipitation and serving as a connection point for a roof panel; each end of said integrated gutter section has a single curved downwardly-projecting tang, said curved downwardly-projecting tang to be inserted into said circular channel of said roof bracket; said integrated gutter sections have a longitudinal downwardly-projecting tab running a full length of a bottom surface of said integrated gutter sections, with said longitudinal downwardly-projecting tab inserted into said continuous channel in said top surface of said roof beam, for providing a seal against precipitation ingress, and resisting lateral or horizontal; and further comprising top edge portions of upwardly-projecting sidewalls for serving as receivers and supports for said roof panel;

a gutter block, configured to be inserted into said roof bracket to block the outflow of precipitation conveyed to said roof bracket by said integrated gutter sections, wherein the gutter block serves as a connection point said roof panel; said gutter block comprising a barrier end wall;

a downspout, configured to be inserted into said roof bracket via curved downwardly-projecting tangs to collect and funnel precipitation conveyed to an installation point of said roof bracket by said integrated gutter sections or said gutter;

a downspout pipe, comprising a cylindrical tube or pipe, connectable with said downspout or a downspout pipe extension to a water fitting, via a threaded inner surface at a top of said downspout pipe, and a threaded inner surface at a bottom of said downspout; said downspout pipe for conveying precipitation collected and drained by said downspout from a roofed portion of a structure or assembly toward the ground;

a downspout pipe extension, identical with said downspout pipe except for being shorter in length, for allowing variations in overall height;

a downspout pipe stabilizer having two configurations, one said configuration to be installed into said bore holes in of said post bracket cap, or into three said bore holes in two of said post bracket cap, said two sides of said post bracket cap adjacent at a shared right angle, said downspout pipe stabilizer consisting of a horizontal supporting and connecting bar and a circular band of an inner diameter sufficient to allow the passage of said downspout pipe or downspout pipe extension through said circular band;

said roof panel comprising a variously-sized and configured roof panels, configured to be installed onto and supported by sidewalls of said integrated gutter sections, or combinations of the sidewalls of integrated gutter sections and said gutter blocks, and also supported by and secured to said post bracket cap, said sidewalls of said integrated gutter sections, and said sidewalls of said gutter block, via downwardly projecting post elements;

said variously-sized and configured roof panels have square bases with a continuous downward-facing channel encompassing a full periphery; downwardly-projecting post elements at each corner of said square bases, said downwardly-projecting post elements having a vertical threaded hole in a bottom center surface of said post element, and with upwardly-projecting roofing surface elements of a four-sided pyramidal shape; one of said variously-sized and configured roof panels is sized to shelter a horizontal surface area approximately equal to the surface floor area of one said one or more floor panel frames; a second one of said variously-sized and configured roof panel is sized to shelter a horizontal surface area approximately equal to the surface floor area of four said one or more floor panel frames assembled in a square two-by-two arrangement;

a roofing bolt; sized and threaded to be inserted upwardly through a bottom aperture of said bore holes in said corners of said post bracket cap, said roofing bolt screwed into either said roof panel, or into a roofing clamp;

and a roofing clamp consisting of a post element combined with an inverted, hook-shaped element, said roof clamp used to cover and secure a vertical seam between said integrated gutter sections, downspouts, gutter blocks, or any combination thereof, installed to said roof bracket.

3. The system of integrated structural components in accordance with claim 2 further comprising said downspout inserted to said roof bracket, said downspout consisting of: 1 a body configured as an elongated semi-circular floor surrounded by upwardly-projecting sidewalls, with a beveled or counter-sunk hole in said floor a downwardly-projecting pipe element descending from said hole to drain precipitation toward the ground and two curved, downwardly-projecting tangs, wherein an outermost, shorter of said tangs to be inserted into said roof bracket, and a longer, innermost tang to rest on and be supported said post bracket cap; said downspout providing a collection and exit point for precipitation conveyed via said integrated gutter sections.

4. The system of integrated structural components in accordance with claim 3 further comprising a junction seal fitted to said roof bracket, with said junction seal comprising a square flat floor surface, and with upwardly-projecting outward-facing right-angle corner elements, said corner elements cover horizontal and vertical seams; and a round, downward projection from a bottom surface of said square flat floor surface of said junction seal fits into said bore hole in the top surface of said cylindrical central column of said roof bracket.

5. The system of integrated structural components in accordance with claim 3 further comprising a water fitting connected to said downspout pipe or said downspout, for directing precipitation onto an installation surface or to a water containment system; said water fitting having two configurations, said two configurations allowing precipitation outflow to be either dispersed horizontally over the ground, or connected via threaded couplings to a water storage or drainage system; said water fitting have a top threaded element, allowing said water fitting to be screwed onto said downspout, or said downspout pipe, or said downspout pipe extension, and a bottom element, said bottom element configured either for unrestricted outflow of water or an outflow-blocking barrier element pierced by and configured with two threaded couplers, said threaded couplers for connection to an external water conveyance, said conveyance leading to or connecting to an external storage or drainage system or location; the top and bottom elements of said water fitting rotate freely and independently about a connection point.

6. The system of integrated structural components in accordance with claim 1 wherein said post bracket further comprises dowels in a bottom surface of said post bracket for insertion into said plurality of floor panel frame connectors to prevent the rotation of said post bracket around said variable-height post.

7. The system of integrated structural components in accordance with claim 1 wherein said one or more floor panel frames include a ramp for providing an inclined surface between an installation surface and a structure or assembly; said ramp is configured to be installed to said floor panel frame connectors with two short toroidally-shaped legs at a non-inclined end of said ramp.

8. The system of integrated structural components in accordance with claim 1 further comprising an anchor component inserted through said hollow center cylinder of said one or more floor panel frames and screwed into the ground in order to anchor said one or more floor panel frames to an outdoor installation surface; said anchor consists of a top tang for gripping and driving said anchor component into the ground, a retaining disc below the tang, a shaft of variable length, and circular or helical tines at or near a bottom end of a shaft.

* * * * *